US006884271B2

(12) United States Patent
Wenzel

(10) Patent No.: US 6,884,271 B2
(45) Date of Patent: Apr. 26, 2005

(54) COMPOSITION AS AN ADDITIVE TO CREATE CLEAR STABLE SOLUTIONS AND MICROEMULSIONS WITH A COMBUSTIBLE LIQUID FUEL TO IMPROVE COMBUSTION

(75) Inventor: Deborah Wenzel, San Francisco, CA (US)

(73) Assignee: Saga Fuel Systems, Inc., San Francisco, CA (US)

( * ) Notice: Subject to any disclaimer, the term of this patent is extended or adjusted under 35 U.S.C. 154(b) by 278 days.

(21) Appl. No.: 10/078,820

(22) Filed: Feb. 19, 2002

(65) Prior Publication Data

US 2003/0093941 A1 May 22, 2003

Related U.S. Application Data

(63) Continuation of application No. 09/228,821, filed on Jan. 11, 1999, now Pat. No. 6,348,074.

(60) Provisional application No. 60/071,181, filed on Jan. 12, 1998, provisional application No. 60/079,686, filed on Mar. 27, 1998, and provisional application No. 60/093,305, filed on Jul. 17, 1998.

(51) Int. Cl.[7] ..... C10L 1/032

(52) U.S. Cl. ..... 44/302; 44/385; 44/408; 44/280

(58) Field of Search ..... 44/302, 385, 408, 44/280

(56) References Cited

U.S. PATENT DOCUMENTS

| | | | | |
|---|---|---|---|---|
| 2,194,496 | A | 3/1940 | Christensen | 44/9 |
| 3,988,122 | A | 10/1976 | Rosenthal et al. | 44/56 |
| 4,083,698 | A | 4/1978 | Wenzel et al. | 44/51 |
| 4,384,872 | A | 5/1983 | Kester et al. | 44/56 |
| 4,451,265 | A | 5/1984 | Schwab et al. | 44/51 |
| 4,451,267 | A | 5/1984 | Schwab et al. | 44/53 |
| 4,526,586 | A | 7/1985 | Schwab et al. | 44/53 |
| 4,732,576 | A | 3/1988 | Friedrich et al. | 44/51 |
| 5,004,479 | A | 4/1991 | Schon et al. | 44/302 |
| 5,025,759 | A | 6/1991 | Wenzel et al. | 123/56 AC |
| 5,360,458 | A | 11/1994 | Forsberg et al. | 44/301 |
| 5,746,783 | A | 5/1998 | Compere et al. | |
| 5,997,590 | A | 12/1999 | Johnson et al. | |
| 6,017,368 | A | 1/2000 | Steinmann | |
| 6,348,074 | B1 * | 2/2002 | Wenzel | 44/302 |

FOREIGN PATENT DOCUMENTS

| | | | |
|---|---|---|---|
| GB | WO 9817745 | 4/1998 | C10L/1/14 |
| IT | RO71636 | 3/1981 | C10C/1/06 |
| JP | 750054927 | 11/1976 | C10L/1/18 |
| JP | 790084846 | 2/1981 | C10L/1/18 |
| JP | 800019549 | 9/1981 | C10L/1/18 |

* cited by examiner

*Primary Examiner*—Jerry D. Johnson
(74) *Attorney, Agent, or Firm*—Peters, Verny, Jones, Schmitt & Aston, LLP; Howard M. Peters

(57) ABSTRACT

The present invention relates to an additive composition for a combustible fuel to produce improved combustion and reduced exhaust pollution of the combusted fuel, which additive composition comprises:

a) one or more water-soluble alcohols having between 1 and 5 carbon atoms, in an anhydrous state or as a 0.5–36% aqueous solution, and one or more of the following:

b) one or more straight- or branched- chain alcohols having between 6–18 carbon atoms;

c) one or more ethoxylated alcohols having between 12 and 18 carbon atoms where the ethylene oxide add-on is less than 5 moles;

d) a fatty acid of the structure R—(C═O)—OH having from 10 to 24 carbon atoms with e) a source of nitrogen in an anhydrous state or as an aqueous solution; wherein components a) to e), when combined with mixing with said combustible fuel, form a clear, stable microemulsion having a viscosity similar to the liquid fossil fuel. Combustion is improved and pollutant and particulate levels are reduced.

27 Claims, 10 Drawing Sheets

COMPOSITION AS AN ADDITIVE TO CREATE CLEAR STABLE SOLUTIONS AND MICROEMULSIONS WITH A COMBUSTIBLE LIQUID FUEL TO IMPROVE COMBUSTION

RELATED APPLICATIONS

This application is a continuation or application under 37 CFR 1.53(d), (continued prosecution application (CPA)) of prior application No. 09/228,821 filed on Jan. 11, 1999, now U.S. Pat. No. 6,348,074, application of U.S. Ser. No. 60/071,181, filed Jan. 12, 1998; U.S. Ser. No. 60/079,686, filed Mar. 27, 1998; and U.S. Ser. No. 60/093,305, filed Jul. 17, 1998, all of which are incorporated herein by reference in their entirety.

BACKGROUND OF THE INVENTION

1. Field of the Invention

The present invention concerns a novel composition of ingredients which are used as an additive to a combustible liquid fuel to produce a clear stable solutions or microemulsions with the fuel. The additive meets or exceeds liquid property specification requirements of the combustible fuel and greatly improves the overall combustion of the fuel while reducing significantly unwanted smoke, particulates, toxic gases, noxious gases and the like. Specifically the additive composition includes one or more of the following: aqueous, or anhydrous water-soluble alcohols and includes optionally one or more of the following: water-insoluble alcohols; ethoxylated alcohols; and fatty acids partially neutralized with a volatile source of basic nitrogen, while specifically limiting the use of ethylene oxides and specifically excluding conventionally used glycerine, esterification products, metals, non-biodegradable solvents, and certain other components.

2. Description of Related Art

Much research, effort and time have been expended to produce fuel compositions for internal combustion engines which show significant decreases upon combustion of toxic exhaust gases or vapors, particulates, smoke, and the like without sacrifice of engine performance or efficiency.

It is currently known by those skilled in the art that the introduction of oxygenators into fossil fuels contributes to better burning and the reduction of toxic exhaust emissions. Ethanol is one such oxygenator which, when used with gasoline for instance, reduces toxic emissions.

A problem, however, is that ethanol attracts water and will separate from gasoline in the presence of certain amounts of water condensation. Another problem is that ethanol is generally denatured using methanol, which exacerbates the problem of water separation and produces unacceptable solvency levels, such that ethanol/methanol/gasoline mixtures cannot be transported through existing pipelines. The present invention solves the problem of water condensation in the presence of ethanol/gasoline mixtures by creating clear microemulsions that are bio-degradeable, do not separate, and actually make use of small amounts of water for superior combustion temperatures. The present invention also solves the problem of solvency levels of ethanol/gasoline mixtures by utilizing components that meet storage and shipping requirements for gasoline.

Another problem associated with using ethanol as an oxygenator is that ethanol, as well as methanol and other water-soluble alcohols, will not mix at all with less refined fossil fuels, such as Diesel fuel or other distillate fuels like kerosene.

The present invention makes it possible to introduce ethanol into Diesel and other distillate fuels, forming biodegradable clear, stable solutions and microemulsions that will absorb water condensation for optimal combustion temperatures and uses other water-soluble alcohols for their oxygenating properties.

There are many components which when mixed together form emulsions with liquid hydrocarbons, fuels, refined renewable resources (vegetable oils) and the like. However, most mixtures of components do not meet the present set of fuel storage and combustion regulations and engine performance parameters.

These requirements include, for example:

A fuel/additive composition must form a clear, stable, water-in-oil microemulsion where water and water-soluble components are very finely dispersed throughout the continuous phase which must be the oil phase.

In order for efficient combustion to occur, the flame front in the combustion chamber must contact oil first to maintain optimum combustion temperature. The presence of any water at all will reduce combustion temperature. The presence of an optimal amount of water and water-soluble alcohol inside the oil droplet (in the micelle of the microemulsion) produces balanced, optimal fuel/oxygen ratios and combustion temperatures where carbon present is more completely burned.

When this slightly reduced but still high level of heat reaches the extremely fine water droplet, the water is transformed into steam. The expansion of liquid water to steam (at a ratio of 1:600) also produces power of its own, which further enhances engine performance.

On the other hand, an oil-in-water emulsion will not perform in the same way. With water as the continuous phase, water contacts the flame front first. The water diminishes or puts the fire out, and then the smoldering flame contacts oil. The results of this incomplete combustion are extremely high hydrocarbon (unburned fuel), particulates, smoke, etc. emissions and significantly reduced power. Nitrogen oxides are usually reduced; however, that is because the temperature of combustion is also reduced below any efficiency level.

Diesel engines are particularly suited to fuel/additive combustion enhancement. Compression ignition engines rely on the heat of compression to produce combustion of fuel; however, it is the compression and expansion of air that is the important power dynamic which makes Diesel engines highly effective.

Fuel/additive power enhancement works on the same principle. At the top of the compression stroke, a small amount of fuel/alcohol/water mixture ignites and explodes. The fuel bums, and now both air and steam expand together to produce power.

Fuel/additive combustion enhancement is made possible by the presence of increased oxygen levels provided by water-soluble alcohols and water. An optimal fuel:oxygen ratio is produced allowing for the complete combustion of available carbon.

The same principle works in a gasoline, spark-ignited engine. As spark-ignited engines are designed, power comes only from the expansion of the explosion of gasoline which is limited compared to the power produced by the compression and expansion of air. The fuel/additive gives these relatively low-efficiency engines the benefit of the water to steam expansion as well as improved oxygenation for more complete burning of carbon.

Even though they produce much greater power levels, the emissions problem associated with Diesel engines has always been difficult to solve. Diesel fuel is usually too rich in hydrocarbons to maintain the delicate balance required for optimal power and complete burning of carbon. Without modification, Diesel fuel burns incompletely. Diesel fuel contains too much carbon in relation to the amount of available oxygen and for what it has to accomplish in the split second before the piston starts moving away from its highest compression (heat) point.

The addition of certain oils, alcohols, and water produce an efficient combination and combustion is extremely enhanced. Vegetable-based components and most alcohols have slightly lower cetane (BTU) value than other fuels. However, water and water-soluble alcohols increase available oxygen and maintain optimal temperatures in the combustion chamber so that essentially all available carbon is burned and utilized for power, rather than being emitted as carbon particles in exhaust smoke. At the same time, water enhances power through expansion as steam and cleans engine parts with its detergent properties.

Although some of the following components may be useful in producing clear, stable microemulsions, they cannot be included in a formulation intended for use as a fuel in an internal combustion engine.

The U.S. Environmental Protection Agency (EPA) specifically rules against fuel compositions with sulphur, aromatic hydrocarbons, and metals of any kind because of the resulting detrimental emissions byproducts. To meet EPA and California (Calif.) Air Resources Board (CARB) standards only the elements carbon, hydrogen, oxygen, or nitrogen (CHON) can be included.

For instance, sodium or potassium salts in the presence of fatty acids also form a microemulsion, but do not fall into the CHON classification, and also cannot be used because of excessive corrosive properties.

Even among possible components that fall within the CHON classification, many are still unsuitable for the intended use. For example, ethylene oxides enhance microemulsion stability, but impede combustion, and can be used only in very limited amounts.

Even among possible CHON components that show promising combustion qualities, many are still unsuitable for optimum performance. For an additive composition to be useful it must meet these qualifications:

1. It must be stable at high and low temperatures.

2. It must maintain a viscosity similar to fossil fuel in all temperature and pressure conditions.

3. It must not damage engine or fuel system parts.

4. It must be usable with little or no retrofit of engine or fuel system parts.

5. It must maintain a power level suitable to its particular application.

6. It must show an improvement in engine performance or emissions and preferably both.

7. It must not increase nitrogen oxides or hydrocarbon or carbon monoxide emissions.

Methyl esters are often used as a fossil fuel additive; however, glycerides must be removed during the esterification process, reducing and even eliminating, cost effectiveness. Gelling problems hamper their use, especially at low temperatures, and typically, methyl esters have been producing about a 5% increase in nitrogen oxides in older engines, making them unusable as far as the EPA and its regulations is concerned.

Another fuel additive is a water emulsion using naptha as its base fuel. The purpose is to reduce NOx emissions. The composition uses as much as 40–50% water. Not only does an extra fuel tank need to be installed to carry the added liquid, hydrocarbon emissions (incomplete combustion) increase dramatically as the combustion flame front hits water. NOx emissions are also reduced, but that is because there is essentially insufficient combustion to cause a nitrogen/oxygen reaction.

Another fuel additive is methyltetrahydrofuran which is currently under study as a possible additive to introduce ethanol into Diesel fuel. However, methyl-tetrahydrofuran is a highly aggressive solvent known to attack and dissolve various metals, creating a high probability for damage to engine parts if used as a fuel in existing engines.

Another fuel additive is methyl tertiary butyl ether (MTBE) which successfully improves combustion characteristics of gasoline. However, MTBE is currently under investigation by the EPA, having been shown to be a toxic groundwater contaminant. As a result, its use is banned in several states.

Some prior research in the field includes, but is not limited to:

E. Wenzel et al. in U.S. Pat. Nos. 3,608,530 and 5,025,759 disclose a compression ignition (Diesel) engine having paired opposed cylinders and a lever system interconnecting the pistons of the opposed power cycle cylinders with each other and with a crank shaft. Together, the long-stroke opposed-cylinders and smooth rotary type connection to the crankshaft produce optimal combustion efficiency and optimally balanced mechanical efficiency. However, even in this efficiently designed engine, standard Diesel fuel will produce unacceptable levels of emissions and by-products under current and planned EPA regulations. On the other hand, the present invention described herein below discloses a stable fuel composition for reducing Diesel fuel emissions as well as incorporating components derived from renewable resources to augment dwindling fossil fuel supplies.

E. Wenzel et al. in U.S. Pat. No. 4,083,698 disclose a clear stable liquid fuel composition for internal combustion engines. The fuel composition comprises a water-in-oil (w/o) emulsion of (a) a hydrocarbon fuel, (b) water, (c) a water-soluble alcohol and a combination of surface active agents, which are stable emulsions over a wide range of temperatures. However, in all described aspects, a non-ionic surfactant is a necessary component of the additive. In all described aspects this non-ionic surfactant includes an ethylene, polyethylene, polyoxyethylene and/or polyoxypropylene addition product.

A. W. Schwab et al. in U.S. Pat. No. 4,451,267 disclose microemulsions for vegetable oil and aqueous alcohol with a trialkylamines surfactant as an alternative fuel for Diesel engines.

A. W. Schwab et al. in U.S. Pat. No. 4,526,586 disclose microemulsions from vegetable oil and aqueous alcohols with 1-butanol and optionally trialkylamines as an alternative fuel for Diesel engines. There is no disclosure in U.S. Pat. No. 4,451,267 or U.S. Pat. No. 4,526,586 in which the vegetable oil emulsion is mixed with hydrocarbon fuels to form a water in oil (w/o) microemulsion with a hydrocarbon fuel.

W. Fridreich et al. in U.S. Pat. No. 4,732,576 disclose a motor fuel and fuel oil emulsions using an organic salt as an emulsifier. Specific amine polyether diacid salts are a necessary component of the additive.

J. W. Foresberg et al. in U.S. Pat. No. 5,360,458 disclose water-oil emulsions comprising-water, oil, and a minor emulsifying amount of the reaction product of at least one saturated or unsaturated aliphatic monocarboxylic acid of about 12 to 24 carbon atoms. In all aspects, at least one acid of the general formula $C_{19}H_nCOOH$ wherein n is between about 27 and 31 and having a phenanthrene nucleus and at least one amine are present as necessary components. In all aspects an aromatic hydrocarbon is a necessary component of the additive.

S. G. Schon et al. in U.S. Pat. No. 5,004,479 disclose stable microemulsion fuel compositions which comprise (a) a hydrocarbon fuel such as Diesel fuel, jet fuel, gasoline, fuel oil, etc.; (b) water; and (c) a cosurfactant combination of methanol and a fatty acid which is partially neutralized by a nitrogenous base. In all aspects of U.S. Pat. No. 5,004,479, methanol is the only alcohol present. Some U.S. Patents of general background interest include:

U.S. Pat. Nos. 4,406,519 and 4,451,265.

Other references of general background interest include:

J. J. Donnelly, Jr. and H. M. White, "Water and Alcohol Use in Automotive Diesel Engines" DOE/DX/50286–4 published September 1985.

A. L. Compere et al., "Microemulsion Fuels: Development and Use" ORNL TM-9603, published March 1985.

W. D. Weatherford, Jr. et al., AFLRL Reports 111, 13, 145, U.S. Army Fuels and Lubricants Research Laboratory.

None of these patents, references, or articles teach or suggest the present invention.

All patents, patent applications, articles, references, standards, etc. cited herein are incorporated by reference in their entirety.

In spite of the present state of the art, a need still exists for improved fuel/additive compositions which:

1. do improve combustion and reduce or eliminate smoke, particulates and noxious gases;

2. do not damage engine or fuel system parts;

3. are usable with little or no retrofit of engine or fuel system parts;

4. are usable in varying proportions according to the requirements of various applications;

5. meet federal EPA and state Air Resources Board standards; and 6. make use of renewable and readily available resources to partially or fully replace fossil-based fuels.

The present invention provides such a range of improved compositions.

SUMMARY OF THE INVENTION

The present invention relates to an additive composition for a combustible fuel, which is also used as a fuel composition, to utilize readily available and renewable resources, to improve liquid combustible fuel properties, reduce undesirable elements such as sulphur, aromatic hydrocarbons, and glycerine from the content of the fuel, produce improved combustion, and to reduce visible smoke, particulates and other noxious emissions production of the combusted fuel, which additive or fuel composition comprises:

a. one or more alcohols selected from the group consisting of water-soluble alcohols:

(i) having between about 1 and 2 carbon atoms, selected from the group consisting of methanol and ethanol in an anhydrous state or as a 0.5–36% aqueous solution by volume, (ii) having between about 3 and 5 carbon atoms, selected from the group consisting of prapanol, iso-propanol, butanol, and pentanol by volume or combinations of (a)(i) and (a)(ii); and optionally one or more of the following:

b. one or more alcohols selected from the group consisting of:

(i) straight or branched chain, saturated or unsaturated alcohols, which are clear and liquid at room temperature, and having between about 6 and 12 carbon atoms, or (ii) straight- or branched-chain, saturated or unsaturated long-chain fatty alcohols, which are solid at room temperature, having from between about 13 and 18 carbon atoms, or combinations of b(i) and (b)(ii);

c. one or more ethoxylated alcohols selected from the group consisting of alcohols having between 6 and 18 carbon atoms, where the ethylene oxide add-on is less than 5 moles (units);

d. a fatty acid of the structure R—(C=O)—OH, wherein R is selected from alkyl, alkenyl or alkynyl having between about 10 to 24 carbon atoms, with e. a source of nitrogen in an anhydrous state or as an aqueous solution selected from the group consisting of the ammonia, hydrazine, alkyl hydrazine, dialkyl hydrazine, urea, ethanolamine, monoalkyl ethanolamine, and dialkyl ethanolamine wherein alkyl is independently selected from methyl, ethyl, n-propyl or isopropyl, wherein trialkylamines are excluded;

wherein components a and one or more of b, c, d, and e, when combined with mixing with combustible fuel form a clear, stable microemulsion having a viscosity similar to that of the liquid combustible fuel, and where the ratio of combustible fuel:additive ranges from about 99:1 to 0:100 by volume;

wherein said additive/fuel composition excludes ethylene glycol, glycerine, polyethylene, polypropylene, aromatic organic compounds, sulfur, sulfur compounds, metals, metal compounds, compounds of phenanthrene, and emulsifiers of the general formula:

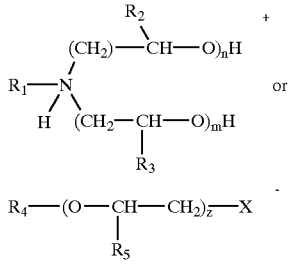

wherein $R_1$ and $R_4$ each independently is a saturated or unsaturated, straight-chain or branched hydrocarbon aliphatic radical each of 4 to 24 carbon atoms (e.g., alkyl or alkenyl) or $R_4$ is alkylphenyl of 1 to 18 carbon atoms in the optionally branched alkyl chain or H; $R_2$, $R_3$ and $R_5$ each independently represent a methyl group or H, n plus m is an integer from 1 to 20; z is an integer from 0 to 15; and X is —COO(−) or —$OCH_2COO$(−), wherein, substituents $R_2$, $R_3$ and $R_5$ are the same or different in different monomer units of each chain, and optionally other organic diacids are excluded.

In another aspect, the present invention relates to an additive composition for a refined combustible fuel, such as gasoline, to utilize readily available and renewable resources, improve liquid fuel properties, and produce improved fuel performance and combustion, which additive/fuel comprises a composition, which additive/fuel comprises a composition of components:

a) one or more alcohols selected form the group consisting of water-soluble alcohols having between about 1 and 2 carbon atoms as defined herein in (a)(i) in an anhydrous state or as a 0.5–5% aqueous solution;

b) one or more alcohols selected from the group consisting of water-soluble alcohols having between about 3 and 5 carbon atoms as defined herein in (a)(ii)

wherein components a and b, are present in a:b ratios from about 80:20 and 99:1, wherein components a and b, when combined with mixing with the refined combustible fuel, such as gasoline, form a clear stable solution or microemulsion having a viscosity similar to that of the liquid fossil fuel and where the ratio of combustible fuel:additive ranges from about 99:1 to 1:99.

In another aspect, the present invention relates to an additive composition for a refined combustible fuel, such as gasoline, to utilize readily available and renewable resources, improve liquid fuel properties, and produce improved fuel performance and combustion, which additive/fuel comprises a composition, which additive/fuel comprises a composition of components:

a) one or more alcohols selected from the group consisting of water-soluble alcohols having between about 1 and 2 carbon atoms as defined herein in a(i) in an anhydrous state or as a 0.5–5% aqueous solution; and preferably a 0.5–1% aqueous ethanol;

b) one or more alcohols selected from the group consisting of water-soluble alcohols having between about 3 and 5 carbon atoms as defined herein in (a)(ii); and preferably iso-propanol:

wherein components a and be, are present in a:b ratios from about 80:20 and 99:1, and more preferably in a:b ratio s range from 90:10 and 95:5 by volume wherein components a and b, when combined with mixing with the combustible fuel form a clear, stable microemulsion having a viscosity similar to that of the liquid combustible fuel, and where the ratio of combustible fuel; additive ranges from about 99:1 to 1:99 and more preferably between about 80:20 and 99:1, and more preferably between about 90:10 and 95:5 by volume.

In another aspect, the present invention relates to an additive composition for a combustible fuel to utilize readily available and renewable resources and produce improved fuel performance and combustion, which additive or fuel comprises a composition of components:

a. one or more alcohols selected from the group consisting of water-soluble alcohols having between about 1 and 5 carbon atoms as defined herein in an anhydrous state or as a 0.5–20% aqueous solution;

b. one or more alcohols selected from the group consisting of clear, liquid saturated or unsaturated, straight- or branched-chain, alcohols having between about 6 and 12 carbon atoms, wherein components a and b, are present in a:b ratios ranging from about 3:1 and 1:3, wherein components a and b, when combined with mixing with combustible fuel form a clear, stable microemulsion having a viscosity similar to that of the liquid combustible fuel, and where the ratio of combustible fuel:additive ranges from about 99:1 to 1:99 by volume.

In another aspect, the present invention relates to an additive composition for a combustible fuel to utilize readily available and renewable resources and produce improved fuel performance and combustion, which additive or fuel comprises a composition of components:

a. one or more alcohols selected from the group consisting of water-soluble alcohols having-between about 1 and 5 carbon atoms as defined herein in an anhydrous state or as a 0.5–20% aqueous solution; more preferably an anhydrous or about 5% aqueous ethanol denatured with methanol and most preferably an anhydrous or about 5% aqueous ethanol denatured with iso-propanol, butanol or combinations thereof;

b. one or more alcohols selected from the group consisting of saturated or unsaturated, straight- or branched-chain alcohols having from between about 6 and 18 carbon atoms, more preferably between about 6 and 12 carbon atoms, and most preferably between about 8 and 10 carbon atoms; and wherein components a and b, are present in a:b ratios ranging from about 3:1 by volume and 1:3, and more preferably in a:b ratios ranging from 3:1 and 1:1 by volume wherein components a and b, when combined with mixing with the combustible fuel form a clear, stable microemulsion having a viscosity similar to that of the liquid combustible fuel, and where the ratio of combustible fuel:additive ranges from about 99:1 to 1:99 and more preferably between about 80:20 and 99:1 and more preferably between about 90:10 and 95:5 by volume.

In another aspect, the present invention relates to an additive composition for a combustible fuel, to utilize readily available and renewable resources and produce improved fuel performance and combustion, which additive or fuel comprises a composition of components:

a. one or more alcohols selected from the group consisting of water-soluble alcohols having between about 1 and 5 carbon atoms as defined herein, in an anhydrous state or as a 0.5–20% aqueous solution; and b. one or more alcohols selected from the group consisting of clear, liquid saturated or unsaturated, straight- or branched-chain alcohols having from between about 6 and 12 carbon atoms; and c. one or more alcohols selected from the group consisting of ethoxylated alcohols having between about 6 and 18 carbon atoms, where the ethylene oxide add-on is less than 5 moles;

wherein components a, b, and c are present in a:b:c ratios ranging from about 4:1:1 and 1:4:4 by volume, wherein components a, b, and c when combined with mixing with the combustible fuel, form a clear, stable microemulsion having a viscosity similar to that of the liquid combustible fuel, and where the ratio of combustible fuel:additive ranges from about 99:1 to 1:99 by volume.

In another aspect, the present invention relates to an additive composition for a combustible fuel, to utilize readily available and renewable resources and produce improved fuel performance and combustion, which additive or fuel comprises a composition of components:

a. one or more alcohols selected from the group consisting of water-soluble alcohols having between about 1 and 5 carbon atoms as defined herein in an anhydrous state or as a 0.5–20% aqueous solution; more preferably an anhydrous or 5–10% aqueous ethanol denatured with methanol and most preferably an anhydrous or 5–10% aqueous ethanol denatured with iso-propanol, butanol or combinations thereof;

b. one or more alcohols selected from the group consisting of saturated or unsaturated, straight- or branched-chain alcohols having from between about 6 and 18 carbon atoms, more preferably between about 6 and 12 carbon atoms, and most preferably between about 8 and 10 carbon atoms; and c. one or more alcohols selected from the group consisting of ethoxylated alcohols having between about 6 and 18 carbon atoms, preferably between about 12 and 16 carbon atoms, where the ethylene oxide add-on is less than 5 moles and preferably 3 moles;

wherein components a, b, and c are present in a:b:c ratios ranging from about 4:1:1 and 1:4:4 by volume, and more preferably between about 4:1:1 and 4:2:1 by volume wherein components a, b, and c when combined with mixing with combustible fuel, form a clear, stable microemulsion having a viscosity similar to that of the liquid fossil fuel, and where the ratio of combustible fuel:additive ranges from about 99:1 to 1:99 and more preferably between about 80:20 and 99:1, and most preferably between about 90:10 and 95:5 by volume.

In another aspect, the present invention relates to an additive composition for a combustible fuel to utilize readily available and renewable resources and produce improved fuel performance and combustion, which additive or fuel comprises a composition of components:

a. one or more alcohols selected from the group consisting of water-soluble alcohols having between about 1 and 5 carbon atoms as defined herein in an anhydrous state or as a 0.5 to 20% aqueous solution; and b. one or more alcohols selected from the group consisting of ethoxylated alcohols having between about 6 and 18 carbon atoms, where the ethylene oxide add-on is less than 5 moles;

wherein components a and b are present in a:b ratios ranging from between 3:1 and 1:2 by volume, wherein components a and b when combined with mixing with the combustible fuel form a clear, stable microemulsion having a viscosity similar to that of the liquid combustible fuel, and where the ratio of combustible fuel:additive ranges from about 99:1 to 1:99 by volume.

In another aspect, the present invention relates to an additive composition for a combustible fuel to utilize readily available and renewable resources and produce improved fuel performance and combustion, which additive or fuel comprises a composition of components:

a. one or more alcohols selected from the group consisting of water-soluble alcohols having between about 1 and 5 carbon atoms as defined herein in an anhydrous state or as a 0.5–20% aqueous solution; more preferably an anhydrous or 5–10% aqueous ethanol denatured with methanol and most preferably an anhydrous or 5–10% aqueous ethanol denatured with iso-propanol butanol or combinations thereof;

b. one or more alcohols selected from the group consisting of ethoxylated alcohols having between about 6 and 18 carbon atoms, preferably between about 12 and 16 carbon atoms, where the ethylene oxide add-on is less than 5 moles and preferably 3 moles;

wherein components a and b are present in a:b ratios ranging from 3:1 and 1:2 by volume, and more preferably between about 3:1 and 2:1 by volume, wherein components a and b when combined with mixing with the combustible fuel form a clear, stable microemulsion having a viscosity similar to that of the liquid combustible fuel, and where the ratio of combustible fuel:additive ranges from about 99:1 to 1:99, and more preferably between about 80:20 and 99:1 and more preferably between about 90:10 and 95:5 by volume.

In another aspect, the present invention relates to an additive composition for a combustible fuel to utilize readily available and renewable resources and produce improved fuel performance and combustion, which additive/fuel comprises a composition of components:

a. one or more alcohols selected from the group consisting of water-soluble alcohols having between about 1 and 5 carbon atoms, such as mentanol, ethanol, propanol, isopropanol, butanol, pentanol, in an anhydrous state or as a 0.5–36% aqueous solution; and b. one or more alcohols selected from the group consisting of saturated or unsaturated, straight-or-branched-chain alcohols having from between about 6 and 18 carbon atoms; and c. a fatty acid of the structure R—(C═O)—OH, wherein R is selected from alkyl, alkenyl or alkynl having from about 10 to 24 carbon atoms; and d. a source of nitrogen in an anhydrous state or as a aqueous solution selected from the group consisting of the ammonia, hydrazine, alkyl hydrazine, dialkyl hydrazine, urea, ethanolamine, monoalkyl ethanolamine, dialky ethanolamine wherein alkyl is independently selected from methyl, ethyl, n-propyl or isopropyl wherein trialkylamines are excluded;

wherein components a, b and c are present in a:b:c ratios ranging from about 4:1:1 and 1:4:4; wherein components a, b, c, and d when combined with mixing with said combustible fuel form a clear, stable microemulsion having a viscosity similar to a liquid fossil fuel, and where the ratio of combustible fuel:additive ranges from about 99:1 to 1:99

In another aspect, the present invention relates to an additive composition for a combustible fuel, to utilize readily available and renewable resources and produce improved fuel performance and combustion, which additive or fuel comprises a composition of components:

a. one or more alcohols selected from the group consisting of water-soluble alcohols having between about 1 and 5 carbon atoms as defined herein in an anhydrous state or as a 0.5–20% aqueous solution; more preferably an anhydrous or 5 to 10% aqueous ethanol denatured with methanol and most preferably an anhydrous or 5 to 10% aqueous ethanol denatured with isopropanol, butanol or combinations thereof;

b. one or more alcohols selected from the group consisting of saturated or unsaturated, straight- or branched-chain alcohols having from between about 6 and 18 carbon atoms, more preferably between about 6 and 12 carbon atoms, and most preferably between about 8 and 10 carbon atoms;

c. a fatty acid of the structure R—(C═O)—OH, wherein R is selected from alkyl, alkenyl or alkynyl having from about 10 to 24 carbon atoms; and preferably saturated fatty acids, such as oleic acid and linoleic acid;

d. a source of nitrogen in an anhydrous state or as an aqueous solution selected from the group consisting of the ammonia, hydrazine, alkyl hydrazine, dialkyl hydrazine, urea, ethanolamine, monoalkyl ethanolamine, and dialkyl ethanolamine wherein alkyl is independently selected from methyl, ethyl, n-propyl or iso-propyl, wherein trialkylamines are excluded; sufficient to neutralize between about 40 to 85 percent of the fatty acid of subpart c;

wherein components a, b, and c are present in a:b:c ratios ranging from about 4:1:1 and 1:4:4; and preferably between about 4:1:1 and 4:2:1 by volume, wherein components a, b, c and d when combined with mixing with said combustible fuel form a clear, stable microemulsion having a viscosity similar to that of the liquid combustible fuel, and where the ratio of combustible fuel:additive ranges from about 99:1 to 1:99, and more preferably between about 80:20 and 99:1 and most preferably between about 90:10 and 95:5 by volume.

In another aspect, the present invention relates to an additive composition for a combustible fuel to utilize readily available and renewable resources and produce improved fuel performance and combustion, which additive or fuel comprises a composition of components:

a. one or more alcohols selected from the group consisting of water-soluble alcohols having between about 1 and 5 carbon atoms as defined herein in an anhydrous state or as a 0.5–36% aqueous solution; and b. one or more alcohols selected from the group consisting of ethoxylated alcohols having between 6 and 18 carbon atoms, where the ethylene oxide add-on is less than 5 moles; and c. a fatty acid of the structure R—(C═O)—OH, wherein R is selected from alkyl, alkenyl or alkynyl having from about 10 to 24 carbon atoms; and d. a source of nitrogen in an anhydrous state or as an aqueous solution selected from the group consisting of the ammonia, hydrazine, alkyl hydrazine, dialkyl hydrazine, urea, ethanolamine, monoalkyl ethanolamine, and dialkyl ethanolamine wherein alkyl is independently selected from methyl, ethyl, n-propyl or isopropyl, wherein trialkylamines are excluded, wherein components a, b, and c are present in a:b:c ratios ranging from about 5:1:1 and 1:4:4 by volume; wherein components a, b, c, and d when combined with mixing with the combustible fuel, form a clear, stable microemulsion having a viscosity similar to that of the liquid combustible fuel, and where the ratio of combustible fuel:additive ranges from about 99:1 to 1:99 by volume.

In another aspect, the present invention relates to an additive composition for a combustible fuel, to utilize readily available and renewable resources and produce improved fuel performance and combustion, which additive or fuel comprises a composition of components:

a. one or more alcohols selected from the group consisting of water-soluble alcohols having between about 1 and 5 carbon atoms as defined herein in an anhydrous state or as a 0.5–20% aqueous solution; more preferably an anhydrous or 5 to 10% aqueous ethanol denatured with methanol and most preferably an anhydrous or 5 to 10% aqueous ethanol denatured with iso-propanol, butanol or combinations thereof;

b. one or more alcohols selected from the group consisting of ethoxylated alcohols having between about 6 and 18 carbon atoms, preferably between about 12 and 16 carbon atoms, where the ethylene oxide add-on is less than 5 moles and preferably 3 moles;

c. a fatty acid of the structure R—(C═O)—OH, wherein R is selected from alkyl, alkenyl or alkynyl having from about 10 to 24 carbon atoms, and preferably oleic acid or linoleic acid;

d. a source of nitrogen in an anhydrous state or as an aqueous solution selected from the group consisting of the ammonia, hydrazine, alkyl hydrazine, dialkyl hydrazine, urea, ethanolamine, monoalkyl ethanolamine, and dialkyl ethanolamine wherein alkyl is independently selected from methyl, ethyl, n-propyl or isopropyl wherein trialkylamines are excluded, sufficient to neutralize between about 40 to 85 percent of the fatty acid of subpart c;

wherein components a, b, and c are present in a:b:c ratios ranging from about 4:1:1 and 1:4:4; and preferably between about 4:1:1 and 3:1:1 by volume, wherein components a, b, c, and d when combined with mixing with the combustible fuel form a clear, stable microemulsion having a viscosity similar to that of the liquid combustible fuel, and where the ratio of combustible fuel:additive ranges from about 99:1 to 1:99, and more preferably between about 80:20 and 99:1 and most preferably between about 90:10 and 95:5 by volume.

In another aspect, the present invention relates to an additive composition for a combustible fuel, to utilize readily available and renewable resources and produce improved fuel performance and combustion, which additive or fuel comprises a composition of components:

a. one or more alcohols selected from the group consisting of water-soluble alcohols having between about 1 and 5 carbon atoms as defined herein in an anhydrous state or as a 0.5–36% aqueous solution; and b. one or more alcohols selected from the group consisting of clear, liquid saturated or unsaturated, straight- or branched-chain alcohols having from between about 6 and 12 carbon atoms; and c. one or more ethoxylated alcohols selected from the group consisting of alcohols having between 6 and 18 carbon atoms, where the ethylene oxide add-on is less than 5 moles; and d. a fatty acid of the structure R—(C═O)—OH, wherein R is selected from alkyl, alkenyl or alkynyl having from about 10 to 24 carbon atoms; and e. a source of nitrogen in an anhydrous state or as an aqueous solution selected from the group consisting of the ammonia, hydrazine, alkyl hydrazine, dialkyl hydrazine, urea, ethanolamine, monoalkyl ethanolamine, and dialkyl ethanolamine, wherein alkyl is independently selected from methyl, ethyl, n-propyl or isopropyl, wherein trialkylamines are excluded;

wherein components a, b, c, and d are present in a:b:c:d ratios ranging from about 6:1:1:1 and 1:4:4:4 by volume; wherein components a, b, c, d, and e when combined with mixing with the combustible fuel form a clear, stable microemulsion having a viscosity similar to that of the liquid combustible fuel, and where the ratio of combustible fuel:additive ranges from about 99:1 to 1:99 by volume.

In another aspect, the present invention relates to an additive composition for a combustible fuel, to utilize readily available and renewable resources and produce improved fuel performance and combustion, which additive or fuel comprises a composition of components:

a. one or more alcohols selected from the group consisting of water-soluble alcohols having between about 1 and 5 carbon atoms as defined herein in an anhydrous state or as a 0.5–20% aqueous solution; more preferably an anhydrous or 5 to 10% aqueous ethanol denatured with methanol and most preferably an anhydrous or 5 to 10% aqueous ethanol denatured with iso-propanol, butanol or combinations thereof;

b. one or more alcohols selected from the group consisting of saturated or unsaturated, straight- or branched-chain alcohols having from between about 6 and 18 carbon atoms, more preferably between about 6 and 12 carbon atoms, and most preferably between about 8 and 10 carbon atoms; and c. one or more alcohols selected from the group consisting of ethoxylated alcohols having between about 6 and 18 carbon atoms, preferably between about 12 and 16 carbon atoms, where the ethylene oxide add-on is less than 5 moles and preferably 3 moles;

d. a fatty acid of the structure R—(C═O)—OH, wherein R is selected from alkyl, alkenyl or alkynyl having from about 10 to 24 carbon atom; and preferably oleic acid and linoleic acid;

e. a source of nitrogen in an anhydrous state or as an aqueous solution selected from the group consisting of the ammonia, hydrazine, alkyl hydrazine, dialkyl hydrazine, urea, ethanolamine, monoalkyl ethanolamine, and dialkyl ethanolamine wherein alkyl is independently selected from methyl, ethyl, n-propyl or isopropyl, wherein trialkylamines are excluded, sufficient to neutralize between about 40 to 85 percent of the fatty acid of subpart c;

wherein components a, b, c, and d are present in a:b:c:d ratios ranging from about 6:1:1:1 and 1:4:4:4; and preferably between about 6:1:1:1 and 6:3:1:1 by volume, wherein components a, b, c, d, and e when combined with mixing with the combustible fuel form a clear, stable microemulsion having a viscosity similar to that of the liquid combustible fuel, and where the ratio of combustible fuel:additive ranges from about 99:1 to 1:99, and more preferably between about 80:20 and 99:1 and more preferably between about 90:10 and 95:5 by volume.

Additional embodiments are found below in the DETAILED DESCRIPTION OF THE INVENTION.

BRIEF DESCRIPTION OF THE DRAWINGS

FIG. 1 is a photographic representation of the Caterpillar engine used at Stockton East Water District, Stockton, Calif.

FIG. 2 is a photograph of the containers of the additive blends.

FIG. 3 is a photograph of the normal emissions of a diesel engine in start-up mode using CA#2 Diesel fuel.

FIG. 4 is a photograph of the emissions of a diesel engine in start-up mode using the fuel additive blend of Example 1.

FIG. 5 is a photograph of the emissions of a diesel engine normal running speed, using CA#2 Diesel fuel after 30 minutes or more.

FIG. 6 is a photograph of the emissions of a diesel engine (far right smoke stack), normal running speed, using the fuel additive blend of Example 1.

FIG. 7 is a photograph of the muffler and exhaust pipe from the diesel engine in FIG. 1C, engine start-up mode using CA#2 diesel, showing method for collecting filter samples.

FIG. 8 is a photograph of the muffler and exhaust pipe from the diesel engine in FIG. 1, engine start-up mode using the fuel additive blend of Example 2 showing method for collecting filter samples.

FIG. 9 is a photograph of the muffler and exhaust pipe from the diesel engine in FIG. 1C, engine running mode, using the fuel additive blend of Example 2.

FIG. 10 is a photograph of the muffler and exhaust pipe from the diesel engine in FIG. 1, engine running mode, using the fuel additive blend of Example 2.

FIG. 11 is a photograph showing on the left the filter sample 110A for engine running mode using CA#2 Diesel, and on the right of the photograph is the filter sample 110B after 10 min engine-running mode using the fuel additive blend of Example 2.

FIG. 12 is a photograph showing on the left the filter sample 120A for engine running mode using CA#2 Diesel and on the right is the filter sample 120B after 30 min engine-running mode using the fuel additive blend of Example 2.

FIG. 13 is a photograph showing on the left the filter sample 130A for engine running mode using-CA#2 diesel and on the right is the filter sample 130B after 1 hr engine running mode using the fuel additive blend of Example 2.

FIG. 14 is a photograph showing on the left the filter sample 140A for engine running mode using CA#2 Diesel and on the right the filter sample 140B after 10 min engine-running mode using CA#2 Diesel, after 1 hr use of the fuel additive blend of Example 2.

FIG. 15 is a photograph showing on the left the filter sample 150A for engine startup mode using CA#2 Diesel and one the right the filter sample 150B for engine start-up mode using the fuel additive blend of Example 1 after 10 min use of the fuel additive blend.

FIG. 16 is a photograph showing on the left the filter sample 160A for engine startup mode using CA#2, and on the right the filter sample 160B for engine start-up mode using the fuel additive blend of Example 1 after 1 hr use of the fuel additive blend.

FIG. 17 is a photograph showing on the left the filter sample 170A for engine startup mode using CA#2 Diesel and on the right the filter sample 170B for engine start-up mode using CA#2 Diesel—after 1 hr use of the fuel additive blend.

FIG. 18 is a photograph showing a comparison of all filter samples wherein filter sample 110A (is the same as 120A and 140A) as compared with 110B, 120B, and 140B, and filter sample 150A (is the same as 160A and 170A) as compared to 150B, 160B and 170B.

FIG. 19 is a photograph showing a comparison of filter samples from Example 4 wherein:

Figure 1:
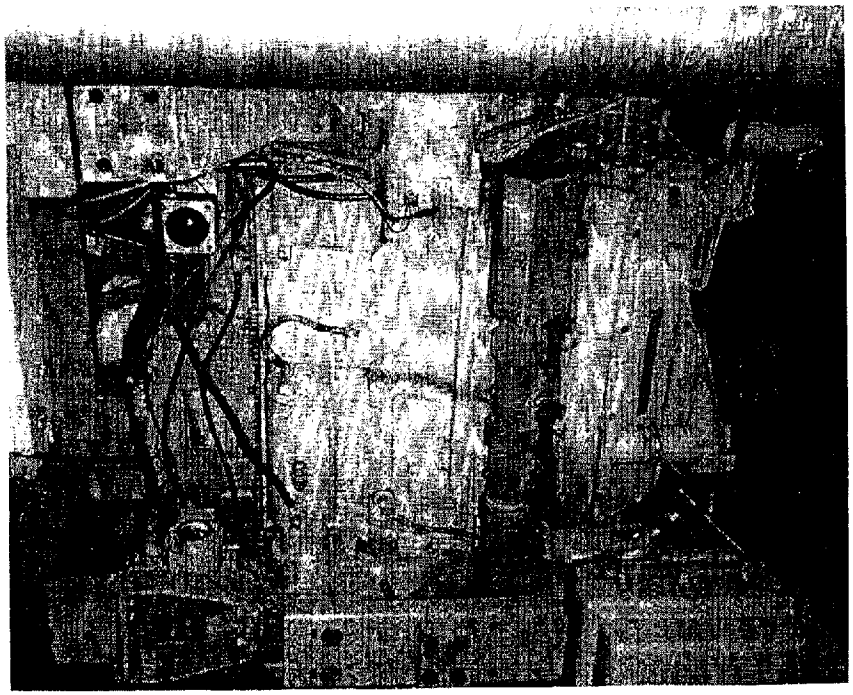
FIGS. 1–6 show visible emissions from exhaust stacks as Stockton East Water District, Stockton, Calif.

190A shows particulates from Test Cycle 1, Standard CA #2 Diesel fuel;

190B shows particulates from Test Cycle 2, Fuel/Additive Composition #1;

190C shows particulates from Test Cycle 3, Fuel/Additive Composition #2;

190D shows particulates from Test Cycle 4, Fuel/Additive Composition #3;

190E shows particulates from Test Cycle 5, Fuel/Additive Composition #4;

190F shows particulates from Test Cycle 6, Standard CA #2 Diesel fuel; and where 190F shows some alteration of the filter sample due to reflection of the plastic filter casing.

DETAILED DESCRIPTION OF THE INVENTION AND PREFERRED EMBODIMENTS

Definitions:

As used herein:

"Co-solvent alcohol" refers to water-soluble alcohol such as methanol, ethanol, propanol, butanol, pentanol or hexanol. Methanol and/or ethanol are preferred. Anhydrous or 5% aqueous ethanol with methanol 1–10% is more preferred, and anhydrous or 5% aqueous ethanol denatured with isopropanol or butanol about 1–10% by volume is especially preferred.

"Ethoxylated alcohols" refer to long-chain fatty alcohols having from between about 12 to 18 carbon atoms, which have an ethylene oxide add-on of less than 5 moles. C12 through C16 fatty alcohols with an ethylene oxide add-on of less than five are preferred, and C12 through C16 fatty alcohols with an ethylene oxide add-on of 3 is most preferred. "Fatty acid" refers to alkyl, alkenyl and alkynyl acids having about 10 to 24 carbon atoms, and preferably about 10 to 18 carbon atoms. Linoleic and oleic acids are preferred.

"Fuel" refers to conventional liquid fuel used in burning (usually to produce power, but also to produce heat) and in various internal combustion engines. Liquid fuels include but are not limited to fossil derived fuels such as diesel fuel, heating oil, jet fuel, kerosene, coal slurry, gasoline, combinations thereof and the like. Distilled liquids derived from renewable resources such as vegetable oils optionally are useful as a combustible fuel. These include but are not limited to oils from soybeans, tall, safflower, sunflower, linseed, cottonseed, corn, rapeseed and the like. Diesel fuel is preferred.

"Liquid fuel hydrocarbons" refers to hydrocarbons which form the continuous phase are mixtures of hydrocarbons, such as those refined (distilled) from fossil fuel, including crude petroleum or coal. Coal slurries (liquids) are part of the present hydrocarbon fuel. Diesel fuel hydrocarbons are preferred, however, it is recognized that the invention includes any distilled liquid fuel which forms a microemulsion with the additive, such as jet fuel, fuel oil, gasoline, and the like.

"Surfactant portion" refers to those components that generally contribute to reducing surface tension of the water and oil phases, allowing a microemulsion to form. In the present invention, these components are some water-soluble alcohols, water-insoluble alcohols, ethoxylated alcohols, and fatty acids partially neutralized with a nitrogen base.

"Viscosity similar to a liquid fossil fuel" refers to the change in viscosity that occurs when the additive of the present invention is mixed with a liquid fossil fuel. The viscosity of the additive/fuel is within ±10%, preferably within ±5% and more preferably between about ±2% of the original viscosity of the fuel.

"Volatile source of basic nitrogen" refers to nitrogen compounds that, when in the presence of fatty acids produce an exothermic reaction, partially neutralizing the fatty acids, forming ammonium salts and creating an anionic surfactant. Sodium and potassium compounds will also create an anionic surfactant through partial neutralization of fatty acids, but do not fall within the EPA CHON classification, and are metal elements that cannot be used in fuel additives because they form toxic metal contaminants during combustion. Aqueous ammonia, or urea dissolved in water or ethanol, are preferred, and BAUM A 26° aqueous ammonia is most preferred.

"Water-insoluble alcohol" refers to those alkyl, alkenyl or alkynyl alcohols (all isomers) having 6 to 12 carbon atoms and a water solubility of less than about 1 g/100 ml at 20° C. Alkyl alcohols between about 6 and 18 carbon atoms are preferred, and those having between 6 to 12 carbon atoms are more preferred Most preferred alkyl alcohols are normal alcohols having 8 to 10 carbon atoms. Octanol is especially preferred.

"Water-soluble portion" refers to those components that generally contribute to fuel oxygenation and have characteristic solvent or detergent qualities that contribute to cleaner burning. In the present invention, these components are water-soluble alcohols (all isomers) and water.

Additional aspects of the invention follow and include;

In another aspect, the present invention relates to an additive composition for a combustible fuel, to utilize readily available and renewable resources and produce improved fuel performance and combustion, which additive or fuel comprises a composition of components:

a. one or more alcohols selected from the group consisting of water-soluble alcohols having between about 1 and 5 carbon atoms as defined herein in an anhydrous state or as a 0.5–36% aqueous solution; and one or more of the following:

b. one or more alcohols selected from the group consisting of saturated or unsaturated, straight- or branched-chain alcohols having from between about 6 and 18 carbon atoms, or between about 6 and 12 carbon atoms. or between about 8 and 10 carbon atoms;

c. one or more ethoxylated alcohols selected from the group consisting of alcohols having between 6 and 18 carbon atoms, where the ethylene oxide add-on is less than 5 moles;

d. a fatty acid of the structure R—(C═O)—OH, wherein R is selected from alkyl, alkenyl or alkynyl having from about 10 to 24 carbon atoms with e. a source of nitrogen in an anhydrous state or as an aqueous solution selected from the group consisting of the ammonia, hydrazine, alkyl hydrazine, dialkyl hydrazine, urea, ethanolamine, monoalkyl ethanolamine, and dialkyl ethanolamine wherein alkyl is independently selected from methyl, ethyl, n-propyl or isopropyl, wherein trialkylamines are excluded;

wherein components a and one or more of b, c, d, and e, when combined with mixing with the combustible fuel form a clear, stable microemulsion having a viscosity similar to the liquid combustible fuel, and where the ratio of combustible fuel:additive ranges from about 95:5 to 99:1 by volume.

In another aspect, the present invention relates to an additive composition for a combustible fuel, to utilize readily available and renewable resources and produce improved fuel performance and combustion, which additive or fuel comprises a composition of components:

a. one or more alcohols selected from the group consisting of water-soluble alcohols having between about 1 and 5 carbon atoms as defined herein in an anhydrous state or as a 0.5–36% aqueous solution; and one or more of the following:

b. one or more alcohols selected from the group consisting of saturated or unsaturated, straight- or branched-chain alcohols having from between about 6 and 18 carbon atoms, or between about 6 and 12 carbon atoms, or between about 8 and 10 carbon atoms;

c. one or more ethoxylated alcohols selected from the group consisting of alcohols having between 6 and 18 carbon atoms, ethylene oxide add-on is less than 5 moles;

d. a fatty acid of the structure R—(C═O)—OH, wherein R is selected from alkyl, alkenyl or alkynyl having from about 10 to 24 carbon atoms, with e. a source of nitrogen in an anhydrous state or as an aqueous solution selected from the group consisting of the ammonia, hydrazine, alkyl hydrazine, dialkyl hydrazine, urea, ethanolamine, monoalkyl ethanolamine, and dialkyl ethanolamine wherein alkyl is independently selected from methyl, ethyl, n-propyl or isopropyl, wherein trialkylamines are excluded;

wherein components a and one or more of b, c, d, and e, when combined with mixing with the combustible fuel form a clear, stable microemulsion having a viscosity similar to the liquid combustible fuel, and where the ratio of combustible fuel:additive ranges from about 90:10 to 99:1 by volume.

In another aspect, the present invention relates to an additive composition for a combustible fuel, to utilize readily available and renewable resources and produce improved fuel performance and combustion, which additive or fuel comprises a composition of components:

a. one or more alcohols selected from the group consisting of water-soluble alcohols having between about 1 and 5 carbon atoms as defined herein in an anhydrous state or as a 0.5–36% aqueous solution, and one or more of the following:

b. one or more alcohols selected from the group consisting of saturated or unsaturated, straight- or branched-chain alcohols having from between about 6 and 18 carbon atoms, or between about 6 and 12 carbon atoms, or between about 8 and 10 carbon atoms;

c. one or more ethoxylated alcohols selected from the group consisting of alcohols having between 6 and 18 carbon atoms, where the ethylene oxide add-on is less than 5 moles;

d. a fatty acid of the structure R—(C═O)—OH, wherein R is selected from alkyl, alkenyl or alkynyl having from about 10 to 24 carbon atoms, with e. a source of nitrogen in an anhydrous state or as an aqueous solution selected from the group consisting of the ammonia, hydrazine, alkyl hydrazine, dialkyl hydrazine, urea, ethanolamine, monoalkyl ethanolamine, and dialkyl ethanolamine wherein alkyl is independently selected from methyl, ethyl, n-propyl or isopropyl wherein trialkylamines are excluded;

wherein components a and one or more of b, c, d and e, when combined with mixing with the combustible fuel form a clear, stable microemulsion having a viscosity similar to that of the liquid combustible fuel, and where the ratio of combustible fuel:additive ranges from about 80:20 to 99:1 by volume.

In another aspect, the present invention relates to an additive composition for a combustible fuel, to utilize readily available and renewable resources and produce improved fuel performance and combustion, which additive or fuel comprises a composition of components:

a. one or more alcohols selected from the group consisting of water-soluble alcohols having between about 1 and 5 carbon atoms as defined herein in an anhydrous state or as a 0.5–36% aqueous solution; and one or more of the following:

b. one or more alcohols selected from the group consisting of saturated or unsaturated, straight- or branched-chain alcohols having from between about 6 and 18 carbon atoms, or preferably between about 6 and 12 carbon atoms, or more preferably between about 8 and 10 carbon atoms;

c. one or more ethoxylated alcohols selected from the group consisting of alcohols having between 6 and 18 carbon atoms, where the ethylene oxide add-on is less than 5 moles;

d. a fatty acid of the structure R—(C═O)—OH, wherein R is selected from alkyl, alkenyl or alkynyl having from about 10 to 24 carbon atoms with e. a source of nitrogen in an anhydrous state or as an aqueous solution selected from the group consisting of the ammonia, hydrazine, alkyl hydrazine, dialkyl hydrazine, urea, ethanolamine, monoalkyl ethanolamine, and dialkyl ethanolamine wherein alkyl is independently selected from methyl, ethyl, n-propyl or isopropyl wherein trialkylamines are excluded;

wherein components a and one or more of b, c, d and e, when combined with mixing with the combustible fuel form a clear, stable microemulsion having a viscosity similar to that of the liquid combustible fuel, and where the ratio of combustible fuel:additive ranges from about 60:40 to 99:1 by volume.

In another aspect, the present invention relates to an additive composition for a combustible fuel, to utilize readily available and renewable resources and produce improved fuel performance and combustion, which additive or fuel comprises a composition of components:

a. one or more alcohols selected from the group consisting of water-soluble alcohols having between about 1 and 5 carbon atoms as defined herein in an anhydrous state or as a 0.5–36% aqueous solution; and one or more of the following:

b. one or more alcohols selected from the group consisting of saturated or unsaturated, straight- or branched-chain alcohols having from between about 6 and 18 carbon atoms, or preferably between about 6 and 12 carbon atoms, or more preferably between about 8 and 10 carbon atoms;

c. one or more ethoxylated alcohols selected from the group consisting of alcohols having between 6 and 18 carbon atoms, where the ethylene oxide add-on is less than 5 moles;

d. a fatty acid of the structure R—(C═O)—OH, wherein R is selected from alkyl alkenyl or alkynyl having from about 10 to 24 carbon atoms, with e. a source of nitrogen in an anhydrous state or as an aqueous solution selected from the group consisting of the ammonia, hydrazine, alkyl hydrazine, dialkyl hydrazine, urea, ethanolamine, monoalkyl ethanolamine, and dialkyl ethanolamine wherein alkyl is independently selected from methyl, ethyl, n-propyl or isopropyl, wherein trialkylamines are excluded;

wherein components a and one or more of b, c, d, and e, when combined with mixing with the combustible fuel form a clear, stable microemulsion having a viscosity similar to the liquid combustible fuel, and where the ratio of combustible fuel:additive ranges from about 50:50 to 99:1 by volume.

In another aspect, the present invention relates to an additive composition for a combustible fuel, to utilize readily available and renewable resources and produce improved fuel performance and combustion, which additive or fuel comprises a composition of components:

a. one or more alcohols selected from the group consisting of water-soluble alcohols having between about 1 and 5 carbon atoms as defined herein in an anhydrous state or as a 0.5–36% aqueous solution; and one or more of the following:

b. one or more alcohols selected from the group consisting of saturated or unsaturated, straight- or branched-chain alcohols having from between about 6 and 18 carbon atoms, or between about 6 and 12 carbon atoms, or between about 8 and 10 carbon atoms;

c. one or more ethoxylated alcohols selected from the group consisting of alcohols having between 6 and 18 carbon atoms, where the ethylene oxide add-on is less than 5 moles;

d. a fatty acid of the structure R—(C═O)—OH, wherein R is selected from alkyl, alkenyl or alkynyl having from about 10 to 24 carbon atoms, with e. a source of nitrogen in an anhydrous state or as an aqueous solution selected from the group consisting of the ammonia, hydrazine, alkyl hydrazine, dialkyl hydrazine, urea, ethanolamine, monoalkyl ethanolamine, and dialkyl ethanolamine wherein alkyl is independently selected from methyl, ethyl, n-propyl or isopropyl wherein trialkylamines are excluded;

wherein components a and one or more of b, c, d and e, when combined with mixing with the combustible fuel form a clear, stable microemulsion having a viscosity similar to the liquid combustible fuel, and where the ratio of combustible fuel:additive ranges from about 1:99 to 50:50 by volume.

In another aspect, the present invention relates to an additive composition for a combustible fuel, to utilize readily available and renewable resources and produce improved fuel performance and combustion, which additive/fuel comprises a composition of components:

a. one or more alcohols selected from the group consisting of water-soluble alcohols having between about 1 and 5 carbon atoms as defined herein in an anhydrous state or as a 0.5–36% aqueous solution; and one or more of the following:

b. one or more alcohols selected from the group consisting of saturated or unsaturated, straight- or branched-chain alcohols having from between about 6 and 18 carbon atoms, or preferably between about 6 and 12 carbon atoms, or more preferably between about 8 and 10 carbon atoms;

c. one or more ethoxylated alcohols selected from the group consisting of alcohols having between 6 and 18 carbon atoms, where the ethylene oxide add-on is less than 5 moles;

d. a fatty acid of the structure R—(C═O)—OH, wherein R is selected from alkyl, alkenyl or alkynyl having from about 10 to 24 carbon atoms, with e. a source of nitrogen in an anhydrous state or as an aqueous solution selected from the group consisting of the ammonia, hydrazine, alkyl hydrazine, dialkyl hydrazine, urea, ethanolamine, monoalkyl ethanolamine, and dialkyl ethanolamine wherein alkyl is independently selected from methyl, ethyl, n-propyl or isopropyl wherein trialkylamines are excluded;

wherein the combustible fuel is any conventional or synthetic combustible fuel.

In another aspect, the present invention relates to an additive composition for a combustible fuel, to utilize readily available and renewable resources and produce improved fuel performance and combustion, which additive or fuel comprises a composition of components:

a. one or more alcohols selected from the group consisting of water-soluble alcohols having between about 1 and 5 carbon atoms as defined herein in an anhydrous state or as a 0.5–36% aqueous solution; and one or more of the following:

b. one or more alcohols selected from the group consisting of saturated or unsaturated, straight- or branched-chain alcohols having from between about 6 and 18 carbon atoms, or preferably between about 6 and 12 carbon atoms, or more preferably between about 8 and 10 carbon atoms;

c. one or more ethoxylated alcohols selected from the group consisting of alcohols having between 6 and 18 carbon atoms, where the ethylene oxide add-on is less than 5 moles;

d. a fatty acid of the structure R—(C═O)—OH, wherein R is selected from alkyl, alkenyl or alkynyl having from about 10 to 24 carbon atoms, with e. a source of nitrogen in an anhydrous state or as an aqueous solution selected from the group consisting of the ammonia, hydrazine, alkyl hydrazine, dialkyl hydrazine, urea, ethanolamine, monoalkyl ethanolamine, and dialkyl ethanolamine wherein alkyl is independently selected from methyl, ethyl, n-propyl or isopropyl, wherein trialkylamines are excluded;

wherein the combustible fuel is a fossil fuel such oil, jet fuel, kerosene, other distillate fuels, coal as Diesel fuel, heating slurry, gasoline or combinations thereof.

In another aspect, the present invention relates to an additive composition for a combustible fuel, to utilize readily available and renewable resources and produce improved fuel performance and combustion, which additive or fuel comprises a composition of components:

a. one or more alcohols selected from the group consisting of water-soluble alcohols having between about 1 and 5 carbon atoms as defined herein in an anhydrous state or as a 0.5–36% aqueous solution; and one or more of the following:

b. one or more alcohols selected from the group consisting of saturated or unsaturated, straight- or branched-chain alcohols having from between about 6 and 18 carbon atoms, or between about 6 and 12 carbon atoms, or between about 8 and 10 carbon atoms;

c. one or more ethoxylated alcohols selected from the group consisting of alcohols having between 6 and 18 carbon atoms, where the ethylene oxide add-on is less than 5 moles;

d. a fatty acid of the structure R—(C═O)—OH, wherein R is selected from alkyl, alkenyl or alkynyl having from about 10 to 24 carbon atoms, with e. a source of nitrogen in an anhydrous state or as an aqueous solution selected from the group consisting of the ammonia, hydrazine, alkyl hydrazine, diaklyl hydrazine, urea, ethanolamine, monoalkyl ethanolamine, and dialkyl ethanolamine wherein alkyl is independently selected from methyl, ethyl, n-propyl or isopropyl, wherein trialkylamines are excluded;

wherein the combustible fuel is a renewable oil, such as triglycerides from any feedstock, esterification products, waste vegetable oils, tallow, tall oils or combinations thereof.

In another aspect, the present invention relates to an additive composition for a combustible fuel, to utilize readily available and renewable resources and produce improved fuel performance and combustion, which additive or fuel comprises a composition of components:

a. one or more alcohols selected from the group consisting of water-soluble alcohols having between about 1 and 5 carbon atoms as defined herein in an anhydrous state or as a 0.5–36% aqueous solution; and one or more of the following:

b. one or more alcohols selected from the group consisting of saturated or unsaturated, straight- or branched-chain alcohols having from between about 6 and 18 carbon atoms, or between about 6 and 12 carbon atoms, or between about 8 and 10 carbon atoms;

c. one or more ethoxylated alcohols selected from the group consisting of alcohols having between 6 and 18 carbon atoms, where the ethylene oxide add-on is less than 5 moles;

d. a fatty acid of the structure R—(C═O)—OH, wherein R is selected from alkyl, alkenyl or alkynyl having from about 10 to 24 carbon atoms, with e. a source of nitrogen in an anhydrous state or as an aqueous solution selected from the group consisting of the ammonia, hydrazine, alkyl hydrazine, dialkyl hydrazine, urea, ethanolamine, monoalkyl ethanolamine, and dialkyl ethanolamine wherein alkyl is independently selected from methyl, ethyl, n-propyl or isopropyl, wherein trialkylamines are excluded;

wherein the combustible fuel is other alcohols, such as water-insoluble alcohols which are clear liquid at room temperature, having between about 6 and 12 carbon atoms, and long-chain saturated fatty alcohols which are solid at room (ambient) temperature, having between about 13 and 18 carbon atoms.

In another aspect, the present invention relates to an additive composition for a combustible fuel, which may also be used as a fuel composition, to utilize readily available and renewable resources and produce improved fuel performance and combustion, which fuel comprises a composition of components:

a. one or more alcohols selected from the group consisting of water-soluble alcohols having between about 1 and 5 carbon atoms as defined herein in an anhydrous state or as a 0.5–36% aqueous solution; and one or more of the following:

b. one or more alcohols selected from the group consisting of saturated or unsaturated, straight- or branched-chain alcohols having from between about 6 and 18 carbon atoms, or between about 6 and 12 carbon atoms, or between about 8 and 10 carbon atoms;

c. one or more ethoxylated alcohols selected from the group consisting of alcohols having between 6 and 18 carbon atoms, where the ethylene oxide add-on is less than 5 moles;

d. a fatty acid of the structure R—(C═O)—OH, wherein R is selected from alkyl, alkenyl or alkynyl having from about 10 to 24 carbon atoms, with e. a source of nitrogen in an anhydrous state or as an aqueous solution selected from the group consisting of the ammonia, hydrazine, alkyl hydrazine, dialkyl hydrazine, urea, ethanolamine, monoalkyl ethanolamine, and dialkyl ethanolamine wherein alkyl is independently selected from methyl ethyl n-propyl or isopropyl, wherein trialkylamines are excluded;

wherein the above composition comprises the total combustible fuel and the ratio of the other combustible fuels: above composition is 0:100.

Aspect for Co-Surfactants and Co-Solvents

In another aspect, the present invention relates to an additive composition for a combustible fuel to produce improved combustion and reduced smoke and particulate production of the combusted fuel, which additive composition comprises:

a. a fatty acid of the structure R—(C═O)—OH, wherein R is selected from alkyl, alkenyl or alkynyl having form about 10 to 24 carbon atoms;

b. at least one cosurfactant selected from the group consisting of clear liquid alcohols having form between about 6 and 12 carbon atoms;

c. at least one cosolvent as a water soluble alcohol selected from the group consisting of methanol, ethanol, propanol, butanol and pentanol;

d. optionally water; and e. a source of nitrogen in an anhydrous state or as any aqueous solution selected from the group consisting of the ammonia, hydrazine, alkyl hydrazine, dialkyl hydrazine, ethanolamine, monoalkyl ethanolamine, and dialkyl ethanolamine wherein alkyl is independently selected from methyl, ethyl, n-propyl or isopropyl, wherein trialkylamines are excluded;

wherein components a to e when combined with mixing with said combustible fuel form a clear stable microemulsion having a viscosity similar to that of the liquid combustible fuel, wherein the additive composition optionally excludes ethylene glycol, glycerine, polyethylene, polypropylene, aromatic organic compounds, sulfur, sulfur compounds, metals, metal compounds, compounds of phenanthrene, or emulsifiers of the general formula:

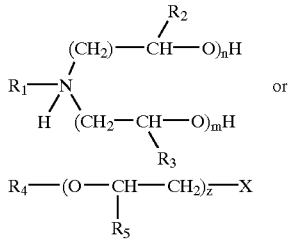

wherein $R_1$ and $R_4$ each independently is a saturated or unsaturated, straight-chain or branched hydrocarbon aliphatic radical each of 4 to 24 C atoms (e.g., alkyl or alkenyl) or $R_4$ is alkylphenyl of 1 to 18 C atoms in the optionally branched alkyl chain or H; $R_2$, $R_3$ and $R_5$ each independently represent a methyl group or H, n plus m is a number from 1 to 20; z is a number from 0 to 15; and X is —COO(−) or —$OCH_2COO$(−), wherein, substitutents $R_2$, $R_3$ and $R_5$ is the same or different in different monomer units of each chain, and optionally other organic diacids are excluded.

Aspect by Parts

In another aspect, the present invention relates to an additive composition for a combustible fuel to produce improved combustion and reduced smoke and particulate production of the fuel, which additive comprises a composition of components:

a. a fatty acid of the structure R—(C═O)—OH, where R is selected from alkyl, alkenyl or alkynyl having from about 10 to 24 carbon atoms is present in between about 15 and 60 parts by volume;

b. a clear water-insoluble liquid alcohol having from between about 6 and 12 carbon atoms present in between about 5 to 30 parts by volume;

c. water soluble alcohol selected from methanol or ethanol which in between about 8 to 40 parts by volume;

d. ammonia sufficient to neutralize between about 40 to 70 by volume the fatty acid of subpart a; and e. water which is present in between about 2 and 22 parts by volume;

wherein components a to e when combined with mixing with a liquid fuel form a clear stable microemulsion, wherein the additive composition optionally excludes ethylene glycol, glycerine, polyethylene, polypropylene, aromatic organic compounds, sulfur, sulfur compounds, metals, metal compounds, compounds of phenanthrene, and emulsifiers of the general formula:

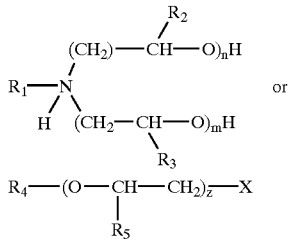

wherein $R_1$ and $R_4$ each independently is a saturated or unsaturated, straight-chain or branched hydrocarbon aliphatic radical each of 4 to 24 C atoms (e.g., alkyl or alkenyl) or $R_4$ is alkylphenyl of 1 to 18 C atoms in the optionally branched alkyl chain or H; $R_2$, $R_3$ and $R_5$ each independently represent a methyl group or H, n plus m is a number from 1 to 20; is a number from 0 to 15; and X is —COO(−) or —$OCH_2COO$(−), wherein, substitutents $R_2$, $R_3$ and $R_5$ are also different in different monomer units of each chain, and optionally other organic diacids are excluded.

Preferably the fuel/additive is in a ratio to produce a water-in-oil (w/o) emulsion, i.e., between about 50:50 to 95:5, more preferably between about 65.35 to 90:10, and most preferably between about 80:20 to 85:15.

Aspect by Parts II

In another aspect, the present invention relates to an additive composition for a combustible fuel to produce improved combustion and reduced smoke and particulate production of the fuel, which additive comprises a composition of components:

a. a fatty acid of the structure R—(C═O)—OH, wherein R is selected from alkyl, alkenyl or alkynyl having from about 10 to 24 carbon atoms is present in between about 15 and 60 parts by volume;

b. at least one alcohol selected from the group consisting of methanol, ethanol, propanol, butanol, and pentanol and clear liquid alcohols having from between about 6 and 12 carbon atoms, is present in between about 18 and 75 parts by volume, where methanol is combined with at least one other alcohol;

c. water which is present in between about 2 and 32 parts by volume; and d. ammonia sufficient to neutralize between about 40 to 70 percent of the fatty acid of subpart a;

wherein the additive composition optionally excludes ethylene glycol, glycerine, polyethylene, polypropylene, aromatic organic compounds, sulfur, sulfur compounds, metals, metal compounds, compounds of phenanthrene, and emulsifiers of the general formula:

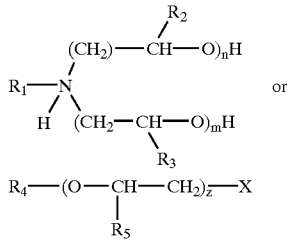

wherein $R_1$ and $R_4$ each independently is a saturated or unsaturated, straight-chain or branched hydrocarbon aliphatic radical each of 4 to 24 C atoms (e.g., alkyl or alkenyl) or $R_4$ is alkylphenyl of 1 to 18 C atoms in the optionally branched alkyl chain or H; $R_2$, $R_3$ and $R_5$ each independently represent a methyl group or H, n plus m is an integer from 1 to 20; is an integra from 0 to 15; and X is —COO(−) or —$OCH_2COO$(−), wherein, substitutents $R_2$, $R_3$ and $R_5$ are different in different monomer units of each chain, and optionally other organic diacids are excluded.

Preferably the fuel/additive is in a ratio to produce a water-in-oil (w/o) emulsion, i.e., between about 50:50 to 95:5, more preferably between about 65:35 to 90:10, and most preferably about 80:20 to 85:15 by volume.

Aspect where Urea Replaces Ammonia

In another aspect, the present invention relates to an additive composition for a combustible fuel to produce improved combustion and reduced smoke and particulate production of the fuel, which additive comprises a composition of components:

a. a fatty acid of the structure R—(C═O)—OH, wherein R is selected from alkyl, alkenyl or alkynyl having from about 10 to 24 carbon atoms is present in between about 15 and 60 parts by volume;

b. at least one alcohol selected from the group consisting of methanol, ethanol, propanol, butanol, pentanol and clear liquid alcohols having from between about 6 and 12 carbon atoms, is present in between about 18 and 75 parts by volume, where methanol is combined with at least one other alcohol;

c. water which is present in between about 2 and 32 parts by volume; and d. urea sufficient to neutralize between about 40 to 70 percent of the fatty acid of subpart a;

wherein the additive composition optionally excludes ethylene glycol, glycerine, polyethylene, polypropylene, aromatic organic compounds, sulfur, sulfur compounds, metals, metal compounds, compounds of phenanthrene, and emulsifiers of the general formula:

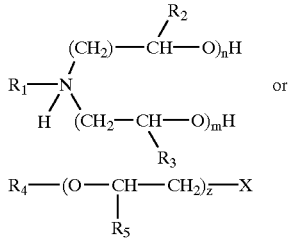

wherein $R_1$ and $R_4$ each independently is a saturated or unsaturated, straight-chain or branched hydrocarbon aliphatic radical each of 4 to 24 C atoms (e.g., alkyl or alkenyl) or $R_4$ is alkylphenyl of 1 to 18 C atoms in the optionally branched alkyl chain or H; $R_2$, $R_3$ and $R_5$ each independently represent a methyl group of H, n plus m is a number from 1 to 20; z is a number from 0 to 15; and X is —COO(−) or —$OCH_2COO$(−), wherein, substitutents $R_2$, $R_3$ and $R_5$ the same or different in different monomer units of each chain, and optionally other organic diacids are excluded.

Preferably the fuel/additive is in a ratio to produce a water-in-oil (w/o) emulsion, i.e., between about 50:50 to 95:5, more preferably between about 65:35 to 90:10, and most preferably about 80:20 to 85:15.

Aspect where Ethanol is the Only Alcohol

In another aspect, the present invention relates to an additive composition for a combustible fuel to produce improved combustion and reduced smoke and particulate production of the fuel, which additive comprises a composition of components:

a. a fatty acid of the structure R—(C═O)—OH, wherein R is selected from alkyl, alkenyl or alkynyl having from about 10 to 24 carbon atoms is present in between about 15 and 60 parts by volume;

b. ethanol is present in between about 18 and 75 parts;

c. water which is present in between about 2 and 32 parts by volume; and d. urea and/or ammonia sufficient to neutralize between about 40 to 70 percent of the fatty acid of subpart a;

wherein the additive composition optionally excludes ethylene glycol, glycerine, polyethylene, polyoxyethylene, polyoxypropylenes, aromatic organic compounds, sulfur, sulfur compounds, metals, metal compounds, compounds of phenanthrene, and emulsifiers of the general formula:

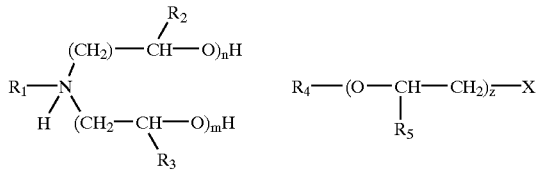

wherein $R_1$ and $R_4$ each independently is a saturated or unsaturated, straight-chain or branched hydrocarbon aliphatic radical each of 4 to 24 C atoms (e.g., alkyl or alkenyl) or $R_4$ is also can be alkylphenyl of 1 to 18 C atoms in the optionally branched alkyl chain or H; $R_2$, $R_3$ and $R_5$ each independently represent a methyl group or H, n plus m is to be a number from 1 to 20; z can be a number from 0 to 15; and X is —COO(−) or —$OCH_2COO$(−), wherein, substitutents $R_2$, $R_3$ and $R_5$ are the same or different in different monomer units of each chain, and optionally other organic diacids are excluded.

Preferably the fuel/additive is a ratio to produce a water-in-oil (w/o) emulsion, i.e., between about 65:35 to 90:10, and most preferably about 80:20 to 85:15 by volume.

Aspect where C6–C12 Alcohols are the Only Alcohols Present

In another aspect, the present invention relates to an additive composition for a combustible fuel to produce improved combustion and reduced smoke and particulate production of the fuel, which additive comprises a composition of components.

a. a fatty acid of the structure R—(C═O)—OH, wherein R is selected from alkyl, alkenyl or alkynyl having from about 10 to 24 carbon atoms is present in between about 15 and 60 parts by volume;

b. at least one alcohol selected from the group consisting of clear liquid alcohols having from between about 6 and 12 carbon atoms, is present in between about 18 and 75 parts by volume;

c. water which is present in between about 2 and 32 parts by volume; and d. urea and/or ammonia sufficient to neutralize between about 40 to 70 percent of the fatty acid of subpart a;

wherein the additive composition optionally excludes ethylene glycol, glycerine, polyethylene, polypropylene, aromatic organic compounds, sulfur, sulfur compounds, metals, metal compounds, compounds of phenanthrene, and emulsifiers of the general formula:

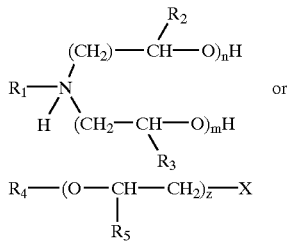

wherein $R_1$ and $R_4$ each independently is a saturated or unsaturated, straight-chain or branched hydrocarbon aliphatic radical each of 4 to 24 C atoms (e.g., alkyl or alkenyl) or R is alkylphenyl of 1 to 18 C atoms in the optionally branched alkyl chain or H; $R_2$, $R_3$ and $R_5$ each independently represent a methyl group or H, n plus m is a number from 1 to 20; z is a number from 0 to 15; and X is —COO(−) or —$OCH_2COO$(−), wherein, substitutents $R_2$, $R_3$ and $R_5$ are the same or different in different monomer units of each chain, and optionally other organic diacids are excluded.

Preferably the fuel/additive is in a ratio to produce a water-in-oil (w/o) emulsion, i.e., between about 50:50 to 95:5, more preferably between about 65:35 to 90:10, and most preferably about 80:20 to 85:15 by volume.

Aspect where Fatty Alcohols are Introduced Using Fossil Fuel as a Co-Solvent In another aspect, the present invention relates to an additive composition for a combustible fuel to produce improved combustion and reduced smoke and particulate production of the fuel, which additive comprises a composition of components:

a. a fatty acid of the structure R—(C═O)—OH, wherein R is selected from alkyl, alkenyl or alkynyl having from about 10 to 24 carbon atoms is present in between about 15 and 60 parts by volume;

b. at least one alcohol selected from the group consisting of methanol, ethanol, propanol, butanol, pentanol and clear liquid alcohols having from between about 6 and 12 carbon atoms, is present in between about 12 and 50 parts by volume, where methanol is combined with at least one other alcohol;

d. water present in between about 2 and 32 parts by volume;

e. urea, ammonia or combinations thereof sufficient to neutralize between about 40 to 70 percent of the fatty acid of subpart a;

f. at least one long-chain fatty alcohol selected from the group consisting of alcohols which are solid at room temperature, having from between about 13 and 18 carbon atoms in between about 6 and 25 parts by volume;

g. a co-solvent of fossil fuel in between about 6 and 25 parts by volume;

wherein the additive composition optionally excludes ethylene glycol, glycerine, polyethylene, polypropylene, metals, metal compounds, compounds of phenanthrene, and emulsifiers the general formula:

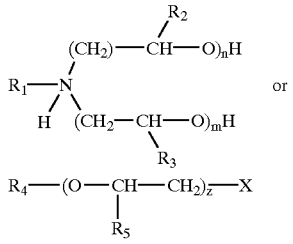

wherein $R_1$ and $R_4$ each independently is a saturated or unsaturated, straight-chain or branched hydrocarbon aliphatic radical each of 4 to 24 C atoms (e.g., alkyl or alkenyl) or $R_4$ is also can be alkylphenyl of 1 to 18 C atoms in the optionally branched alkyl chain or H; $R_2$, $R_3$ and $R_5$ each independently represent a methyl group or H, n plus m is a number from 1 to 20; z is a number from 0 to 15; and X is —COO(−) or —$OCH_2COO$(−), wherein, substitutents $R_2$, $R_3$ and $R_5$ are the same or different in different monomer units of each chain, and optionally other organic diacids are excluded.

Preferably the fuel/additive is in a ratio to produce a water-in-oil (w/o) emulsion, i.e., between about 50:50 to 95:5, more preferably between about 65:35 to 90:10, and most preferably about 80:20 to 85:15 by volume.

Aspect where Fatty Alcohols are Introduced Using a Non-Ionic Surfactant

In another aspect, the present invention relates to an additive composition for a combustible fuel to produce improved combustion and reduced smoke and particulate production of the fuel, which additive comprises a composition of components:

a. a fatty acid of the structure R—(C═O)—OH, wherein R is selected from alkyl, alkenyl or alkynyl having from about 10 to 24 carbon atoms is present in between about 15 and 60 parts by volume;

b. at least one alcohol selected from the group consisting of methanol, ethanol, propanol, butanol, pentanol and clear liquid alcohols having from between about 6 and 12 carbon atoms, is present in between about 12 and 50 parts by volume, where methanol is combined with at least one other alcohol;

d. water which is present in between about 2 and 32 parts by volume;

e. urea and/or ammonia sufficient to neutralize between about 40 to 70 percent of the fatty acid of subpart a;

f. at least one long-chain fatty alcohol selected from the group consisting of alcohols which are solid at room temperature, having from between about 13 and 18 carbon atoms is present in between about 6 and 25 parts;

wherein the additive composition optionally excludes polyethylene, polypropylene, aromatic organic compounds, sulfur, sulfur compounds, metals, metal compounds, compounds of phenanthrene, and emulsifiers of the general formula:

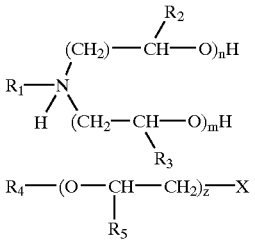

or wherein $R_1$ and $R_4$ each independently is a saturated or unsaturated, straight-chain or branched hydrocarbon aliphatic radical each of 4 to 24 C atoms (e.g., alkyl or alkenyl) or $R_4$ is alkylphenyl of 1 to 18 C atoms in the optionally branched alkyl chain or H; $R_2$, $R_3$ and $R_5$ each independently represent a methyl group or H, n plus m is an integer from 1 to 20; z is an integer from 0 to 15; and X is —COO(−) or —$OCH_2COO$(−), wherein, substitutents $R_2$, $R_3$ and $R_5$ are the same or different in different monomer units of each chain, and optionally other organic diacids are excluded.

Preferably the fuel/additive is in a ratio to produce a water-in-oil (w/o) emulsion, i.e., between about 50:50 to 95:5, more preferably between about 65:35 to 90:10, and most preferably about 80:20 to 85:15 by volume.

Aspect where Fatty Alcohols and Non-Ionic Surfactants are Introduced Using Fossil Fuel as a Co-Solvent The present invention relates to an additive composition for a combustible fuel to produce improved combustion and reduced smoke and particulate production of the combusted fuel, which additive composition comprises:

a. a fatty acid of the structure R—(C═O)—OH, wherein R is selected from alkyl, alkenyl or alkynyl having from about 10 to 24 carbon atoms;

b. at least one alcohol selected from the group consisting of methanol, ethanol, propanol, butanol, pentanol and clear liquid alcohols having from between about 6 and 12 carbon atoms, where methanol is always be combined with at least one other alcohol;

c. water; and d. a source of nitrogen in an anhydrous state or as an aqueous solution selected from the group consisting of the ammonia, hydrazine, alkyl hydrazine, dialkyl hydrazine, urea, ethanolamine, monoalky ethanolamine, and dialkyl ethanolamine wherein alkyl is independently selected from methyl, ethyl, n-propyl or isopropyl, wherein trialkylamines are excluded;

e. optionally, at least one long-chain fatty alcohol selected from the group consisting of alcohols which are solid at room temperature, having from between about 13 and 18 carbon atoms;

f. optionally, an ethoxylated non-ionic surfactant wherein the ethylene oxide condensation product is formed with a fatty alcohol of the formula:

$$R_6—(OOCH_2—CH_2)_nOH$$

wherein $R_6$ is a long-chain, saturated or unsaturated hydrocarbon radical containing 12 to 18 carbon atoms and n is an integer from 1 to 4;

g. optionally, a liquid fossil fuel.

wherein components a to g when combined with mixing with said combustible fuel form a clear stable microemulsion having a viscosity similar to a liquid combustible fuel, wherein the additive composition optionally excludes ethylene glycol, glycerine, polyethylene, polypropylene, aromatic organic compounds, sulfur, sulfur compounds, metals, metal compounds, compounds of phenanthrene, and emulsifiers of the general formula:

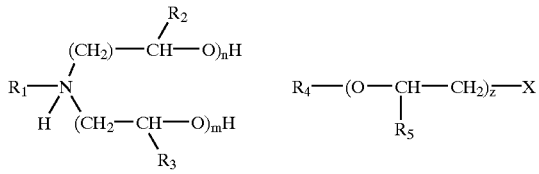

wherein $R_1$ and $R_4$ each independently is a saturated or unsaturated, straight-chain or branched hydrocarbon aliphatic radical each of 4 to 24 C atoms (e.g., alkyl or alkenyl) or $R_4$ also can be alkylphenyl of 1 to 18 C atoms in the optionally branched alkyl chain or H; $R_2$, $R_3$ and $R_5$ each independently represent a methyl group of H, n plus m is to be a number from 1 to 20; z can be a number from 0 to 15; and X is —COO(−) or —$OCH_2COO$(−), wherein, substitutents $R_2$, $R_3$ and $R_5$ can also be different in different monomer units of each chain, and optionally other organic diacids are excluded.

Compositions of the present invention are easily used in place of the corresponding hydrocarbon fuels without substantial changes in combustion apparatus or equipment.

Even with the components used herein there are rules and limitations. For example:

Too much methanol causes dissolving of sensitive engine or fuel system parts.

Too much water causes poor combustion, possible corrosion.

Too much of any water-soluble portion causes no stability.

Too much water-insoluble alcohol causes poor viscosity.

Too much ethoxylated alcohol causes poor viscosity and poor combustion.

Too much fatty acid causes poor viscosity, fatty acid degradation.

Too much ammonia causes no stability of the microemulsion.

Too much of any surface-active portion causes poor viscosity, and factors prohibitively in end-use costs.

On the other hand:

Too little water-soluble alcohol causes poor viscosity and reduces emissions improvements.

Too little water causes reduced emissions improvements;

Too little surfactant portion causes no stability; and

Too little water-insoluble alcohol in relation, to ethoxylated alcohols or fatty acids causes poor viscosity.

The stability of the fuel/additive emulsions of the present invention at lower temperatures from about −20° C. to +70° C. Alternatively, the upper limit is about 20° C. (preferably about 20° C.) lower than the boiling point of the fuel.

The stable fuel/additive emulsions have improved long term storage properties.

The appearance of the fuel/additive emulsion is as a clear liquid having the expected properties of a water-in-oil without microemulsion. All of the components of the fuel/additive emulsion are known and are preparable from conventionally known starting materials. Most, if not all, are available from commercial sources.

Some preferred compositions of the present invention include but are not limited to those:

wherein Example A below is repeated except that the additive composition amounts are replaced to be the additive composition as follows:

| | |
|---|---|
| linoleic acid, or oleic acid, or both; | 16–36 parts by volume |
| octanol; | 6–32 parts by volume |
| methanol; | 12–28 parts by volume |
| water; | 0.5–16 parts by volume |
| aqueous ammonia or urea | 0.3–6 parts by volume |

where the preferred fuel is Diesel fuel, the fuel/additive ratio is about 65:35 to 95:5 and the result of mixing by gentle swirling produces a clear microemulsion composition that remains stable over time, up to 6 months or longer, and during and after storage at a temperature of −20° C.

wherein Example A below is repeated except that the additive composition amounts are replaced to be the additive composition as follows:

| | |
|---|---|
| linoleic acid, or oleic acid, or both; | 16–36 parts by volume |
| 2-ethyl hexanol-1, or octanol or octadecanol, or decanol; | 6–32 parts by volume |
| methanol; | 12–28 parts by volume |
| water; | 0.5–16 parts by volume |
| aqueous ammonia or urea | 0.3–6 parts by volume |

where the preferred fuel is Diesel fuel, the fuel/additive ratio is about 65:35 to 95:5 and the result of mixing by gentle swirling produces a clear microemulsion composition that remains stable over time, up to 6 months or longer, and during and after storage at a temperature of −20° C.

wherein Example A below is repeated except that the additive composition amounts are replaced to be the additive composition as follows:

| | |
|---|---|
| linoleic acid, or oleic acid, or both; | 16–36 parts by volume |
| 2-ethyl hexanol-1, or octanol or octadecanol, or decanol; | 6–32 parts by volume |
| methanol, or ethanol, or both or methanol and/or ethanol with iso-propanol or butanol; | 12–28 parts by volume |
| water; | 0.5–16 parts by volume |
| aqueous ammonia or urea | 0.3–6 parts by volume |

where the preferred fuel is Diesel fuel, the fuel/additive ratio is about 65:35 to 95:5 and the result of mixing by gentle swirling produces a clear microemulsion composition that remains stable over time, up to 6 months or longer, and during and after storage at a temperature of −20° C.

wherein Example A below is repeated except that the additive composition amounts are replaced to be the additive composition as follows:

| | |
|---|---|
| linoleic acid, or oleic acid, or both; | 16–36 parts by volume |
| ethoxylated alcohol with 12–18 carbons and ethylene oxide ending of less than 5; | 2–10 parts by volume |
| 2-ethyl hexanol-1, or octanol or octadecanol, or decanol; | 6–32 parts by volume |
| methanol, or ethanol, or both or methanol and/or ethanol with iso-propanol or butanol; | 12–28 parts by volume |
| water; | 0.5–16 parts by volume |
| aqueous ammonia or urea | 0.3–6 parts by volume |

where the preferred fuel is Diesel fuel, kerosene, or heating oil, the fuel/additive ratio is about 65:35 to 95:5 and the result of mixing by gentle swirling produces a clear microemulsion composition that remains stable over time, up to 6 months or longer, and during and after storage at a temperature of −20° C.

wherein Example A below is repeated except that the additive composition amounts are replaced to be the additive composition as follows:

| | |
|---|---|
| ethoxylated alcohol with 12–18 carbons and ethylene oxide ending of less than 5; | 2–10 parts by volume |
| 2-ethyl hexanol-1, or octadecanol, or decanol; | 6–32 parts by volume |
| ethanol, or ethanol with methanol, or ethanol with iso-propanol or butanol; | 12–32 parts by volume |
| water; | 0.5–8 parts by volume |

where the preferred fuel is Diesel fuel or gasoline, fuel/additive ratio is about 65:35 to 95:5 and the result of mixing by gentle swirling produces a clear microemulsion composition that remains stable over time, up to 6 months or longer, and during and after storage at a temperature of −20° C.

wherein Example A below is repeated except that the additive composition amounts are replaced to be the additive composition as follows:

| | |
|---|---|
| ethoxylated alcohol with 12–18 carbons and ethylene oxide ending of less than 5; | 6–32 parts by volume |

-continued

| | |
|---|---|
| ethanol, or ethanol with methanol, or ethanol with iso-propanol or butanol; | 12–32 parts by volume |
| water; | 0.5–8 parts by volume |

where the preferred fuel is Diesel fuel or gasoline, fuel/additive ratio is about 65:35 to 95:5 and the result of mixing by gentle swirling produces a clear microemulsion composition that remains stable over time, up to 6 months or longer, and during and after storage at a temperature of −20° C.

wherein Example A is repeated except that the additive composition amounts are replaced to be the additive composition as follows:

| | |
|---|---|
| 2-ethyl hexanol-1, or octanol or octadecanol, or decanol; | 12–32 parts by volume |
| ethanol, or ethanol with methanol, or ethanol with iso-propanol or butanol; | 12–32 parts by volume |
| water; | 0.5–4 parts by volume |

where the preferred fuel is Diesel fuel or gasoline, fuel/additive ratio is about 65:35 to 95:5 and the result of mixing by gentle swirling produces a clear microemulsion composition that remains stable over time, up to 6 months or longer, and during and after storage at a temperature of −20° C.

It is important to understand that the present invention is a significant advance in additives designed to introduce water-soluble components into Diesel fuel and other fossil fuels.

Although it is generally understood that the addition of water-soluble elements into fossil fuels would have a positive oxygenating effect; fossil fuels are, generally, chemically hydrophobic, meaning they will not readily absorb or mix with water and/or water-soluble components.

Gasoline will tolerate certain levels of ethanol and methanol, which are water-soluble, but will not tolerate high levels of methanol, will not tolerate any level of water, and will, in the presence of water, exhibit immediate phase separation without some chemical or mechanical means of breaking surface tension to produce a stable solution or emulsion.

Less-refined fossil fuels such as Diesel fuel and kerosene, are especially hydrophobic, and will not tolerate any level of water-soluble alcohol or water, and will, in the presence of either, exhibit immediate phase separation without some chemical or mechanical means of breaking surface tension to produce a stable solution or emulsion.

It is important to understand that many methods have been tried to overcome the problem of phase separation between fossil fuels and water-soluble components.

Prior art, such as Wenzel et al, U.S. Pat. No. 4,083,698, successfully produces stable microemulsions with water and methanol, but utilizes high concentrations of non-ionic surfactants with 5,7,9 and up to 20 moles of ethylene oxide, or polyethylene. polyoxyethylene, or polyoxypropylene molecules. While these create stable microemulsions, viscosity is adversely affected, producing compositions that are more viscous than Diesel fuel, which poses potential problems in adequate fuel flow during use in an engine.

The above ethylene, polyethylene, polyoxyethylene, or polyoxypropylene add-ons are also largely incombustible, which poses the immediate problem of increased exhaust smoke when not specifically limited or eliminated entirely from compositions for use as fuel.

Other products currently used or under investigation for the purpose of introducing water-soluble elements into fossil fuel include Methyl Tertiary Butyl Ether (MTBE) and Methyltetrahydrofuran.

MTBE, which is currently used in many states as a gasoline additive, is a significant alteration of the chemical composition of methanol, making it 'oleophilic,' so that it will mix with and can be used to oxygenate gasoline. The process of producing MTBE, however, also alters the biodegradeability of the methanol, and has been shown to filtrate through to groundwater and contaminate drinking water supplies.

The present invention can be used to introduce water-soluble alcohols into gasoline to achieved oxygenation with no toxic contamination of the air or water supplies.

Methyltetrahydrofuran, which is currently under study as a Diesel fuel additive, is another significant alteration of methanol, increasing its solvent qualities. This methanol compound breaks surface tension between Diesel fuel and ethanol, making it possible to utilize ethanol for its oxygenating properties.

However, methyltetrahydrofiran is an extremely aggressive solvent that melts steel. Its use in engines as a fuel additive poses a very high risk of causing damage to internal engine and sensitive fuel system parts.

The present invention can be used to introduce water soluble alcohols and water into Diesel fuel with no damage to engine or fuel system parts.

Even currently used ethanol, denatured with methanol, poses a problem when used to oxygenate gasoline because methanol especially attracts water to the mixture, promoting phase separation; and because methanol is a much stronger solvent than ethanol (about 10 times stronger) which has been shown to adversely affect pipelines through which gasoline is shipped to many suppliers.

The present invention can be used to introduce ethanol into gasoline to achieve oxygenation, with no phase separation, damage to pipelines, engines or fuel systems, and with no toxic contamination of the air or water supplies.

It is also important to understand that, in addition to fossil fuel oxygenation, the present invention is a significant advance in additives designed to introduce renewable and readily-available resources into fossil fuels.

It is generally understood that successful introduction into fossil fuels of oils and alcohols derived from bio-mass sources would have a positive effect on extending dwindling fuel supplies by fully utilizing readily-available resources that are also renewable.

Significant attempts have been made to introduce ethanol, which can be derives from bio-mass sources, into fossil fuels, as described above.

Significant attempts have also been made to introduce vegetable oil products, such as soy and rapeseed oils, into fossil fuels, specifically for the purpose of utilizing these oils.

A product commercially known as "Biodiesel" is currently being developed and tested in transit bus lines, marine diesel engines, and industrial furnaces. Biodiesel is made from methyl esters, a process by which methanol and vegetable oils are chemically bonded.

However, methyl esters solidify at relatively high temperatures. Biodiesel must be heat-jacketed for storage at temperatures of less than 32° F., and no practical solution has been found for the problem of additive gelling in fuel tanks when ambient temperatures drop below freezing.

It is important to understand that the present invention utilizes components, such as fatty acids, that can be derived from a wide range of renewable sources such as soy, rapeseed, peanut, safflower, tall(tree) oil, and tallow, with no compromise to additive viscosity at high or low temperatures.

The compositions of the invention also utilize water-insoluble alcohols that can be derived from either fossil (coal) or renewable sources such as palm or coconut. The present invention also utilizes water-soluble alcohols, such as ethanol, that can also be derived from fossil sources (such as coal), or from bio-mass sources such as corn or surplus or damaged crops.

It is important to understand that the wide range of possible sources from which components for the present invention can be derived is a significant advance in additive technologies designed to incorporate renewable resources into fossil fuels. Many present technologies rely on one or two sources, such as soy or canola (rapseed) oils, which presently are prohibitively expensive and hinder commercially successful utilization. Biodiesel is one such technology.

Other technologies rely on inexpensive components, such as methanol, as the source from which components are derived. However, methanol derivatives tend to be toxic, or non-biodegradeable, or chemically aggressive, or all of the above. MTBE and methylterahydrofuran are such examples.

It is possible to derive components for the present invention from a wide selection of renewable feedstocks, such as tall oil, tallow, soy, canola, waste oils, cottonseed, corn, peanut, safflower, coconut and palm oils, as well as crushed waste, surplus, or damaged crops.

But it is also important that several of the preferred embodiments of the present invention can be derived almost entirely from coal, and still produce clear, stable microemulsions that oxygenate fossil fuels.

This provides an essential link, economically, for successfully introducing alcohol/water-based oxygenators that can also be made entirely from renewable sources at any time that positive economic and/or political factors make them commercially viable.

The present invention is, among other things, a 'roadmap' for the successful introduction of renewable fuels, by making it possible to mix relatively high-cost renewable components with lower-cost fossil-based components in proportions that optimize economic and environmental benefits.

The present invention makes it possible to utilize all of the above-mentioned components in such a way that the resulting compositions will maintain, and in some cases improve, viscosity levels of Diesel and other fossil fuels.

The present invention also makes it possible to utilize all of the above-mentioned components in such a way that the resulting compositions will not pollute the environment, or harm engines or fuel systems.

The present invention also makes it possible to utilize all of the above-mentioned components in such a way that the resulting compositions maintain good combustion characteristics, and, when properly mixed with Diesel and other fossil fuels, will improve combustion and reduce toxic exhaust emissions.

Some preferred compositions of the present invention include but are not limited to those:

wherein Examples 1–7 are repeated except that the additive composition amounts are replaced to be the additive composition as follows:

| | |
|---|---|
| 2-ethyl hexanol-1 or octanol or octadecanol, or decanol; | 12–32 parts by volume |
| ethanol, or ethanol with methanol, or ethanol with iso-propanol or butanol; | 12–32 parts by volume |
| water | 0.5–4 parts by volume |

where the fuel/additive ratio is about 80:20 to 95:5 and the result of combustion of the resulting fuel additive composition is improved combustion, reduced carbon buildup inside the engine, reduced smoke, particulates, and noxious gases, reduced unburnt hydrocarbon emissions and improved fuel consumption efficiency.

wherein Examples 1–7 are repeated except that the additive composition amounts are replaced to be the additive composition as follows:

| | |
|---|---|
| ethoxylated alcohol with 12–18 carbons and ethylene oxide ending of less than 5; | 6–32 parts by volume |
| ethanol, or ethanol with methanol, or ethanol with iso-propanol or butanol; | 12–32 parts by volume |
| water | 0.5–8 parts by volume |

where the fuel/additive ratio is about 80:20 to 95:5 and the result of combustion of the resulting fuel additive composition is improved combustion reduced carbon buildup inside the engine, reduced smoke, particulates, and noxious gases, reduced unburnt hydrocarbon emissions and improved fuel consumption efficiency.

In another aspect Examples 1–7 are repeated except that the additive composition amounts are replaced to be the additive composition as follows:

| | |
|---|---|
| ethoxylated alcohol with 12–18 carbons and ethylene oxide ending of less than 5; | 2–10 parts by volume |
| 2-ethyl hexanol-1, or octanol, or octadecanol, or decanol; | 6–32 parts by volume |
| ethanol, or ethanol with methanol, or ethanol with iso-propanol or butanol; | 12–32 parts by volume |
| water | 0.5–8 parts by volume |

where the fuel/additive ratio is about 80:20 to 95:5 and the result of combustion of the resulting fuel additive composition is improved combustion, reduced carbon buildup inside the engine, reduced smoke, particulates, and noxious gases, reduced unburnt hydrocarbon emissions and improved fuel consumption efficiency.

In another aspect Examples 1, 2, 3 or 7 below are repeated except that the additive composition amounts are replaced to be the additive composition as follows:

| | |
|---|---|
| linoleic acid, or oleic acid, or both; | 16–36 parts by volume |
| ethoxylated alcohol with 12–18 carbons and ethylene oxide ending of less than 5; | 2–10 parts by volume |
| 2-ethyl hexanol-1, or octanol, or octadecanol, or decanol; | 6–32 parts by volume |
| methanol, or ethanol, or both, or methanol and/or ethanol with iso-propanol or butanol; | 12–28 parts by volume |
| water; | 0.5–16 parts by volume |
| aqueous ammonia or urea | 0.3–6 parts by volume |

where the fuel/additive ratio is about 80:20 to 95:5 and the result of combustion of the resulting fuel additive composition is improved combustion, reduced carbon buildup inside the engine, reduced smoke, particulates, and noxious gases, reduced unburnt hydrocarbon emissions and further improved fuel consumption efficiency.

In another aspect Examples 1, 2, 3 or 7 below are repeated except that the additive composition amounts are replaced to be the additive composition as follows:

| | |
|---|---|
| linoleic acid, or oleic acid, or both; | 16–36 parts by volume |
| 2-ethyl hexanol-1, or octanol, or octadecanol, or decanol; | 6–32 parts by volume |
| methanol, or ethanol, or both, or methanol and/or ethanol with iso-propanol or butanol; | 12–28 parts by volume |
| water; | 0.5–16 parts by volume |
| aqueous ammonia or urea; | 0.3–6 parts by volume |

where the fuel/additive ratio is about 80:20 to 95:5 and the result of combustion of the resulting fuel additive composition is improved combustion, reduced carbon buildup inside the engine, reduced smoke, particulates, and noxious gases, reduced unburnt hydrocarbon emissions and further improved fuel consumption efficiency.

In another aspect Examples 1, 2, 3 or 7 below are repeated except that the additive composition amounts are replaced to be the additive composition as follows:

| | |
|---|---|
| linoleic acid, or oleic acid, or both; | 16–36 parts by volume |
| methanol, or ethanol, or both. or methanol and/or ethanol with iso-propanol or butanol; | 12–28 part by volume |
| water; | 0.5–16 parts by volume |
| aqueous ammonia or urea; | 0.3–6 parts by volume |

where the fuel/additive ratio is about 80:20 to 95:5 and the result of combustion of the resulting fuel additive composition is improved combustion, reduced carbon buildup inside the engine, reduced smoke, particulates, and noxious gases, reduced unburnt hydrocarbon emissions and further improved fuel consumption efficiency.

In another aspect Examples 1, 2, 3 or 7 below are repeated except that the additive composition amounts are replaced to be the additive composition as follows:

| | |
|---|---|
| fatty acid (linoleic acid) | 40 to 44 parts by volume; |
| water-insoluble alcohol (octanol) | 20 to 22 parts by volume; |
| water-soluble alcohol (ethanol denatured with 5–10% methanol) | 16 to 18 parts by volume; |
| water | 4 to 6 parts by volume; |
| aqueous ammonia (28%) | 4 to 6 parts by volume; |

where the fuel/additive ratio is about 95:5 to 85:15 and the result of combustion of the resulting fuel/additive composition is improved combustion reduced carbon buildup inside the engine, and reduced smoke, particulates, and noxious gases.

In another aspect Examples 1, 2, 3 or 7 below are repeated except that the additive composition amounts are replaced to be the additive composition as follows:

| | |
|---|---|
| fatty acid (linoleic acid) | 34 to 36 parts by volume; |
| water-insoluble alcohol (octanol) | 16 to 18 parts by volume; |

-continued

| | |
|---|---|
| water-soluble alcohol (methanol-denatured) | 20 to 24 parts by volume; |
| water | 9 to 12 parts by volume; |
| aqueous ammonia (28%) | 4.6 to 4.9 parts by volume; |

where the fuel/additive ratio is about 90:10 to 75:25 and the result of combustion of the resulting fuel/additive composition is improved combustion, reduced carbon buildup inside the engine, and further reduced smoke, particulates, and noxious gases compared to compositions having a lower additive proportion.

In another aspect Examples 1, 2, 3 or 7 below are repeated except that the additive composition amounts are replaced to be the additive composition as follows:

| | |
|---|---|
| fatty acid (linoleic acid) | 28 to 32 parts by volume; |
| water-insoluble alcohol (octanol) | 10 to 16 parts by volume; |
| water-soluble alcohol (methanol) + ethanol | 24 to 28 parts by volume; |
| water | 10 to 15 parts by volume; |
| aqueous ammonia (28%) | 3.8 to 4.4 parts by volume; |

where the fuel/additive ratio is about 80:20 to 65:35 and the result of combustion of the resulting fuel/additive composition is improved combustion, reduced carbon buildup inside the engine, and reduced noxious gases and remarkably reduced smoke and particulate emissions.

In another aspect Examples 1, 2, 3 or 7 below are repeated except that the additive composition amounts are replaced to be the additive composition as follows:

| | |
|---|---|
| fatty acid (linoleic acid) | 24 to 26 parts by volume; |
| water-insoluble alcohol (octanol) | 8 to 12 parts by volume; |
| water-soluble alcohol (methanol) + ethanol | 24 to 28 parts by volume; |
| water | 10 to 15 parts by volume; |
| aqueous ammonia (28%) | 3.8 to 4.4 parts by volume; |

where the fuel/additive ratio is about 65:35 to 50:50 and the result of combustion of the resulting fuel/additive composition is improved combustion, reduced carbon buildup inside the engine, and reduced noxious gases and remarkably reduced smoke and particulate emissions.

It is important to understand that the present invention is a significant advance in additives designed to oxygenate fossil fuels. The selection and use of the components described herein fall within the US EPA 'CHON' classification, meaning they contain only carbon, hydrogen, oxygen and nitrogen.

The selection and use of the components described herein are non-toxic compared to fossil fuel, especially Diesel fuel, and are non-toxic and bio-degradeable compared to other additives such as methyltetrahydrofuran and methyl tertiary butyl ether (MTBE).

The selection and use of the components described herein can be derived entirely from renewable bio-sources, and some may also be derived from coal to offset currently high costs associated with renewable fuels production compared to fossil fuel production.

It is important also to understand that the present invention is a significant advance in additives for fuels for internal combustion engines. The selection and use of the components described herein improve by about 50% or greater reduction of the smoke and particulates produced by incomplete combustion. Specific additive compositions will provide 30%, 40%, 50%, 60%, 70%, 80% or greater reductions in total particulate emissions and 50%, 60%, 70%, 80%, 90% or greater reduction in smoke opacity.

The commercial sources of components can be obtained by referring to *Chemical Sources U.S.A.* published annually by Directories Publications, Inc. of Boca Raton, Fla. Usually the materials are used in the present invention as received without further purification.

The following Examples are provided to be illustrative and descriptive only. They are not to be construed to be limited in any way.

EXAMPLE 1

Combustion Tests with Additive Composition Photo Documentation of Visible Exhaust Emissions a) A confidential test experiment was performed at the Stockton East Water District, Stockton, Calif.

The engine was a 300 hp V8 Caterpillar Diesel engine (one of four pumping engines at the site).

The additive formulation was by parts by volume:

30 parts linoleic acid 10 parts TERGITOL 1553 (3 moles ethylene oxide 15C alcohol)

28 parts methanol 15 parts water 4.1 parts aqueous ammonia

The blend ratio was Diesel fuel:additive of 65:35 by volume.

Forty gallons of the subject additive blend in a 55 gallon drum were lifted by forklift to the level of the far right engine and the fuel pump/line was secured to the fuel drum. The engine was started with fuel/additive blend as its only fuel supply. No changes were made to the engine other than switching the fuel supply.

With reference to FIGS. 1–6 the experimental results are described.

FIG. 1 shows Caterpillar engine used for the test.

Figure 2:
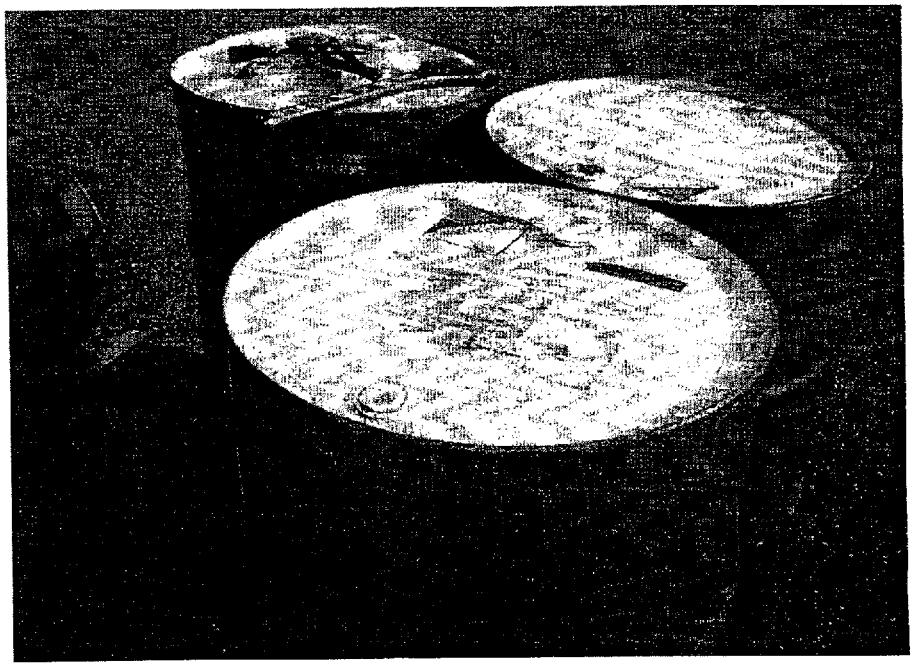

FIG. 2 shows containers of the additive blends.

Figure 3:
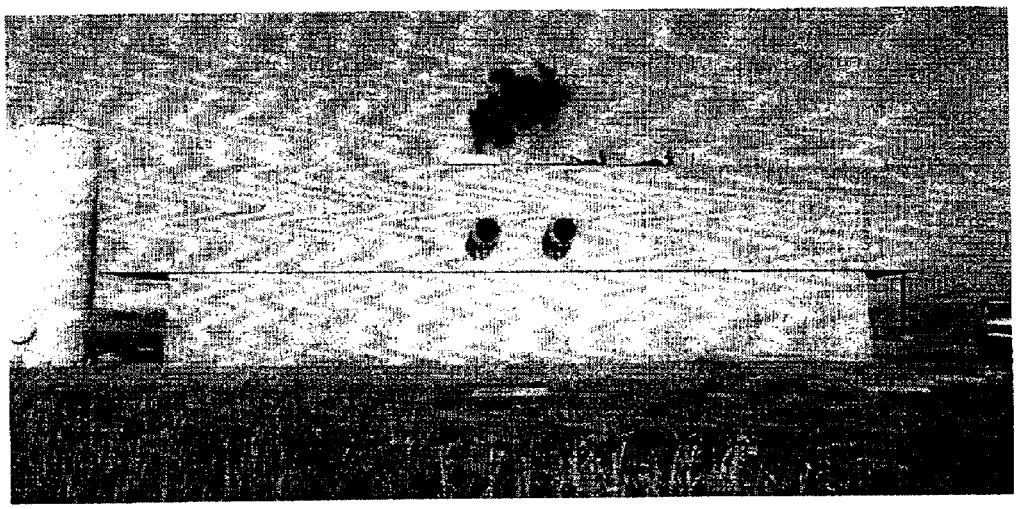

FIG. 3 shows engine housing building with typical straight diesel fuel startup emissions shown from the left smoke stack.

Figure 4:
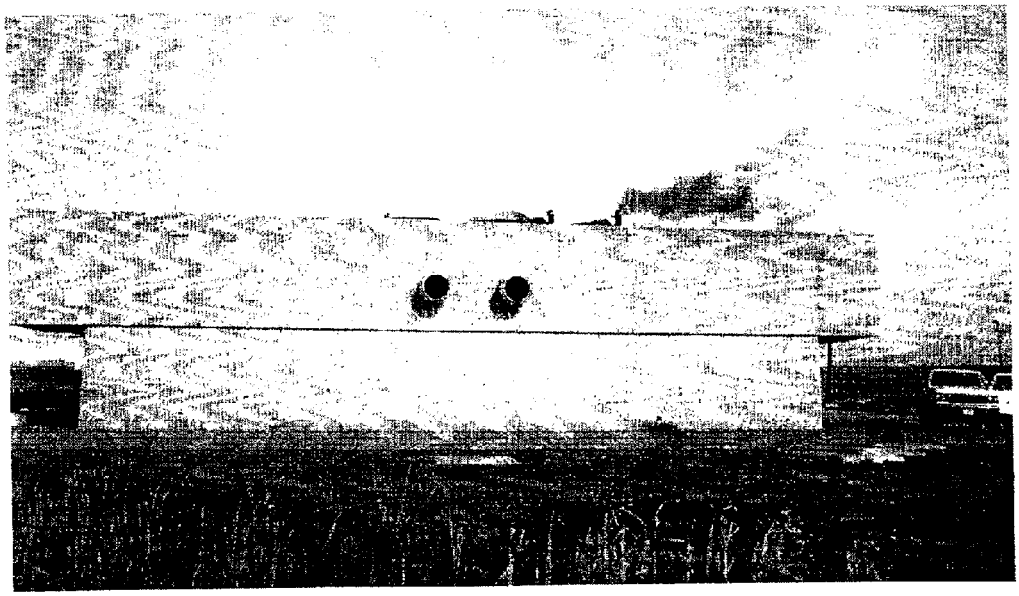

FIG. 4 shows a typical startup from engine using the fuel/additive blend shown from far right smoke stack.

Figure 5:
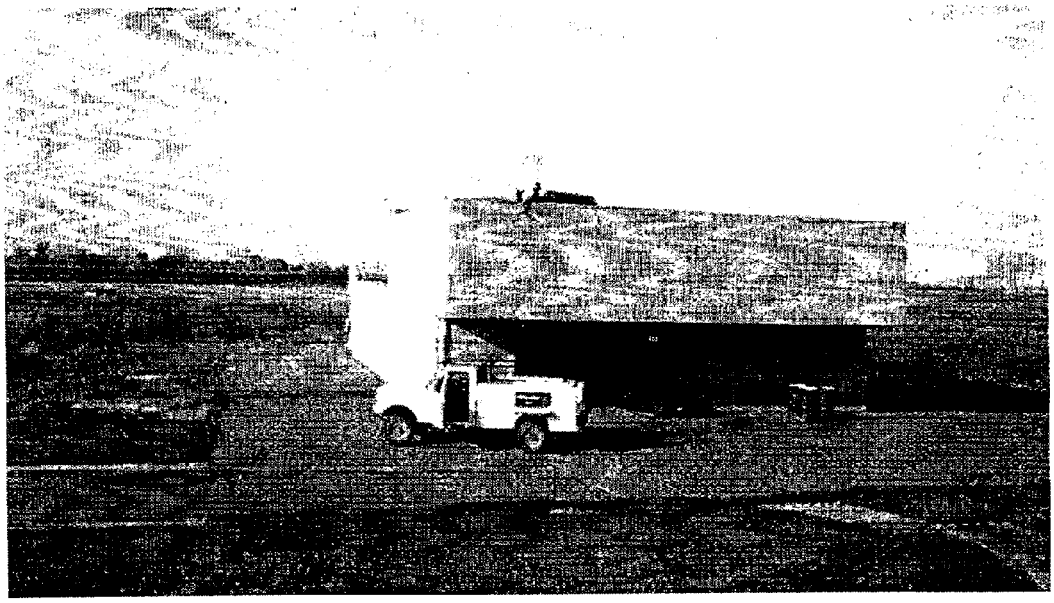

FIG. 5 shows typical smoke wisp from two left smoke stacks where straight diesel fuel is being used.

Figure 6:
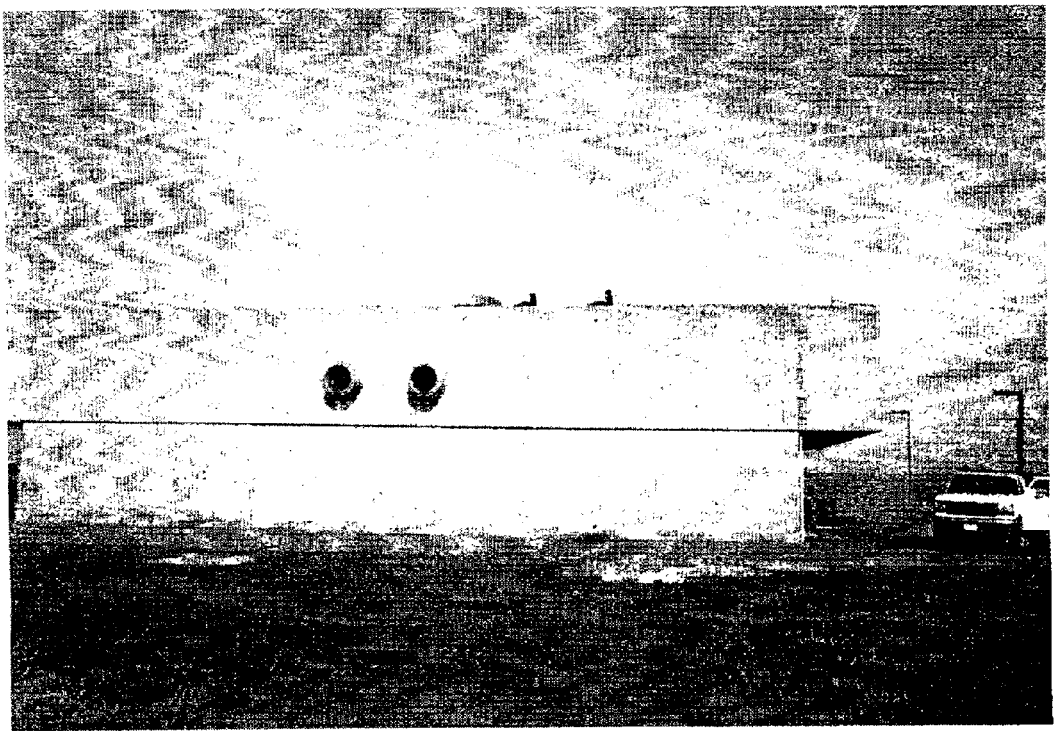
Figure 7:
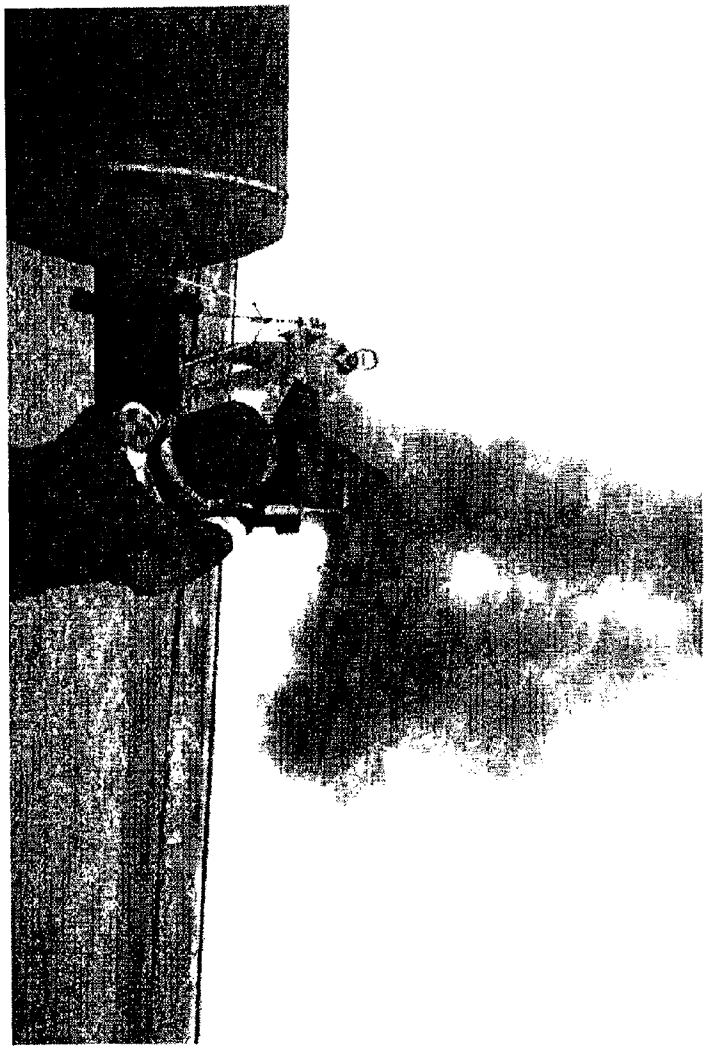
FIGS. 7–18 show test procedure and 1-minute filter samples showing particulate reductions at Stockton East Water District.
Figure 8:
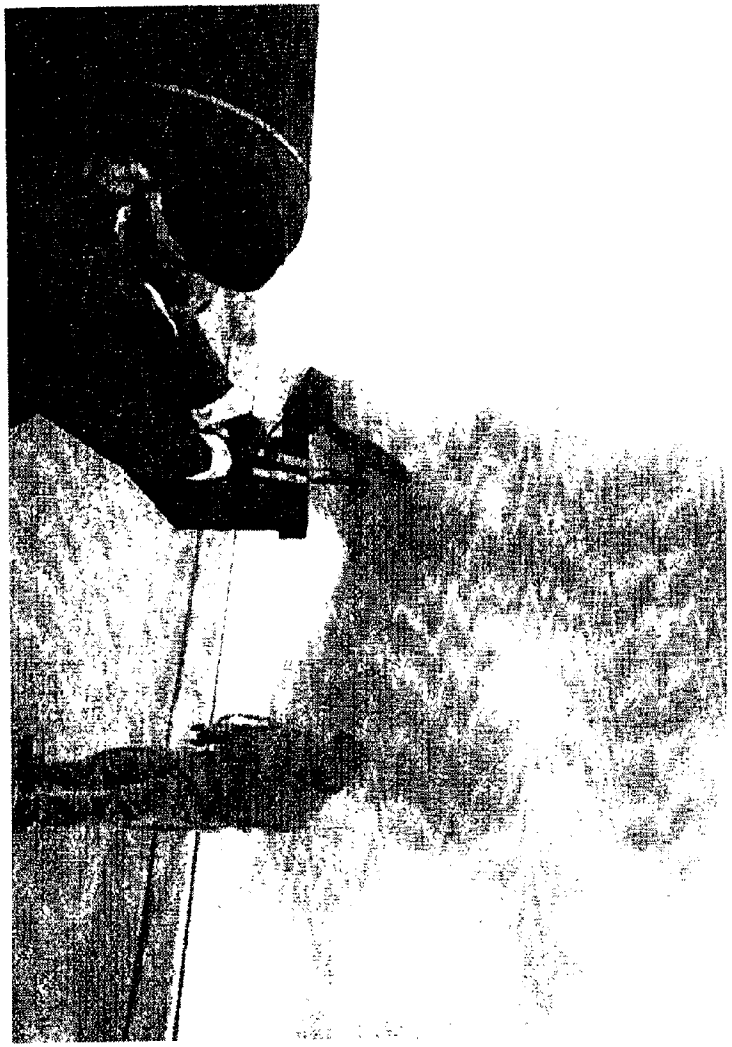
Figure 9:
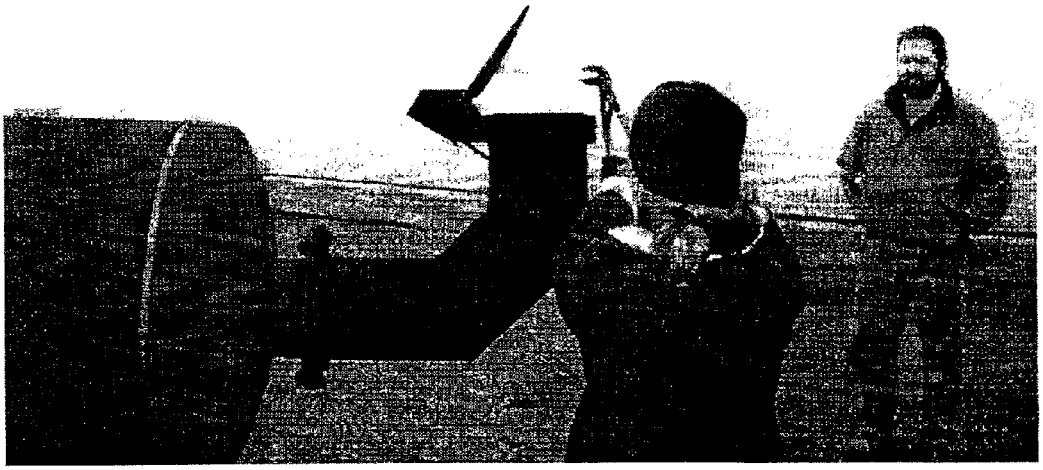
Figure 10:
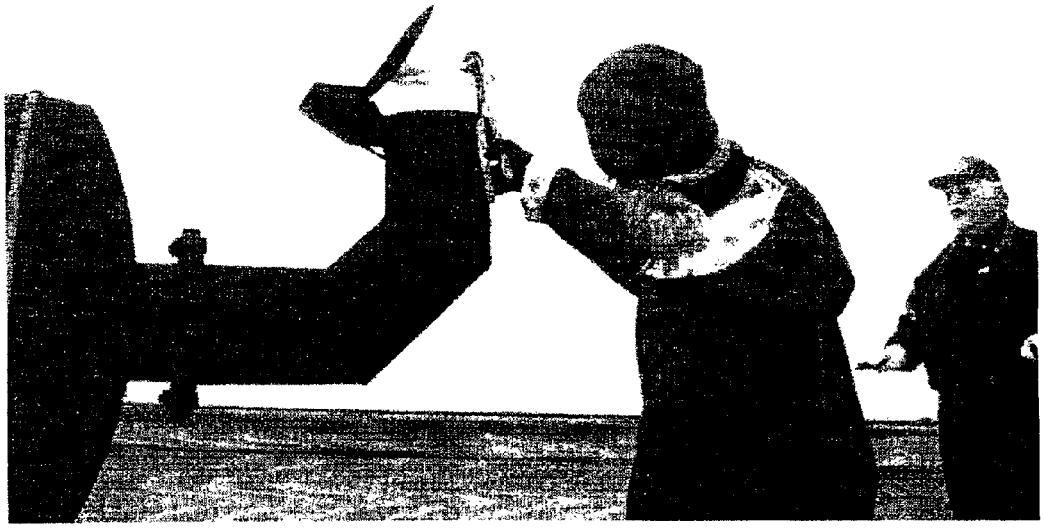
Figure 11:
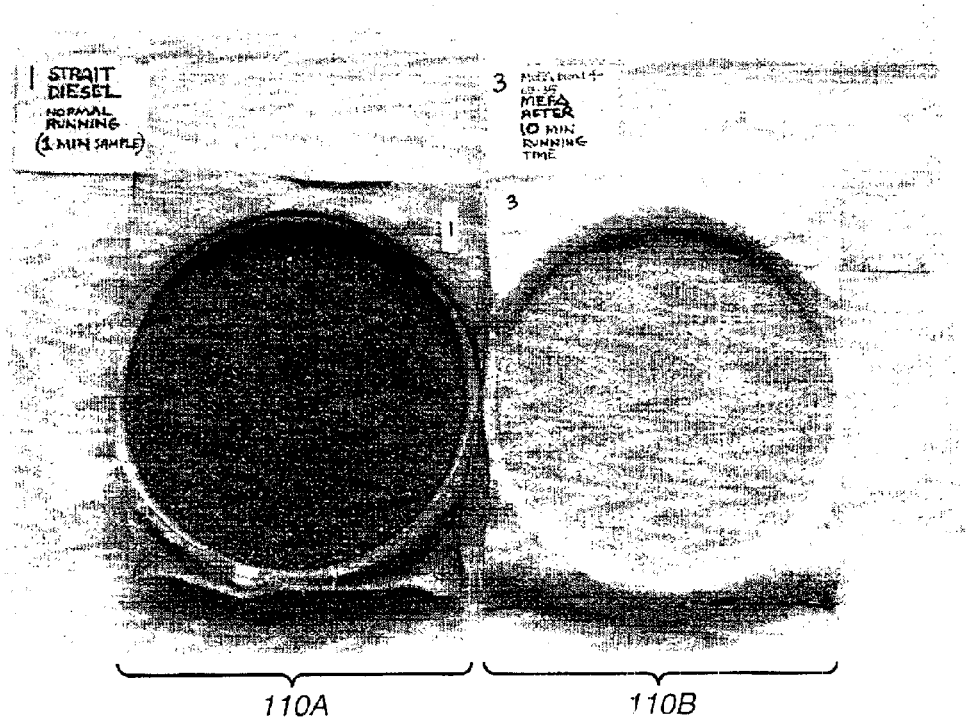
Figure 12:
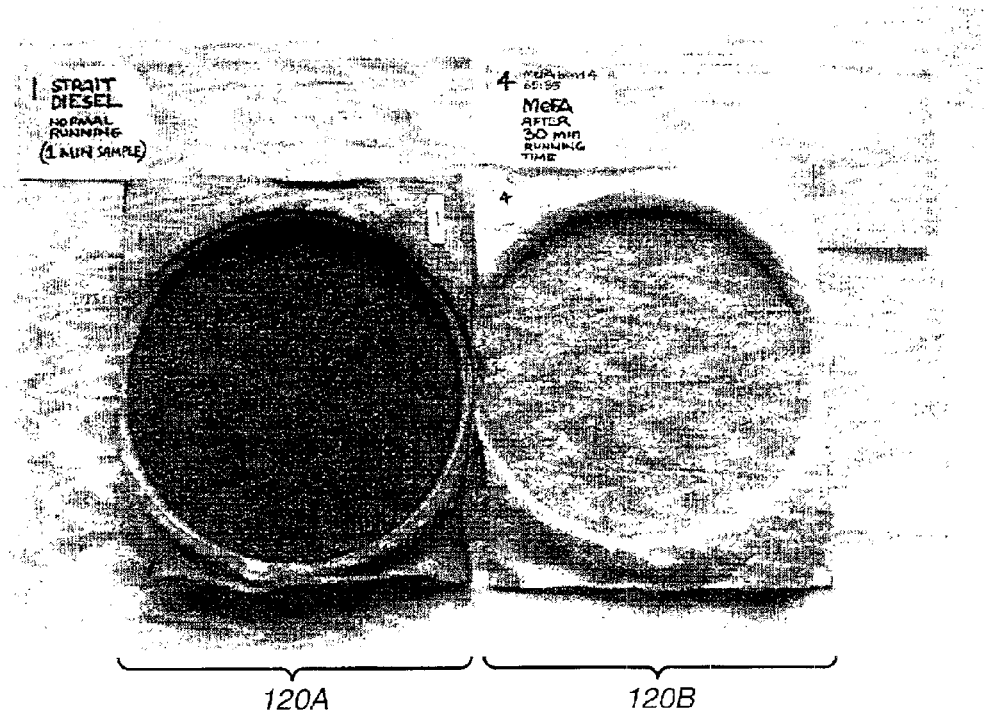
Figure 13:
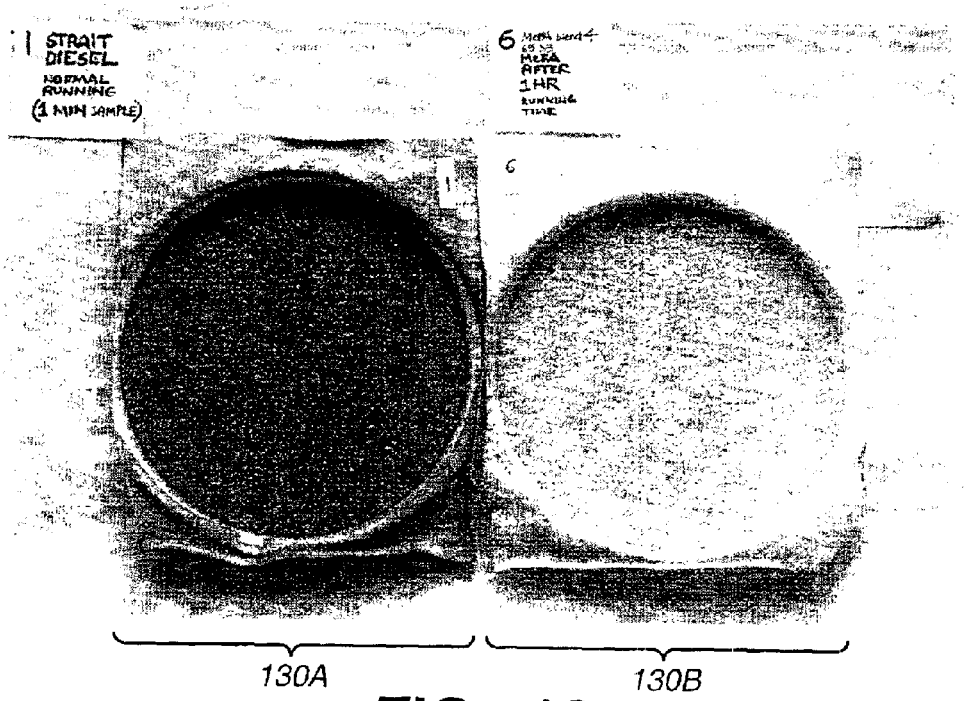
Figure 14:
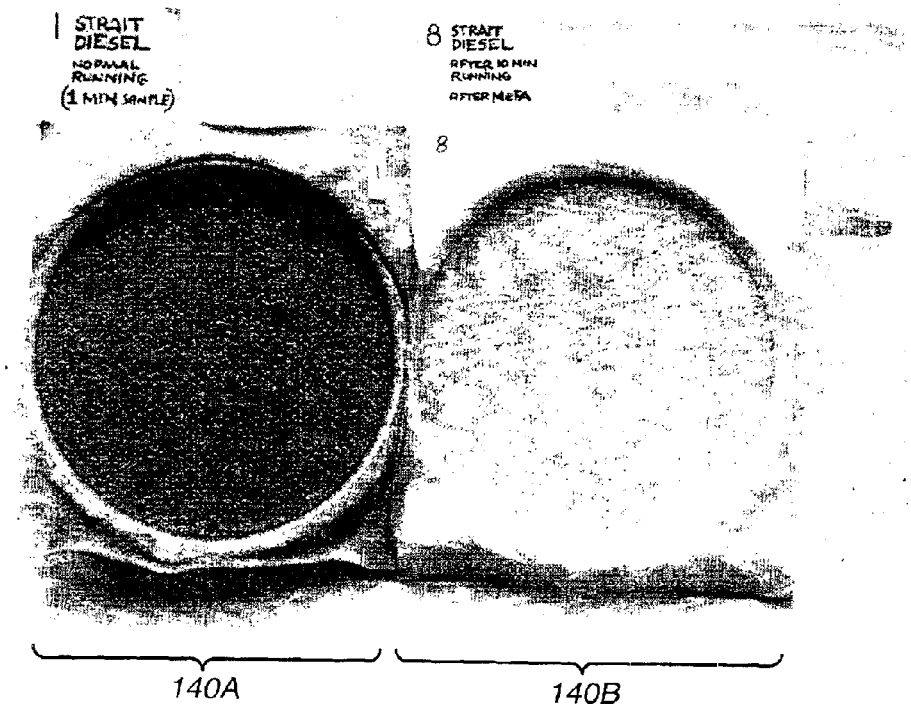
Figure 15:
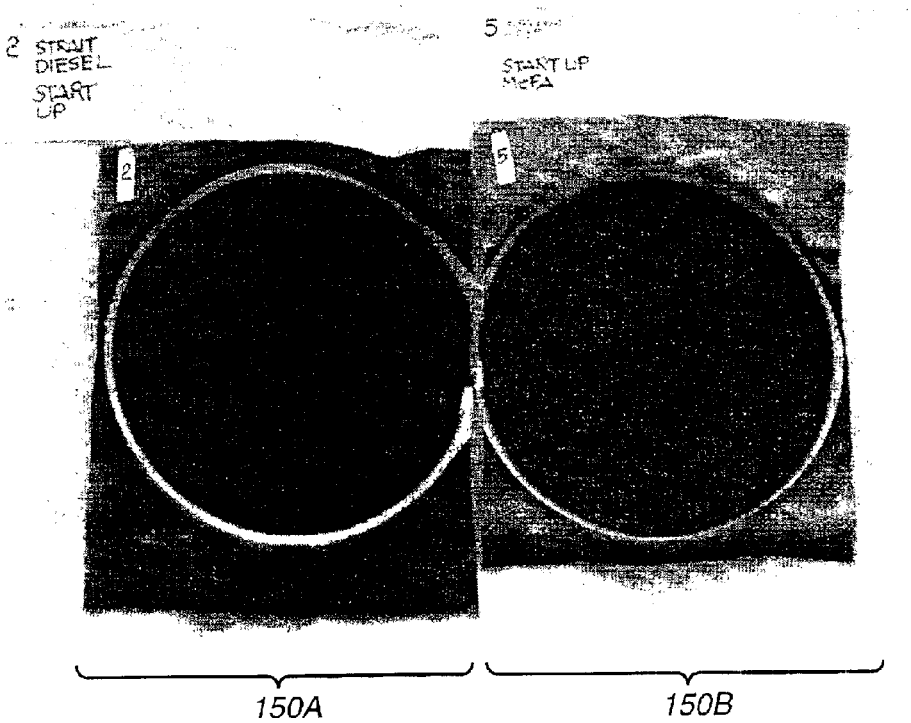
Figure 16:
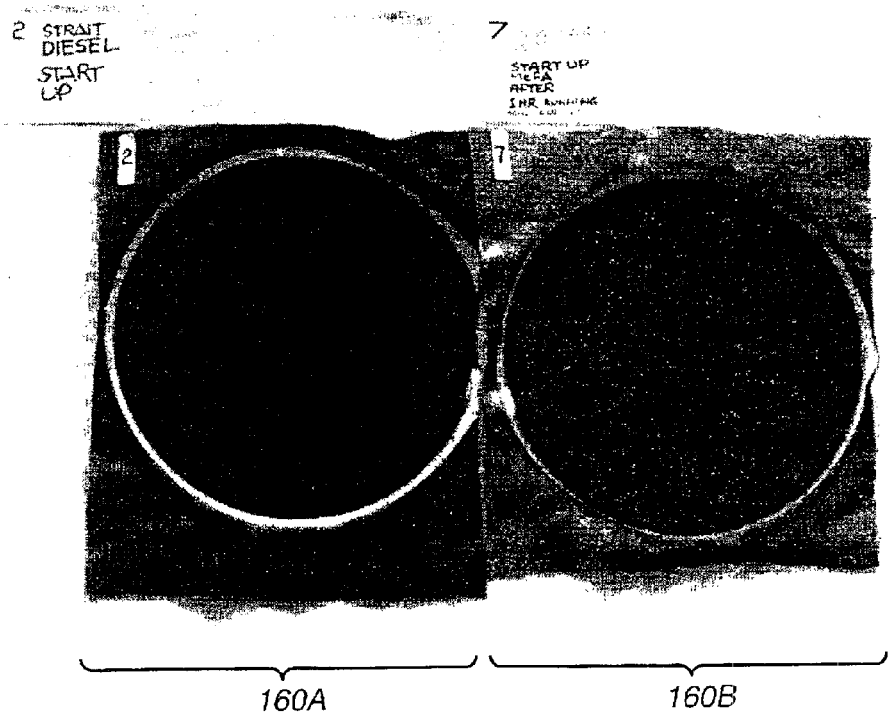
Figure 17:
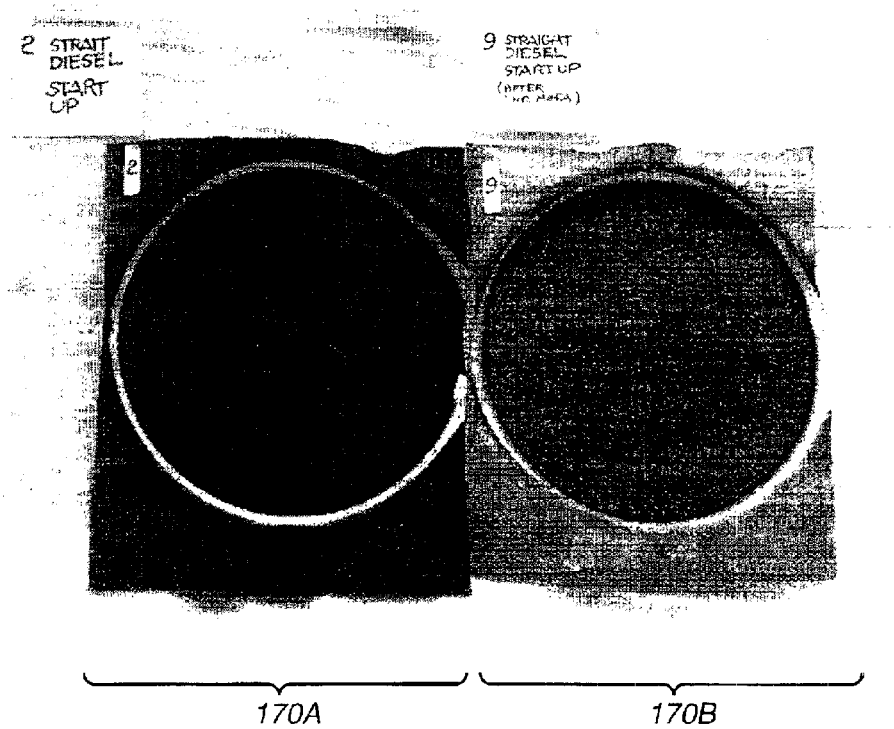
Figure 18:
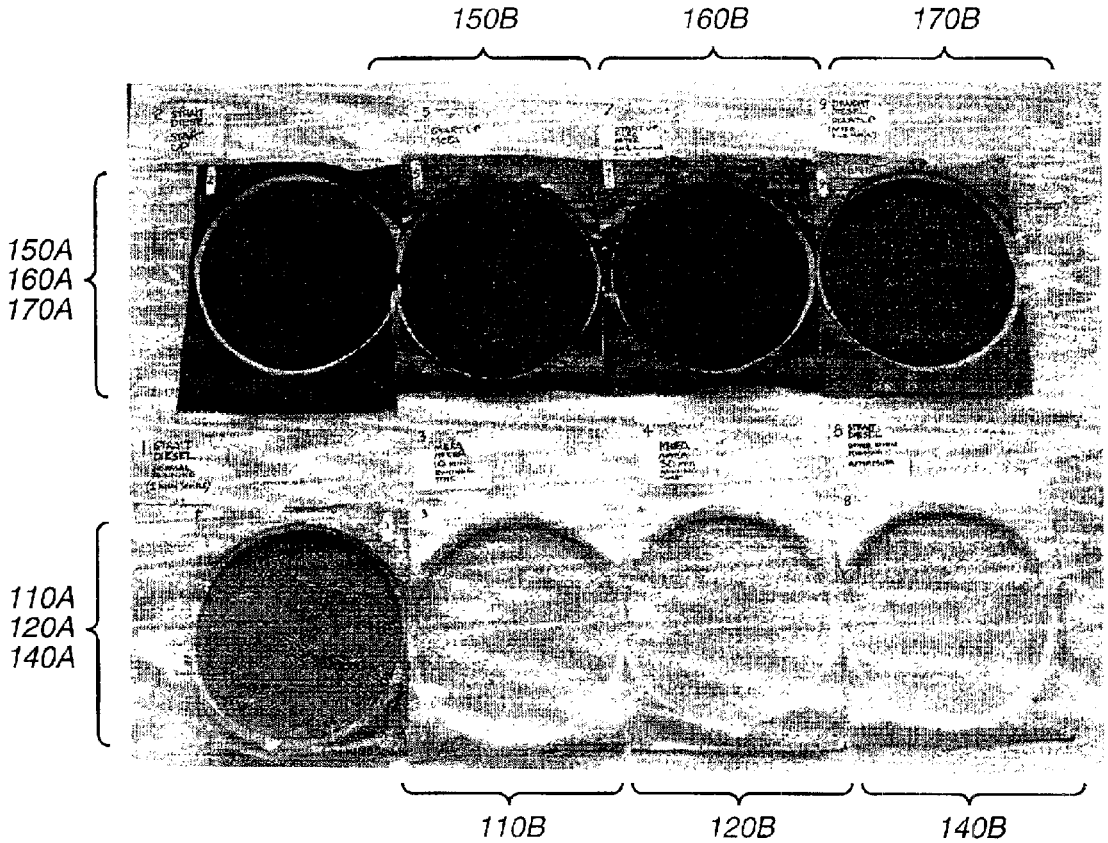

FIG. 6 shows no visible smoke from the far right smoke stack where the fuel additive blend has been running for approximately 15 minutes. Engine associated with the left smoke stack is not running and far left smoke wisp above the far left dome is from an engine using straight Diesel fuel.

EXAMPLE 2

Combustion Tests with Additive Composition 1-Minute Filter Sample Collection of Particulate Emissions a) A confidential test experiment was performed at the Stockton East Water District, Stockton, Calif.

The engine was a 360 hp V8 Caterpillar diesel engine (one of four pumping engines at the site).

The additive formulation, was by parts, by volume:

30 parts linoleic acid 10 parts octanol 28 parts methanol 15 parts water 4.1 parts aqueous ammonia The blend ratio was Diesel fuel:additive of 65:35 by volume.

The white cloth-like material used as the filter to collect particulates is a white felt "Classic felt" approximately 8–½" wide×11" long, available from Foss Manufacturing Co., Retail Division, and is also available from Mendel's Far-Out Fabrics, 1556 Haight Street, San Francisco, Calif. 94117.

The properties are as follows:

FELT PROPERTY TABLE

| PROPERTY | SPECIFICATION | TEST | METHOD |
|---|---|---|---|
| Fiber | Polyester and/or Acrylic | | |
| Width | As requested +/.5" | ASTM | D461 |
| Weight | 5.0 +/− .5 OZ/YD2 | FTM N | W503 |
| Thickness | .080" +/− .010" | ASTM | D1777 |
| Tensile Warp | 75 LBS minimum | FTM N | W505 |
| @ 10 lb Fill | 85 LBS minimum | | |
| Elongation Warp | 25% AVG. | FTM N | W506 |
| @ 10 lb Fill | 40% AVG. | | |
| Appearance | To Match Approved Standard | Visual | |
| Color | To Match Approved Standard | Visual | |
| Critical | Appearance, Weight and Gauge | | |

The filters were stretched across generally available wooden embroidery hoops approximately 7" in diameter.

These filters are intended as a visual aid to demonstrate smoke and particulate reduction. They are not intended to be used for quantitative (weighed) studies. They provide qualitative comparisons between diesel fuel emissions and emissions from the additive fuel composition.

Forty gallons of the subject additive blend in a 55 gallon drum were lifted by forklift to the level of the far right engine and the fuel pump/line was secured to the fuel drum. The engine was started with fuel/additive blend as its only fuel supply. No changes were made to the engine other than switching the fuel supply.

The muffler and exhaust pipe for the engine in FIG. 1 are located on the roof of the building which houses the water pumping engines. Each filter sample was held approximately 5–7 inches above the exhaust pipe with a pair of standard long-handled pliers available in a hardware store. All sample collection tests lasted exactly one minute (60 seconds).

With reference to FIGS. 7–10 and 11–18, the experimental results are described.

FIGS. 7–10 show the procedure used for collecting filter samples.

FIGS. 11–18 show the emission-reduction results.

(b) Similarly Example 2(a) is repeated except that the additive composition and amounts are replaced to be the additive composition as follows:

| | |
|---|---|
| fatty acid (linoleic acid) | 44 parts by volume; |
| water-insoluble alcohol (octanol) | 22 parts by volume; |
| water-soluble alcohol (methanol) | 18 parts by volume; |
| water | 6 parts by volume; |
| aqueous ammonia (28%) | 6 parts by volume; |

where the fuel additive ratio is about 95:5 to 85:15 and the result of combustion of the resulting fuel/additive composition is improved combustion, reduced carbon buildup inside the engine and reduced smoke, particulates, and noxious gases.

(c) Similarly Example 2(a) is repeated except that the additive composition and amounts are replaced to be the additive composition as follows:

| | |
|---|---|
| fatty acid (linoleic acid) | 36 parts by volume; |
| water-insoluble alcohol (octanol) | 18 parts by volume; |
| water-soluble alcohol (methanol) | 24 parts by volume; |
| water | 12 parts by volume; |
| aqueous ammonia | 5.5 parts by volume; |

where the fuel additive ratio is about 90:10 to 75:25 and the result of combustion of the resulting fuel/additive composition is improved combustion) reduced carbon buildup inside the engine and further reduced smoke, particulates, and noxious gases compared to compositions having a lower additive proportion.

(d) Similarly Example 2(a) is repeated except that the additive composition and amounts are replaced to be the additive composition as follows:

| | |
|---|---|
| fatty acid (linoleic acid) | 32 parts by volume; |
| water-insoluble alcohol (octanol) | 16 parts by volume; |
| water-soluble alcohol (methanol) | 28 parts by volume; |
| water | 15 parts by volume; |
| aqueous ammonia (28%) | 4.9 parts by volume; |

where the fuel additive ratio is about 80:20 to 65:35 and the result of combustion of the resulting fuel/additive composition is improved combustion, reduced carbon buildup inside the engine and reduced noxious gases and remarkably reduced smoke and particulate emissions) where the results are essentially the same as represented in FIGS. 11–18.

(e) Similarly Example 2(a) is repeated except that the additive composition and amounts are replaced to be the additive composition as follows:

| | |
|---|---|
| fatty acid (linoleic acid) | 26 parts by volume; |
| water-insoluble alcohol (octanol) | 12 parts by volume; |
| water-soluble alcohol (methanol) | 28 parts by volume; |
| water | 15 parts by volume; |
| aqueous ammonia (28%) | 4.4 parts by volume; |

where the fuel additive-ratio is about 65:35 to 50:50 and the result of combustion of the resulting fuel/additive composition is improved combustion, reduced carbon buildup inside the engine and reduced noxious gases and remarkably reduced smoke and particulate emissions) where the results are essentially the same as represented in FIGS. 11–18.

(f) Similarly Example 2(a) is repeated except that the additive composition and amounts are replaced to be the additive composition as follows:

| | |
|---|---|
| fatty acid (oleic acid) | 40 parts by volume; |
| water-insoluble alcohol (octanol) | 20 parts by volume; |
| water-soluble alcohol (methanol) | 16 parts by volume; |
| water | 4 parts by volume; and |
| aqueous ammonia (28%) | 4 parts by volume, |

where the fuel additive ratio is about 95:5 to 85:15 and the result of combustion of the resulting fuel/additive composition is improved combustion, reduced carbon buildup inside the engine and reduced smoke, particulates, and noxious gases.

(g) Similarly Example 2(a) is repeated except that the additive composition and amounts are replaced to be the additive composition as follows:

| | |
|---|---|
| fatty acid (oleic acid) | 34 parts by volume; |
| water-insoluble alcohol (octanol) | 16 parts by volume; |
| water-soluble alcohol (methanol) | 20 parts by volume; |
| water | 9 parts by volume; |
| aqueous ammonia(28%) | 4.6 parts by volume, |

where the fuel additive ratio is about 90:10 to 75:25 and the result of combustion of the resulting fuel/additive composition is improved combustion, reduced carbon buildup inside the engine and further reduced smoke, particulates, and noxious gases compared to compositions having a lower additive proportion.

(h) Similarly Example 2(a) is repeated except that the additive composition and amounts are replaced to be the additive composition as follows:

| | |
|---|---|
| fatty acid (oleic acid) | 28 parts by volume; |
| water-insoluble alcohol (octanol) | 10 parts by volume; |
| water-soluble alcohol (methanol) | 24 parts by volume; |
| water | 10 parts by volume; |
| aqueous ammonia (28%) | 3.8 parts by volume, |

where the fuel additive ratio is about 80:20 to 65:35 and the result of combustion of the resulting fuel/additive composition is improved combustion, reduced carbon buildup inside the engine and reduced noxious gases and remarkably reduced smoke and particulate emissions where the results are essentially the same as represented in FIGS. 11–18.

(i) Similarly Example 2(a) is repeated except that the additive composition and amounts are replaced to be the additive composition as follows:

| | |
|---|---|
| fatty acid (oleic acid) | 24 parts by volume; |
| water-insoluble alcohol (octanol) | 8 parts by volume; |
| water-soluble alcohol (methanol) | 24 parts by volume; |
| water | 10 parts by volume; and |
| aqueous ammonia (28%) | 3.8 parts by volume, |

where the fuel additive ratio is about 65:35 to 50:50 and the result of combustion of the resulting fuel/additive composition is improved combustion, reduced carbon buildup inside the engine and reduced noxious gases and remarkably reduced smoke and particulate emissions where the results are essentially the same as represented in FIGS. 11–18.

EXAMPLE 3

Combustion Tests with Additive Composition (US Environmental Protection Agency Federal Test Procedure for Stationary Sources)

a) A confidential test experiment was performed at the Stockton East Water District, Stockton, Calif.

An independent emissions testing company, Normandeau Associates of Berkeley, Calif. performed all emissions tests according to US Environmental Protection agency Federal Test Procedure for stationary sources. Additional particulate measurements were taken to meet California Air Resource Board specifications.

The additive formulation for both test procedures was by parts, by volume:

32 parts linoleic acid 12 parts octanol 28 parts methanol 16 parts water 4.4 parts aqueous ammonia.

The engines were two Caterpillar V8 4-Stroke-Cycle Diesel engines (two of the four pumping engines at the site), number Engine #P27 and Engine #P28. Data for engine type and condition at time of testing are as follows:

| | |
|---|---|
| #P273 Model: | L2-2 |
| Rated Horsepower: | 319 |
| Rated RPM: | 1200 |
| Total use hours: | 38,761.1 |
| OEM recommended use hours before engine overhaul: | 8,000.0 |
| Use hours since last overhaul: | 10,304.4 |
| #P28: Model: | L2-2 |
| Rated Horsepower: | 319 |
| Rated RPM: | 1200 |
| Total use hours: | 31,001.0 |
| OEM recommended use hours before engine overhaul: | 8,000.0 |
| Use hours since last overhaul: | 2,192.3 |

The test procedure observed was as follows:

At 10:30 a.m. on Day One of testing, Engine #P27 was stabilized at approximately 293 hp and exactly 1080 rpm while running on CA #2 Diesel fuel. Three full emissions tests were run over the following consecutive four hours. See attached results in Table J as Column AA.

At 9:00 p.m. on Day One of testing, the fuel source for engine #P27 was switched to the above diesel: additive fuel blend. The engine ran from this fuel composition continuously until the end of testing on the following day.

At 10:00 a.m. on Day Two of testing engine #P27 was stabilized at approximately 293 hp and exactly 1078 rpm while running on the above mentioned diesel:additive fuel blend. Three full emissions tests were run over the following consecutive four hours. See attached results in Table J as Column BB.

At 10.30 a.m. on Day Three of testing, Engine #P28 was stabilized at approximately 319 hp and exactly 1200 rpm while running on CA #2 Diesel fuel. Three full emissions tests were run over the following consecutive four hours in Table J as Column CC.

At 3.00 am. on Day Four of testing, the fuel source for engine #P28 was switched to the above diesel: additive fuel blend. The engine ran from this fuel composition continuously until the end of testing on the following day.

At 10:00 a.m. on Day Four of testing engine #P28 was stabilized at approximately 313 hp and exactly 1177 rpm while running on the above mentioned diesel:additive fuel blend. Three fill emissions tests were run over the following consecutive four hours. See attached results in Table J as Column DD.

No mechanical changes were made to the engines during testing other than switching fuel source.

TABLE J

| | SUMMARY OF RESULTS | | | |
|---|---|---|---|---|
| Test Parameters | AA Engine P-27 Diesel Baseline | BB Engine P-27 66/35 Mix | CC Engine P-28 Diesel Baseline | DD Engine P-28 66/35 Mix |
| Gas Temperature, F. | 587 | 543 | 510 | 486 |
| RPM | 1,080 | 1,078 | 1,200 | 1177 |
| Average Flow Rate, dscfm | 409 | 398 | 836 | 767 |
| Moisture, % | 9.8 | 11.3 | 6.9 | 8.2 |
| Oxygen, dry % | 6.1 | 6.1 | 11.8 | 12.8 |
| Carbon dioxide, dry % | 10.6 | 10.4 | 6.8 | 6.2 |
| PARTICULATE MATTER (filters only) | | | | |
| Concentration, gr/dscf | 0.028 | 0.015 | 0.023 | 0.008 |
| Emission Rate, lbs/hr | 0.099 | 0.052 | 0.164 | 0.055 |
| PARTICULATE MATTER (CARB) | | | | |
| Concentradon gr/dscf | 0.056 | 0.037 | 0.041 | 0.021 |
| Emission Rate, lbs/hr | 0.197 | 0.126 | 0.294 | 0.139 |
| OXIDES OF NITROGEN | | | | |
| Concentration, ppmv | 1208 | 1194 | 861 | 839 |
| Emission Rate, lbs/hr as NO2 | 3.54 | 3.41 | 5.16 | 4.61 |
| Concentration, Corrected to 15% O2 | 483 | 477 | 560 | 563 |
| CARBON MONOXIDE | | | | |
| Concentration, ppmv | 1097 | 619 | 168 | 81 |
| Emission Rate, lbs/hr | 1.96 | 1.07 | 0.61 | 0.27 |
| Concentration, Corrected to 15% O2 | 438 | 248 | 109 | 54 |
| NON-METHANE HYDROCARBONS | | | | |
| Concentration, ppmv as O1 | 5.3 | 10.1 | 8.5 | 9.9 |
| Emission Rate, lbs/hr | 0.004 | 0.007 | 0.013 | 0.014 |
| Concentration, Corrected to 15% O2 | 2.1 | 4.0 | 5.5 | 6.6 |

Equations: Emission Rate, lb/hr = [Conc. ppm] × [Mol Wt] × [Flow Rate, dscfm] × 1.557E−7 Concentration, Corrected to 15% O2 = [Conc. ppm] × [5.95 / (20.95−O2 pct)]

These results represent the following significant toxic emissions improvements provided by the diesel:additive fuel composition compared to use of CA #2 Diesel fuel:

| | Engine *P27 | Engine *P28 |
|---|---|---|
| Particulates: | | |
| gr/dscf | 46% reduction | 65% reduction |
| lbs/hr | 47% reduction | 66% reduction |
| Particulates (CARB): | | |
| gr/dscf | 33.9% reduction | 48.8% reduction |
| lbs/hr | 36% reduction | 47% reduction |
| Oxides of Nitrogen: | | |
| ppm | 1.2% reduction | 2.6% reduction |
| lbs/hr | 3.7% reduction | 11.7% reduction |
| Carbon Monoxide: | | |
| ppm | 44.6% reduction | 51.8% reduction |
| lbs/hr | 45.5% reduction | 55.8% reduction |

Non-Methane Hydrocarbon emissions were negligible for both Diesel fuel and the disel:additive composition.

Fuel flow in engine #P27 increased from approximately 11 gal/hr to approximately 12 gal/hr, or an increase of 9%.

Fuel flow in engine #P28 increased from approximately 14 gal/hr to approximately 15 gal/hr, or an increase of 7%.

When allowance for variations in emissions flow rate, engine power, and fuel flow rate are evaluated, a slight timing change may be recommended for improved power.

EXAMPLE 4 a) A confidential test experiment was performed at California Truck Testing Services (CaTTS), a division of Clean Air Vehicle Technology Center (CAVTC), in Hayward, Calif.

CaTTS is located at the Chevron Research and Development Center in Richmond, Calif. CaTTS test cell can accommodate vehicles as song as 65 feet. The centerpiece of the cell is a Froude-Consine direct-current electric chassis dynamometer, which consists of two 48-inch roll sets (with a distance from center to center of 53 inches).

The dynamometer tests both single-and tandem-axle vehicles with gross vehicle weight rallos of up to 85,000 pounds at a speed as high as 75 mph. The maximum power absorption at the roll is 500 horsepower. The dynamometer can simulate a wide variety of transient cycles.

The particulate emissions analysis system is a heated primary dilution tunnel, and a secondary tunnel for sample conditioning and particaulate measurements.

The test vehicle was a 1984 MACK (Model WS767LT) single axle,

Tractor VIN #WS7671T41238;

Differential: Rockwell R140 4,11:1

Tires: 285R75X24.5 retreads (40" diameter)

Transmission: Fuller RT 910

Engine: 10724613 Cummins NTC, CPL #393, Pump 9217

Rated: 400 hp@2100 rpm

Fuil Pressure: 172–194 pst

Engine flow rate: 139–145 lbs/hr

Injector flow rate: 193 mm/stroke

Intake manifold pressure: 31–39" Hg

Federal Certification Level: 10.6 grams/hp-hr $NO_x$

The transient test cycle was Code of Federal Regulations (CFR) §86.146-96 from CFR Volume 40 Part 86 (7-1-97 Edition).

This test cycle was a 16-minute urban transient cycle simulating urban conditions for a heavy-duty vehicle. The exact test cycle was repeated for the following fuels:

1) Standard CA #2 Diesel Fuel

2) Fuel/Additive Composition #1

3) Fuel/Additive Composition #2

4) Fuel/Additive Composition #3

5) Fuel/Additive Composition #4

6) Standard CA #2 Diesel Fuel

The additive formulation for Fuel/Additive Composition #1 was, by parts, by volume:

| | |
|---|---|
| 30 parts linoleic acid | (Henkel Emersol 315) |
| 10 parts ethoxylated alcohol | (Union Carbide Tergitol 1553) |
| 28 parts methanol | (Gallade Chemical, industrial) |
| 15 parts water | (Standard tap water) |
| 4.1 parts aqueous ammonia | (26% BAUM A) |

The additive formulation for Fuel/Additive Composition #2 was, by parts, by volume:

| | |
|---|---|
| 36 parts linoleic acid | (Henkel Emersol 315) |
| 6 parts ethoxylated alcohol | (Union Carbide Tergitol 1553) |
| 28 parts methanol | (Gallade Chemical, industrial) |
| 15 parts water | (Standard tap water) |
| 4.1 parts aqueous ammonia | (26% BAUM A) |

The added formulation for Fuel/Additive Composition #3 was, by parts, by volume:

| | |
|---|---|
| 36 parts linoleic acid | (Henkel Emersol 315) |
| 6 parts ethoxylated alcohol | (Henkel Produce #33240) |
| 28 parts methanol | (Gallade Chemical, industrial) |
| 15 parts water | (standard tap water) |
| 4.1 parts aqueous ammonia | (26% BAUM A) |

The additive formulation for Fuel/Additive Composition #4 was, by parts, by volume:

| | |
|---|---|
| 30 parts linoleic acid | (Henkel Emersol 315) |
| 10 parts ethoxylated alcohol | (Henkel Produce #3324)) |
| 28 parts methanol | (Gallade Chemical, industrial) |
| 15 parts water | (Standard tap water) |
| 4.1 parts aqueous ammonia | (26% BAUM A) |

A test cycle was run for each fuel in the order described above. A 10-minute flushing cycle was run between each fuel sample. Clean filter samples were installed at the end of each test run. No changes were made to the truck, the engine, or the chassis dynamometer, except for the change in fuel source.

Figure 19:
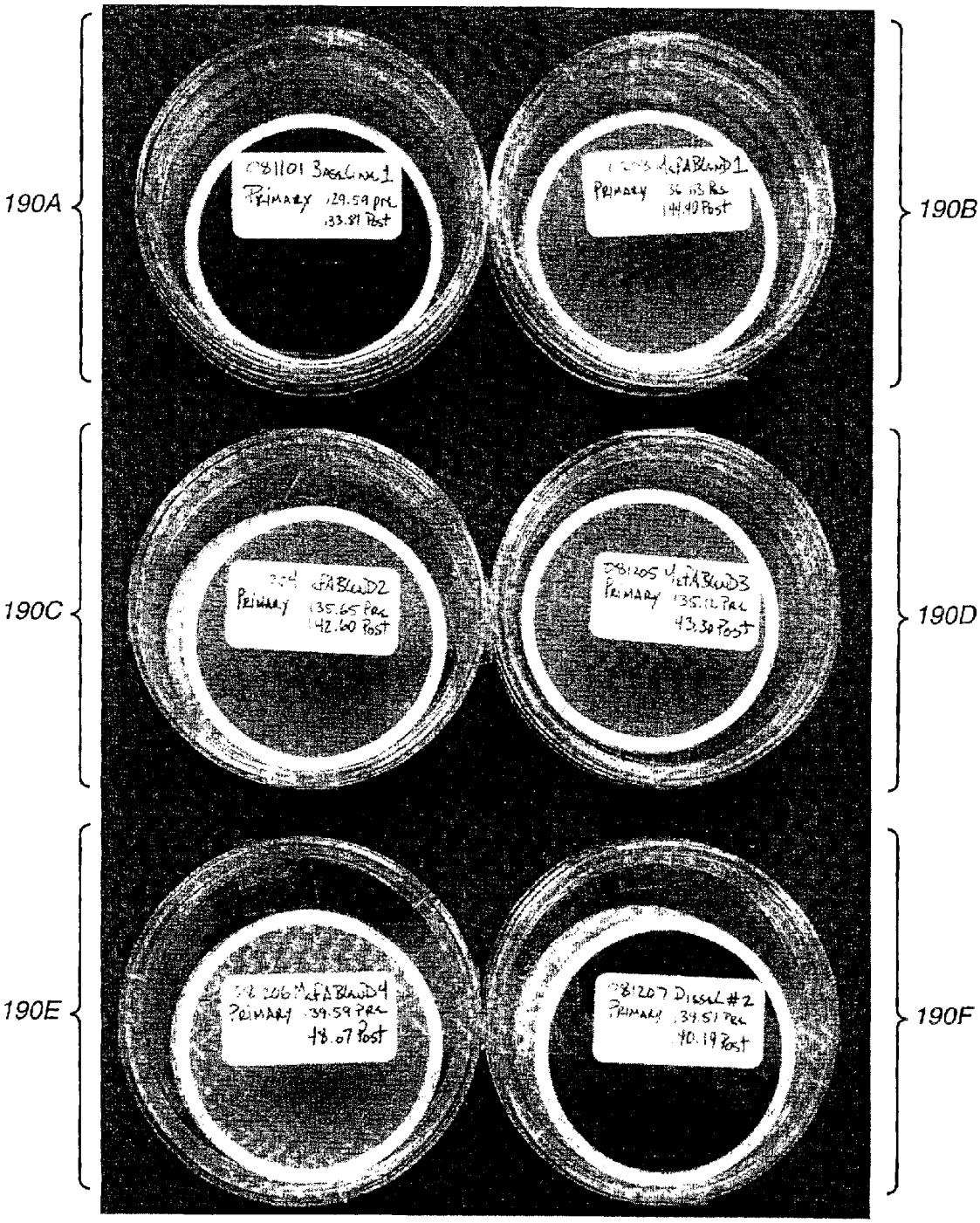

With reference to FIG. 19, experimental results are described above in the Brief Description of the Figures.

EXAMPLE 5 a) Similarly, Examples 3(a) or 4(a) are repeated except that the additive composition is replaced with the additive composition as follows:

| | |
|---|---|
| Linoleic acid:oleic acid, 50:50 | 32 parts by volume |
| any C-8-10 alcohol; | 12 parts by volume |
| ethanol denatured with methanol or iso-propanol; | 28 parts by volume |
| water; | 16 parts by volume |
| aqueous ammonia | 4.4 parts by volume |

Wherein the fuel/additive ratio is about 65:35 to 80:20 and the result of combustion of the resulting fuel additive composition compared to Diesel fuel is improved combustion, reduce carbon buildup inside the engine; reduced smoke, particulates, and noxious gases; reduced unburnt hydrocarbon emissions; where the results are essentially the same as represented in Examples 1(a), 2(a), 3(a) or 4(a).

b) Similarly, Examples 3(a) or 4(a) are repeated except that the additive composition is replaced with the additive composition as follows:

| | |
|---|---|
| Linoleic acid:oleic acid, 50:50 (v/v) | 32 parts by volume |
| any C-8-10 alcohol; | 12 parts by volume |
| ethanol denatured with methanol or iso-propanol; | 28 parts by volume |
| water; | 8 parts by volume |
| aqueous ammonia | 4.4 parts by volume |

wherein the fuel/additive ratio is about 65:35 to 80:20 (v/v) and the result of combustion of the resulting fuel additive composition compared to Diesel fuel is improved combustion, reduce carbon buildup inside the engine; reduced smoke, particulates, and noxious gases; reduced unburnt hydrocarbon emissions; and fuel efficiency is improved compared to 5(a).

c) Similarly, Examples 3(a) or 4(a) are repeated except that the additive composition is replaced with the additive composition as follows:

| | |
|---|---|
| Linoleic acid:oleic acid, 50:50 | 16 parts by volume |
| any C-8-10 alcohol; | 16 parts by volume |
| ethanol denatured with iso-propanol; | 28 parts by volume |
| water; | 4 parts by volume |
| aqueous ammonia | 2.2 parts by volume |

where the fuel/additive ratio is about 65:35 to 80:20 and the result of combustion of the resulting fuel additive composition compared to Diesel fuel is improved combustion, reduced carbon buildup inside the engine; reduced smoke, particulates, and noxious gases; reduced unburnt hydrocarbon emissions; and improved storage characteristics compared to Example 5(b) and improved fuel consumption efficiency compared to Example 5(b).

d) Similarly, Examples 3(a) or 4(a) are repeated except that the additive composition is replaced with the additive composition as follows:

| | |
|---|---|
| Linoleic acid:oleic acid, 50:50 | 16 parts by volume |
| any C-8-10 alcohol; | 16 parts by volume |
| ethanol denatured with iso-propanol; | 28 parts by volume |
| water; | 4 parts by volume |
| aqueous urea (urea/water, 72/28, v/v) | 4.4 parts by volume |

where the fuel/additive ratio is about 80:20 to 95:5 and the result of combustion of the resulting fuel additive composition compared to Diesel fuel is improved combustion, reduced carbon buildup inside the engine; reduced smoke, particulates, and noxious gases; reduced unburnt hydrocarbon emissions; and improved storage characteristics compared to Example 5(c)

e) Similarly, Examples 1(a), 2(a), 3(a) or 4(a) are repeated except that the additive composition is replaced with the additive composition as follows:

| | |
|---|---|
| Linoleic acid:oleic acid, 50:50 | 8 parts by volume |
| any C-8-10 alcohol; | 24 parts by volume |
| ethanol denatured with iso-propanol; | 28 parts by volume |
| water; | 4 parts by volume |
| aqueous ammonia | 1.1 parts by volume |

where the fuel/additive ratio is about 80:20 to 95:5 and the result of combustion of the resulting fuel additive composition compared to Diesel fuel is improved combustion, reduced carbon buildup inside the engine; reduced smoke, particulates, and noxious gases; reduced unburnt hydrocarbon emissions; and improved storage characteristics compared to Example 5(d)

f) Similarly, Examples 1(a), 2(a), 3(a) or 4(a) are repeated except that the additive composition is replaced with the additive composition as follows:

| | |
|---|---|
| ethoxylated alcohol 13S3 or 15S3 | 8 parts by volume |
| any C-8-10 alcohol; | 24 parts by volume |
| ethanol denatured with iso-propanol; | 28 parts by volume |
| water; | 4 parts by volume |

where the fuel/additive ratio is about 80:20 to 95:5 and the result of combustion of the resulting fuel additive composition compared to Diesel fuel is improved combustion, reduced carbon buildup inside the engine; reduced smoke, particulates, and noxious gases; reduced unburnt hydrocarbon emissions; and improved storage characteristics compared to Example 5(e).

g) Similarly, Examples 3(a) or 4(a) are repeated except that the additive composition is replaced with the additive composition as follows:

| | |
|---|---|
| Any C8-10 alcohol; | 28 parts by volume |
| ethanol denatured with iso-propanol; | 28 parts by volume |
| water; | 1.5 parts by volume |

where the fuel/additive ratio is about 90:10 to 95:5 and the result of combustion of the resulting fuel additive composition compared to Diesel fuel is improved combustion, reduced carbon buildup inside the engine; reduced smoke, particulates, and noxious gases; reduced unburnt hydrocarbon emissions; and improved storage characteristics compared to Example 5(e).

h) Similarly, Examples 3(a) or 4(a) are repeated except that the additive composition is replaced with the additive composition as follows:

| | |
|---|---|
| Any C8-10 alcohol; | 28 parts by volume |
| ethanol denatured with iso-propanol; | 28 parts by volume |

where the fuel/additive ratio is about 90:10 to 95:5 and the result of combustion of the resulting fuel additive composition compared to Diesel fuel is improved combustion, reduced carbon buildup inside the engine; reduced smoke, particulates, and noxious gases; reduced unburnt hydrocarbon emissions; and improved fuel storage characteristics compared to Diesel fuel and compared to Example 5(g).

EXAMPLE 6 a) Similarly, Examples 3(a) or 4(a) are repeated except that the additive composition is replaced with the additive composition as follows:

| | |
|---|---|
| iso-propanol; | 10 parts by volume |
| ethanol | 28 parts by volume |

Where the engine is a spark-ignition engine and the fuel is gasoline, and where the fuel/additive ratio is about 90:10 to 95:5, and the result of combustion of the resulting fuel additive composition compared to gasoline is improved combustion, reduced carbon buildup inside the engine; reduced smoke, particulates, and noxious gases; reduced unburnt hydrocarbon emissions.

b) Similarly, Examples 3(a) or 4(a) are repeated except that the additive composition is replaced with the additive composition as follows:

| | |
|---|---|
| any C-8-10 alcohol; | 6 parts by volume |
| ethanol denatured with iso-propanol; | 28 parts by volume |

where the engine is a spark-ignition engine and the fuel is gasoline, and where the fuel/additive ratio is about 90:10 to 95:5, and the result of combustion of the resulting fuel additive composition compared to gasoline is improved combustion, reduced carbon buildup inside the engine; reduced smoke, particulates, and noxious gases; reduced unburnt hydrocarbon emissions.

c) Similarly, Examples 3(a) or 4(a) are repeated except that the additive composition is replaced with the additive composition as follows:

| | |
|---|---|
| ethoxylated alcohol 13S2 or 15S3; | 2 parts by volume |
| ethanol denatured with iso-propanol; | 28 parts by volume |

where the engine is a spark-ignition engine and the fuel is gasoline, and where the fuel/additive ratio is about 90:10 to 95:5, and the result of combustion of the resulting fuel additive composition compared to gasoline is improved combustion, reduced carbon buildup inside the engine; reduced smoke, particulates, and noxious gases; reduced unburnt hydrocarbon emissions.

EXAMPLE 7

(a) Similarly, Examples 1(a), 2(a), 3(a) are repeated except that the additive composition and amounts are replaced to be the additive composition as follows:

| | |
|---|---|
| Fatty acid (linoleic:oleic:myristic:palmitic: stearic at ratios of 5:5:1:1:1) | 44 parts by volume; |
| water-insoluble alcohol (hexanol:octanol: decanol:oleyl:myristyl:palmityl at ratios of 2:4:4:2:1:1) | 22 parts by volume; |
| water-soluble alcohol (methanol:ethanol: propanol:butanol at ratios of 2:4:2:1) | 18 parts by volume; |
| water | 6 parts by volume; |
| aqueous ammonia (28%) | 6 parts by volume, |

where the application is industrial or home furnaces and the fuel is heating oil or kerosene, and the fuel additive ratio is about 95:5 to 85:15 and the result of combustion of the resulting fuel/additive composition is reduced smoke, particulates, and noxious gases.

(b) Similarly, Examples 1(a), 2(a), 3(a) are repeated except that the additive composition and amounts are replaced to be the additive composition as follows:

| | |
|---|---|
| Fatty acid (linoleic:oleic:myristic:palmitic: stearic at ratios of 5:5:1:1:1) | 40 parts by volume; |
| water-insoluble alcohol (hexanol:octanol: decanol:oleyl:myristyl:palmityl at ratios of 2:4:4:2:1:1) | 20 parts by volume; |
| water-soluble alcohol (methanol:ethanol: propanol:butanol at ratios of 2:4:2:1) | 16 parts by volume; |
| water | 4 parts by volume; |
| aqueous ammonia (28%) | 4 parts by volume, |

where the application is industrial or home furnaces and the fuel is heating oil or kerosene, and the fuel additive ratio is about 95:5 to 85:15 and the result of combustion of the resulting fuel/additive composition is improved combustion, reduced carbon buildup inside the furnace and further reduced smoke, particulates, and noxious gases.

(c) Similarly, Examples 1(a), 2(a), 3(a) are repeated except that the additive composition and amounts are replaced to be the additive composition as follows:

| | |
|---|---|
| Fatty acid (linoleic:oleic:myristic:palmitic: tearic at ratios of 5:5:1:1:1) | 36 parts by volume; |
| water-insoluble alcohol (hexanol:octanol: decanol:oleyl:myristyl:palmityl at ratios of 2:4:4:2:1:1) | 18 parts by volume; |
| water-soluble alcohol (methanol:ethanol: propanol:butanol at ratios of 2:4:2:1) | 24 parts by volume; |
| water | 12 parts by volume; |
| aqueous ammonia (28%) | 4.9 parts by volume, |

where the application is industrial or home furnaces and the fuel is heating oil or kerosene, and the fuel additive ratio is about 90:10 to 75:25 and the result of combustion of the resulting fuel/additive composition is improved combustion, reduced carbon buildup inside the furnace and further reduced smoke, particulates, and noxious gases compared to compositions having a lower additive proportion.

(d) Similarly, Examples 1(a), 2(a), 3(a) are repeated except that the additive composition and amounts are replaced to be the additive composition as follows:

| | |
|---|---|
| Fatty acid (linoleic:oleic:myristic:palmitic: tearic at ratios of 5:5:1:1:1) | 34 parts by volume; |
| water-insoluble alcohol (hexanol:octanol: decanol:oleyl:myristyl:palmityl at ratios of 2:4:4:2:1:1) | 16 parts by volume; |
| water-soluble alcohol (methanol:ethanol: propanol:butanol at ratios of 2:4:2:1) | 20 parts by volume; |
| water | 9 parts by volume; |
| aqueous ammonia (28%) | 4.6 parts by volume, |

where the application is industrial or home furnaces and the fuel is heating oil or kerosene, and the fuel additive ratio is about 90:10 to 75:25 and the result of combustion of the resulting fuel/additive composition is improved combustion, reduced carbon buildup inside the furnace and further reduced smoke, particulates, and noxious gases compared to compositions having a lower additive proportion.

(e) Similarly, Examples 1(a), 2(a), 3(a) are repeated except that the additive composition and amounts are replaced to be the additive composition as follows:

| | |
|---|---|
| Fatty acid (linoleic:oleic:myristic:palmitic: tearic at ratios of 5:5:1:1:1) | 32 parts by volume; |
| water-insoluble alcohol (hexanol:octanol: decanol:oleyl:myristyl:palmityl at ratios of 2:4:4:2:1:1) | 16 parts by volume; |
| water-soluble alcohol (methanol:ethanol: propanol:butanol at ratios of 2:4:2:1) | 28 parts by volume; |
| water | 15 parts by volume; |
| aqueous ammonia (28%) | 4.9 parts by volume, |

where the application is industrial or home furnaces and the fuel is heating oil or kerosene, and the fuel additive ratio is about 80:20 to 65:35 and the result of combustion of the resulting fuel/additive composition is improved combustion, reduced carbon buildup inside the engine and reduced noxious gases and remarkably reduced smoke and particulate emissions.

(f) Similarly, Examples 1(a), 2(a), 3(a) are repeated except that the additive composition and amounts are replaced to be the additive composition as follows:

| | |
|---|---|
| Fatty acid (linoleic:oleic:myristic:palmitic: tearic at ratios of 5:5:1:1:1) | 28 parts by volume; |
| water-insoluble alcohol (hexanol:octanol: decanol:oleyl:myristyl:palmityl at ratios of 2:4:4:2:1:1) | 10 parts by volume; |
| water-soluble alcohol (methanol:ethanol: propanol:butanol at ratios of 2:4:2:1) | 24 parts by volume; |
| water | 10 parts by volume; |
| aqueous ammonia (28%) | 3.8 parts by volume, |

where the application is industrial or home furnaces and the fuel is heating oil or kerosene, and the fuel additive ratio is about 80:20 to 65:35 and the result of combustion of the resulting fuel/additive composition is improved combustion, reduced carbon buildup inside the furnace and reduced noxious gases and remarkable reduced smoke and particulate emissions.

(g) Similarly, Examples 1(a), 2(a), 3(a) are repeated except that the additive composition and amounts are replaced to be the additive composition as follows:

| | |
|---|---|
| Fatty acid (linoleic:oleic:myristic:palmitic: tearic at ratios of 5:5:1:1:1) | 24 parts by volume; |
| water-insoluble alcohol (hexanol:octanol: decanol:oleyl:myristyl:palmityl at ratios of 2:4:4:2:1:1) | 8 parts by volume; |
| water-soluble alcohol (methanol:ethanol: propanol:butanol at ratios of 2:4:2:1) | 24 parts by volume; |
| water | 10 parts by volume; |
| aqueous ammonia (28%) | 4.4 parts by volume, |

where the application is industrial or home furnaces and the fuel is heating oil or kerosene, and the fuel additive ratio is about 65:35 to 50:50 and the result of combustion of the resulting fuel/additive composition is improved combustion, reduced carbon buildup inside the furnace and reduced noxious gases and remarkably reduced smoke and particulate emissions.

DIAGNOSTIC SELECTION PROCESS—In another aspect, a diagnostic process was found which makes it possible for one of skill in the art to identify quickly components and quantities of an additive which when combined with a combustible fuel produces a clear stable micro-emulsion is needed in commercial application to improve combustion.

EXAMPLE A

Diagnostic Tests with Additive Compositions a) Confidential test experiments were performed at 534 Ashbury Street, San Francisco, Calif.

The glassware used were standard glass and pyrex beaker, graduated cylinders, pipettes, erlenmeyer flasks and 4 oz. boston round bottles purchased from VWR Scientific Products in San Francisco, Calif. and from Bryant Laboratory, Inc. in Berkeley, Calif.

The beakers were of the general description PYREX brand Double Scale Griffin Beakers, graduated, 30, 50, 100 and 250 mis capacity Corning Nos. 1000–30, 1000–50, 1000–100 and 1000–250.

The graduated cylinders were of the general description Graduated Cylinders Single metric Scale White line, 10, 25, and 50 ml capacity with milliliter divisions of 0.2, 0.5, and 1.0 respectively.

The pipettes were of the general description KIMAX-51 Measuring (Mohr) Pipets, reusable, Class B, Color-Coded, SAFE-Gard tempered tip, intended for chemical laboratory work, 1 ml and 5 ml capacity.

The Erlenmeyer flasks were of the general description PYREX brand, Erlenmeyer, Narrow Mouth, Graduated Flask, 100 ml and 250 ml capacity.

The Boston round bottles were of the general description Boston Round Bottles, Narrow Mouth, Qorpak, with Polyseal-lined black phenolic caps, 120 ml (4 oz) capacity.

Chemical components used in the following experiments were generally supplied as samples by chemical companies such as Henkel Corporation, of Cincinatti, Ohio; and Union Carbide, of Chicago, Ill.; or as generally-sold products from Gallade Chemical, Inc. of Newark, Calif.; VWR Scientific of San Francisco, Calif.; and Bryant Laboratory, Inc. of Berkeley, Calif.

All laboratory equipment was used exactly as shipped from the above mentioned suppliers; and all chemical components were used exactly as shipped from the above mentioned suppliers, with no further purification or other alterations.

CA #2 Diesel fuel was purchased from standard public Diesel fuel distributors in San Francisco, from standard gas station pumps.

Where the following components were added in the following order to a 250 ml Erlenmeyer flask:

| | |
|---|---|
| 34 ml linoleic acid | (Henkel Corporation product Emersol 305) |
| 6 ml octanol | (Henkel Corporation product # 3324) |
| 28 ml methanol | (Gallade Chemical, Inc. technical grade) |

gentle swirling produced Freuhoffer lines and then a clear solution, to which was added:

| | |
|---|---|
| 14.6 ml water | (standard tap water) |

gentle swirling produced a white, milky solution, to which was added, by pipette:

| | |
|---|---|
| 4.6 ml aqueous ammonia | (Gallade Chemical, Inc. Baum A 26%) |

an immediate exothermic reaction took place, producing mild heat and immediate visual change of the solution from milky to clearing; where gentle swirling produced complete clearing of the mixture.

A 120 ml (4 oz) boston bottle was then partially filled with

| | |
|---|---|
| 80 mls diesel fuel | (CA standard #2 Diesel fuel) |

to which was added:

20 ml of the above clear fatty acid/alcohol/water/ammonia composition; gentle swirling produced a clear, microemulsion composition that remained stable over time after 6 months the microemulsion is still clear, and stable although fatty acid degradation has caused a color change from no color to light amber color).

This 100 ml microemulsion sample was then stored overnight at 20° C. in a standard home freezing unit, where freezer temperature was measured using a standard freezer thermometer such as can be purchased in a hardware store.

On immediate removal from the freezing unit, the microemulsion composition showed partial 'slushy' solidification, similar or identical to solification of 100 mis of 100% Diesel fuel stored simultaneously in the same freezing unit.

After ten minutes, the microemulsion composition and the 100% Diesel fuel thawed entirely, returning to a clear, liquid state. The microemulsion composition showed no visible signs of phase separation.

b) Similarly, Example A(a) is repeated except that the additive composition and amounts are replaced to be the additive composition as follows:

| | |
|---|---|
| 50/50 linoleic acid/oleic | 32 parts by volume |
| C8-10 alcohol; | 16 parts by volume |

-continued

| | |
|---|---|
| methanol; | 28 parts by volume |
| water; | 12 parts by volume |
| aqueous ammonia | 3.3 parts by volume |

where the fuel/additive ratio is about 65:35 to 95:5 and the result of mixing by gentle swirling produces an exothermic reaction, and a clear microemulsion composition that remains stable over time, up to 6 months or longer, and during and after storage at a temperature of −20° C., where fatty acids will show discoloration and other signs of oxidation over time.

c) Similarly, Example A(a) is repeated except that the additive composition and amounts are replaced to be the additive composition as follows:

| | |
|---|---|
| 50/50 linoleic acid/oleic | 24 parts by volume |
| C8-10 alcohol; | 16 parts by volume |
| methanol; | 28 parts by volume |
| water; | 8 parts by volume |
| aqueous ammonia | 3.3 parts by volume |

where the fuel/additive ratio is about 65:35 to 95:5 and the result of mixing by gentle swirling produces an exothermic reaction, and a clear microemulsion composition that remains stable over time, up to 6 months or longer, and during and after storage at a temperature of −20° C., where the fuel/additive composition will show discoloration or other signs of oxidation from fatty acids over time compared to Examples A(a) and A(b).

d) Similarly, Example A(a) is repeated except that the additive composition and amounts are replaced to be the additive composition as follows:

| | |
|---|---|
| 50/50 linoleic acid/oleic | 16 parts by volume |
| C8-10 alcohol; | 16 parts by volume |
| ethanol denatured with methanol; | 28 parts by volume |
| water; | 4 parts by volume |
| aqueous ammonia | 2.2 parts by volume |

where the fuel/additive ratio is about 65:35 to 95:5 and the result of mixing by gentle swirling produces an exothermic reaction, and a clear microemulsion composition that remains stable over time, up to 6 months or longer, and during and after storage at a temperature of −20° C., where the fuel/additive composition will show significantly less discoloration or other signs of oxidation from fatty acids over time compared to Examples A(a), A(b) and A(c).

e) Similarly, Example A(a) is repeated except that the additive composition and amounts are replaced to be the additive composition as follows:

| | |
|---|---|
| 50/50 linoleic acid/oleic | 16 parts by volume |
| C8-10 alcohol; | 16 parts by volume |
| ethanol denatured with methanol; | 28 parts by volume |
| water; | 4 parts by volume |
| aqueous urea | 4.4 parts by volume |

where the fuel/additive ratio is about 65:35 to 95:5 and the result of mixing by gentle swirling produces an exothermic reaction, and a clear microemulsion composition that remains stable over time, up to 6 months or longer, and during and after storage at a temperature of −20° C., and the nitrogen content of the fuel/additive composition is increased compared to Example A(d).

f) Similarly, Example A(a) is repeated except that the additive composition and amounts are replaced to be the additive composition as follows:

| | |
|---|---|
| 50/50 linoleic acid/oleic | 8 parts by volume |
| ethoxylated alcohols 13S3 or 15S3 | 8 parts by volume |
| C8-10 alcohol; | 16 parts by volume |
| ethanol denatured with methanol; | 28 parts by volume |
| water; | 4 parts by volume |
| aqueous ammonia | 2.2 parts by volume |

where the fuel/additive ratio is about 65:35 to 95:5 and the result of mixing by gentle swirling produces an exothermic reaction, and a clear microemulsion composition that remains stable over time, up to 6 months or longer, and during and after storage at a temperature of −20° C., where fuel/additive composition will show further reduction of discoloration and other signs of oxidation from fatty acids over time compared to Examples A(a), A(b), A(c), A(e) and A(d).

g) Similarly, Example A(a) is repeated except that the additive composition and amounts are replaced to be the additive composition as follows:

| | |
|---|---|
| ethoxylated alcohols 13S3 or 15S3 | 16 parts by volume |
| C8-10 alcohol; | 16 parts by volume |
| ethanol denatured with methanol; | 28 parts by volume |
| water; | 4 parts by volume |

where the fuel/additive ratio is about 65:35 to 95:5 and the result of mixing by gentle swirling produces a clear microemulsion composition (with no discernable exothermic reaction) that remains stable over time, up to 6 months or longer, and during and after storage at a temperature of −20° C., where no discoloration or other signs of oxidation occur over time.

h) Similarly, Example A(a) is repeated except that the additive composition and amounts are replaced to be the additive composition as follows:

| | |
|---|---|
| C8–10 alcohol; | 32 parts by volume |
| ethanol denatured with iso-propanol; | 28 parts by volume |
| water; | 2 parts by volume |

where the fuel/additive ratio is about 65:35 to 95:5 and the result of mixing by gentle swirling produces a clear microemulsion composition (with no discernable exothermic reaction) that remains stable over time, up to 6 months or longer, and during and after storage at a temperature of −20° C., where no discoloration or other signs of oxidation occur over time and no ethylene oxides are present in the fuel/additive.

i) Similarly, Example A(a) is repeated except that the additive composition and amounts are replaced to be the additive composition as follows:

| | |
|---|---|
| C8–10 alcohol; | 24 parts by volume |
| anhydrous ethanol denatured with iso-propanol; | 28 parts by volume |

where the fuel/additive ratio is about 65:35 to 95:5 and the result of mixing by gentle swirling produces a clear microemulsion composition (with no discernable exothermic reaction) that remains stable over time, up to 6 months or longer, and during and after storage at a temperature of −20° C., where no discoloration or other signs of oxidation occur over time and no ethylene oxides are present in the fuel/additive.

EXAMPLE B

Determining Surface Activity Strength of Various Water-Insoluble Alcohols

Experiments #1,2,3, & 4 all begin with 32 mls anhydrous ethanol to which is added 32 mls of the following alcohols:

| | | |
|---|---|---|
| # 1 | 98% pure C8 alcohol | (straight chain) |
| # 2 | combination C8 and C10 alcohols | (straight chain) |
| # 3 | combination C6 through 12 alcohols | (straight chain) |
| # 4 | 2-ethyl-hexanol-1 | (branched chain) |

Alcohols 1,2,3 and 4 mixed readily with ethanol, but for all of them, mixing is not considered complete until Freuhoffer lines disappear. This happens with very gentle swirling of the beaker or stirring.

80 mls of CA #2 Diesel fuel was then poured into four separate clean beakers and 20 mls of each of the above ethanol/water-insoluble alcohol combinations were added, one mixture to each beaker.

#1 C8 alcohol was hazy at first, but after gentle "sloshing" or swirling, the mixture was perfectly clear.

Hundreds of previous experiments have proven that once the mixture has gone clear, it is stable and will remain stable at temperatures of −20° C. or lower.

Therefore, 98% pure, straight-chain C8 alcohol, can be used by itself as the only necessary surfactant when introducing anhydrous ethanol into Diesel fuel.

#2 The C8-10 alcohol combination was hazy at first, but cleared almost immediately with the slightest agitation. There was a quality of instantaneous clearing that the C8 alcohols lacked, but was quite evident in this experiment.

Previous experiments have shown that this instant clearing quality indicates superior surface activity. This superior performance manifests not so much in a 'more stable solution' (once the solution is clear, it is stable), but that the superior solution will tolerate components that are more hydrophilic than anhydrous ethanol (i.e. methanol, water) and still remain stable.

Therefore, the combination straight-chain C8-10 can be used by itself as the only necessary surfactant when introducing anhydrous ethanol into Diesel fuel and is a superior surfactant to 98% pure C8 alcohol.

#3 The C6-12 alcohol combination was completely hazy at first, meaning that there was an opaque quality to the solution rather than a more pearly quality evident in the previous two experiments.

This opaque quality usually signifies that there is 'a long way to go' before the surface activity is strong enough to produce a clear solution. Swirling, sloshing, shaking did nothing to promote clearing.

Previous experiments have shown that if a solution does not clear, it will eventually show phase separation, sometimes slowly at room temperature, but very quickly at lower temperatures.

Therefore, the combination straight-chain C6-12 alcohol cannot be used by itself as the only necessary surfactant when introducing anhydrous ethanol into Diesel fuel. By inference, it is also true that C6-12 alcohols will not tolerate components that are more hydrophilic than anhydrous ethanol.

#4 The branched chain 2-ethyl-1-hexanol solution was hazy at first, but possessed the pearly quality observed in experiments 1 and 2. Swirling did not produce immediate clearing, but over time (4 minutes) the solution cleared on its own with no further agitation. Swirling produced a slightly hazy quality again, but standing for one more minute, the solution became perfectly clear and remained clear.

Previous experiments have shown that this 'delay' quality indicates relatively weak surface activity compared to components that produce immediately clear results. This inferior performance manifests not so much in a 'less stable solution' (once the solution is clear, it is stable), but that the inferior solution will not tolerate components that are more hydrophilic than anhydrous ethanol, but will benefit from higher concentrations of the surface active component.

Therefore, the branched chain 2-ethyl-hexanol-1 can be used by itself as the only necessary surfactant when introducing anhydrous ethanol into Diesel fuel, but is not as strong a surfactant as either the C8 alcohol or the C8-10 alcohols combination.

REDUCE OCTANOL SERIES USING C8, C8–10, C6–12 and 2EH-1

| #1 | #2 | #3 | #4 |
|---|---|---|---|
| 37. Ethanol<br>32. Henkel 3324<br>C8 Alcohol | 32. Ethanol<br>32. Henkel 3328<br>C8–10 Alcohol | 32. Ethanol<br>32. Henkel 3393<br>C6–12 Alcohol | 32. Ethanol<br>32. Baker<br>2EH1 |
| 80 ml Diesel<br>20 ml #1<br>Hazy at first<br>__Shaking | 80 ml Diesel<br>20 ml #2<br>Hazy at first<br>__Clearing | 80 ml Diesel<br>20 ml #3<br>Completely hazy<br>Sloshing, Shaking | 80 ml Diesel<br>20 ml #4<br>Hazy<br>But almost |
| Perfectly clear | Almost immediately | No change | Clearing |
| — | Gentle slosh | Stays hazy | Perfectly |
| — | Instant Clear | — | Over time |
| — | — | — | (4 min) |
| — | — | 5 minutes | CLEAR! |
| — | — | Enter Pearly | SLIGHTLY PERSISTENT |

NEXT SERIES: Beakers have the following amounts remaining in them:

| #1A | #2A | #3A | #4A |
|---|---|---|---|
| 22. Ethanol<br>22. Henkel 3324<br>C8 Alcohol | 22. Ethanol<br>22. Henkel 3328<br>C8–10 Alcohol | 22. Ethanol<br>22. Henkel 3393<br>C6–12 Alcohol | 22. Ethanol<br>22. Baker<br>2EH1 |
| Add 7 ethanol | Add 7 ethanol | Add 7 of C6–12 alcohol | Add 7 ml 2EH1 |
| 80 ml Diesel<br>20 ml #1A<br>Hazy, period | 80 ml Diesel<br>20 ml #2A<br>Hazy, period | 80 ml Diesel<br>20 ml #3A<br>Hazy | 80 mi Diesel<br>20 ml #4A<br>Clear immediately |

EXAMPLE C

Verification of Superior Surface Activity of Linoleic Acid with Ammonia

Experiments #1 and #2 both begin with 32 mls 5% aqueous ethanol to which is added:

| | |
|---|---|
| #1 | 28 mls C8–10 alcohol<br>4 mls linoleic acid<br>5 mls aqueous ammonia (28% ammonia/72% water) |
| #2 | 32 mls C8–10 |

Note that, as closely as possible, the ethanol:total surfactant ratio is 1:1 for both experiments.

#1

Aqueous ethanol and C8-10 alcohol mix fairly readily, where Freuhoffer lines are visible until mixing is complete.

The addition of linoleic acid produced a milky solution.

The addition of aqueous ammonia produces instant clearing and heat.

When 20 mls of this mixture is added to 80 mls of CA #2 Diesel Freuhoffer lines are evident (Freuhoffer lines are not the same as 'haze', but are clear, oily, lines that resemble smoke wisps). Then the mixture goes perfectly clear, signifying as mentioned above, that the composition is stable.

Previous experiments have shown that linoleic acid and ammonia, together, are a potent (antonic) surfactant that can be depended on to produce stable micro-emulsions, even in the presence of large quantities of very hydrophilic components, namely, methanol and water.

#2

Aqueous ethanol and C8-10 alcohol mixed readily as above.

When 20 mls of this mixture is added to 80 mls of CA#2 Diesel the composition exhibits a very fine haze first, and then clears.

However, previous experiments have shown that the initial haze signifies weaker surface activity than in the experiment where linoleic acid with ammonia did not exhibit any hazy quality when mixed with Diesel fuel.

EXAMPLE D

Verification of Superior Surface Activity of C8-10 Alcohol Combination Over 2EH-1

Experiments #1 and #2 both begin with 32 mis anhydrous methanol to which is added:

| | |
|---|---|
| #1 | 32 mls C8–10 alcohol combination |
| #2 | 32 mls 2 ethyl hexanol 1 |

Alcohols 1 and 2 mixed readily with the methanol, but mixing is not considered complete until Freuhoffer lines disappear. This happens with very gentle swirling of the beaker or stirring.

80 mls of CA #2 Diesel fuel was then poured into each of two separate clean beakers and 20 mls of each of the above alcohol combinations were added respectively, one mixture to each beaker.

#1

The C8-10 alcohol mixture was pearly, hazy at first. It was almost clear, but there is a definite moment when a mixture becomes really clear. It is only then that the mixture can be considered stable.

After 4 minutes, with gentle swirling, the haze had diminished significantly, but not until 5 minutes later that the solution became completely clear.

Therefore, while C8-10 alcohol can be used by itself as the only necessary surfactant when introducing anhydrous methanol into Diesel fuel, it is not ideal for this application, and would benefit from the presence of a stronger surfactant, such as linoleic with ammonia, as described above.

#2

2-ethyl hexanol-1 was cloudy (not hazy) at first, meaning opaque and definitely not leaning toward clearing. Swirling, sloshing, stirring did nothing to promote clearing.

Therefore, 2EH-1 alcohol cannot be used by itself in this ratio as the only necessary surfactant when introducing anhydrous methanol into Diesel fuel and is proven to be a weaker surfactant than the C8-10 combination.

EXAMPLE E

Benefit of Increasing Surface Active Component when Using Relatively Weak Surfactant

#2A additional mls of 2-ethylhexanol-1 (2EH-1) were added to the remaining #2 alcohol mixture, above, producing a methanol 22.27 2EH-1 mixture.

20 mls of this mixture was then added to a beaker with 80 ml of CA Diesel fuel.

The mixture went clear immediately, illustrating that comparatively weak surfactants benefit from an increase in the ration of surfactant to water soluble alcohol.

The many Examples described herein above may use water as a component. It is to be understood in the many examples that when the water content is reduced by half, by quarter or by 90%, equal or better results in combustion improvement are obtained.

While only a few embodiments of the invention have been shown and described herein, it will become apparent to those skilled in the art that various modifications and changes can be made in the present invention to the present additive composition to produce fuel/additive microemulsions with a combustible fuel, without departing from the spirit and scope of the present invention. All such modification and changes coming within the scope of the appended claims are intended to be carried out thereby.

I claim:

1. A combustible fuel composition of combustible liquid fuel and an additive as a clear microemulsion having water present, wherein said combustible liquid fuel is selected from the group consisting of diesel fuel, kerosene, heating oil, coal slurry oil and distilled vegetable oil and said additive comprises:

(a) ethanol having between 0.5 and 25% water by volume of ethanol;

(b) one or more alcohols selected from the group consisting of:

(i) straight- or branched-chain alcohols having between 3 and 5 carbon atoms, and (ii) straight- or branched-chain alcohols having between 6 and 12 carbon atoms;

(c) ethoxylated alcohols having between 6 and 18 carbon atoms, where the ethylene oxide add-on is less than 5 moles, and (d) a fatty acid of the structure R—(C=O)—OH, wherein R is alkyl or alkylene having between about 10 to 24 carbon atoms, in combination with ammonia or urea in an anhydrous state or as an aqueous solution;

wherein components a, b, c, and d as the additive when combined with mixing with the combustible liquid fuel form a clear, stable microemulsion fuel composition having a viscosity within 10% of the original viscosity of the combustible liquid fuel, and wherein the ratio of the combustible liquid fuel to additive ranges from about 50:50 to 99:1 by volume, with the proviso that water is present in the composition sufficient to form the microemulsion and with the proviso that ethylene oxide condensation and ethylene oxide esterification products formed with 1) an alkyl phenol, 2) a fatty acid, or 3) a fatty alcohol where the ethylene oxide add-on is 5 or more moles, 4) a polyol or 5) a polyol and long-chain fatty acid are completely eliminated.

2. The combustible fuel composition of claim 1 where the ratio of combustible liquid fuel to additive is between about 65:35 to 80:20.

3. The combustible fuel composition of claim 1 where the ratio of combustible liquid fuel to additive is between about 80:20 to 90:10.

4. The combustible fuel composition of claim 1 wherein:

in subpart (a) the alcohol is ethanol having between 0.5%–25% water by volume of ethanol; and in subpart (b) one or more alcohols is selected from the group consisting of:

(b)(i) straight- or branched-chain alcohols having between 3 and 5 carbon atoms, (b)(ii) straight- or branched-chain alcohols having between 6 and 12 carbon atoms, and in subpart (c) the ethylene oxide condensation product is of the formula:

$$R'_2—(OCH_2CH_2)_{n_1}OH$$

wherein $R'_2$ is a long-chain saturated or unsaturated hydrocarbon radical containing 12 to 18 carbon atoms, and $n_1$ is an integer from 1 to 4; and in subpart (d) the ammonia or urea is present sufficient to neutralize 40–80% of the fatty acid and completely eliminated are the following compounds:

the ethylene oxide condensation or esterification product formed with (i) an alkyl phenol of the formula:

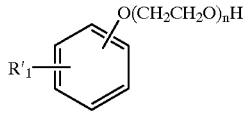

where $R'_1$ is a alkyl chain having up to 8 carbon atoms and n is an integer from 5 to 20;

(ii) a fatty acid of the formula:

$$R'_2—\underset{\underset{O}{\|}}{C}—(O—CH_2—CH_2)_n\,OH$$

(iii) a fatty alcohol of the formula:

$$R'_2—(OCH_2CH_2)_nOH$$

wherein $R'_2$ is a long-chain, saturated or unsaturated hydrocarbon radical containing 12 to 18 carbon atoms, and a is an integer from 5 to 30;

(iv) a polyol having the formula:

$$HOCH_2—(CHOH)_n—CH_2O\underset{\underset{O}{\|}}{C}—R'_3$$

wherein $R'_3$ is a long-chain, saturated or unsaturated hydrocarbon radical containing 12 to 18 carbon atoms, and n is an integer from 1 to 4; or (v) a polyol and long-chain fatty acid having the formula:

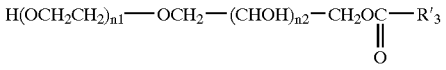

wherein $R'_3$ has the meaning given above, n1 is an integer from 5 to 30 and $n_2$ is an integer from 1 to 4.

5. The combustible fuel composition of claim 1 wherein:

in subpart (b) the alcohol of (b)(i) is selected from straight- or branched-chain alcohols having between 3 and 5 carbon atoms, (b)(ii) is excluded, and subpart (c) is selected from ethoxylated alcohols having between 6 and 18 carbon atoms, where the ethylene oxide add-on is less than 5 moles.

6. The combustible fuel composition of claim 1 wherein in subpart (b) the alcohol (b)(i) is excluded, (b)(ii) is selected from straight- or branched-chain alcohols having between 6 and 12 carbon atoms, and subpart (c) is selected from ethoxylated alcohols having between 6 and 18 carbon atoms, where the ethylene oxide add-on is less than 5 moles.

7. The combustible fuel composition according to claim 1 wherein the ratio of combustible liquid fuel to additive is between about 80:20 to 90:10.

8. The combustible fuel composition according to claim 1 wherein the combustible fuel is diesel fuel.

9. The combustible fuel composition according to claim 8 wherein the ratio of diesel fuel to additive is between about 65:35 to 90:10.

10. The combustible fuel composition according to claim 1 wherein the combustible fuel is kerosene.

11. The combustible fuel composition according to claim 10 wherein the ratio of kerosene to additive is between about 65:35 to 90:10.

12. The combustible fuel composition according to claim 1 wherein the combustible fuel is heating oil.

13. The combustible fuel composition according to claim 12 wherein the ratio of heating oil to additive is between about 65:35 to 90:10.

14. The combustible fuel composition according to claim 1 wherein the combustible fuel is a distilled liquid vegetable oil derived from renewable resources.

15. The combustible fuel composition according to claim 14 wherein the distilled liquid fuel is derived from soybeans, safflower, sunflower, linseed, cottonseed, corn, rapeseed, or tall oil.

16. The combustible fuel composition according to claim 14 wherein the ratio of distilled liquid derived from renewable resources to additive is between about 65:35 to 90:10.

17. The combustible fuel composition according to claim 1 wherein the combustible fuel is coal slurry.

18. The combustible fuel according to claim 17 wherein the ratio of coal slurry to additive is between about 65:35 to 90:10.

19. A combustible fuel composition of combustible liquid fret selected from diesel fuel, kerosene, heating oil, coal slurry oil and distilled vegetable oil and an additive as a clear microemulsion with water present wherein said additive comprises:

(a) ethanol having between 0.5 and 10% water by volume of ethanol;

(b) one or more alcohols selected from the group consisting of:

(i) straight- or branched-chain alcohols having between 3 and 5 carbon atoms, and (ii) straight- or branched-chain alcohols having between 6 and 12 carbon atoms;

(c) ethoxylated alcohols having between 6 and 18 carbon atoms, where the ethylene oxide add-on is less than 5 moles;

(d) a fatty acid of the structure R—(C═O)—OH, wherein R is alkyl or alkylene having between about 10 to 24 carbon atoms, in combination with ammonia or urea in an anhydrous state or as an aqueous solution and the ammonia or urea is present sufficient to neutralize about 40–80% of the fatty acid;

wherein components a, b, c, and d as the additive when combined with mixing with the combustible liquid fuel form a clear, stable microemulsion fuel composition having a viscosity within 10% of the original viscosity of the combustible liquid fuel, and wherein the ratio of the combustible liquid fuel to additive ranges from about 50:50 to 99:1 by volume, with the proviso that water is present in the composition sufficient to form the microemulsion and with the proviso that ethylene oxide condensation and ethylene oxide esterification products formed with 1) an alkyl phenol, 2) a fatty acid, or 3) a fatty alcohol where the ethylene oxide add-on is 5 or more moles 4) a polyol or 5) a polyol and long-chain fatty acid are completely eliminated.

20. The combustible fuel composition of claim 19 wherein;

in subpart (b) the alcohol (b)(i) is selected from straight- or branched-chain alcohols having between 3 and 5 carbon atoms (b)(ii) is excluded, and subpart (c) is ethoxylated alcohols having between 6 and 18 carbon atoms, where the ethylene oxide add-on is less than 5 moles.

21. The combustible fuel composition of claim 19 wherein in subpart (b) the alcohol (b)(i) is excluded, (b)(ii) is selected from straight- or branched-chain alcohols having between 6 and 12 carbon atoms, and subpart (c) is selected from ethoxylated alcohols having between 6 and 18 carbon atoms, where the ethylene oxide add-on is less than 5 moles.

22. The combustible fuel composition of claim 19 where the ratio of combustible liquid fuel to additive is between about 65:35 to 80:20.

23. The combustible fuel composition of claim 19 where the ratio of combustible liquid fuel to additive is between about 80:20 to 90:10.

24. A combustible fuel composition of combustible liquid fuel selected from diesel fuel, kerosene, heating oil, coal slurry oil and distilled vegetable oil and an additive as a clear microemulsion with water present wherein said additive comprises:

(a) ethanol having between 5 and 10% water by volume of ethanol;

(b) one or more alcohols selected form the group consisting of:

(i) straight- or branched-chain alcohols having between 3 and 5 carbon atoms, and (ii) straight- or branched-chain alcohols having between 6 and 12 carbon atoms;

(c) ethoxylated alcohols having between 6 and 18 carbon atoms, where the ethylene oxide add-on is less than 5 moles.

(d) a fatty acid of the structure R—(C═O)—OH, wherein R is alkyl or alkylene having between about 10 to 24 carbon atoms, in combination with ammonia or urea in an anhydrous state or as an aqueous solution and the ammonia or urea is present sufficient to neutralize about 40–80% of the fatty acid;

wherein components a, b, c, and d, as the additive when combined with mixing with combustible liquid fuel form a clear, stable micro emulsion fuel composition having a viscosity with 10% of the original viscosity of the combustible liquid fuel, and wherein the ratio of the combustible liquid fuel to additive ranges from about 50:50 to 99:1 by volume, with the proviso that water is present in the composition sufficient to form the microemulsion and with the proviso that ethylene oxide condensation and ethylene oxide esterification products formed with 1) an alkyl phenol, 2) a fatty acid, 3) a fatty alcohol where the ethylene oxide add-on is 5 or more moles, 4) a polyol or 5) a polyol and long-chain fatty acid are completely eliminated.

25. The combustible fuel composition of claim 24 wherein;

in subpart (b) the alcohol of (b)(i) is straight or branched-chain alcohols having between 3 and 5 carbon atoms, (b)(ii) is excluded, and (c) is ethoxylated alcohols having between 6 and 18 carbon atoms, where the ethylene oxide add-on is less than 5 moles.

26. The combustible fuel composition of claim 24 wherein in subpart (b) the alcohol (b)(i) is excluded, (b)(ii) is selected from straight- or branched-chain alcohols having between 6 and 12 carbon atoms, and subpart (c) is selected from ethoxylated alcohols having between 6 and 18 carbon atoms, where the ethylene oxide add-on is less than 5 moles.

27. The combustible fuel composition of claim 24 where the combustible fuel is diesel fuel and the ratio of diesel fuel to additive is between about 65:35 to 80:20.

* * * * *